US006168709B1

(12) United States Patent
Etter

(10) Patent No.: US 6,168,709 B1
(45) Date of Patent: Jan. 2, 2001

(54) PRODUCTION AND USE OF A PREMIUM FUEL GRADE PETROLEUM COKE

(76) Inventor: Roger G. Etter, 217 S. Marion St., Cardington, OH (US) 43315

( * ) Notice: Under 35 U.S.C. 154(b), the term of this patent shall be extended for 0 days.

(21) Appl. No.: 09/137,283

(22) Filed: Aug. 20, 1998

(51) Int. Cl.[7] ..... C10G 9/14; C10L 7/00

(52) U.S. Cl. ..... 208/131; 208/132; 44/530; 44/607

(58) Field of Search ..... 208/131, 132; 44/281, 607, 532

(56) References Cited

U.S. PATENT DOCUMENTS

| | | | | |
|---|---|---|---|---|
| Re. 20,011 | | 6/1936 | Pelzer | 202/15 |
| 1,831,719 | | 11/1931 | Pelzer . | |
| 1,873,024 | | 8/1932 | Pelzer . | |
| 2,881,130 | | 4/1959 | Pfeiffer et al. | 208/127 |
| 3,617,480 | | 11/1971 | Kneel | 208/50 |
| 3,661,543 | | 5/1972 | Saxton | 8/206 |
| 3,702,816 | | 11/1972 | Bachmann et al. . | |
| 3,775,290 | | 11/1973 | Peterson et al. | 208/50 |
| 3,775,294 | | 11/1973 | Peterson et al. | 208/89 |
| 3,816,084 | | 6/1974 | Moser, Jr. et al. | 5/72 |
| 3,852,047 | * | 12/1974 | Schlinger et al. | 44/24 |
| 3,896,023 | | 7/1975 | Ozaki et al. | 208/46 |
| 3,917,564 | | 11/1975 | Meyers | 208/131 |
| 3,932,587 | | 1/1976 | Grantham et al. | 423/242 |
| 4,043,898 | | 8/1977 | Kegler | 208/50 |
| 4,049,537 | | 9/1977 | Hayashi et al. | 208/50 |
| 4,055,484 | | 10/1977 | Blaser et al. | 208/127 |
| 4,096,097 | | 6/1978 | Yan | 252/510 |
| 4,100,035 | | 7/1978 | Smith | 7/78 |
| 4,178,229 | | 12/1979 | McConaghy et al. | 208/50 |
| 4,188,277 | | 2/1980 | Martin | 204/190 |
| 4,198,380 | | 4/1980 | Kohl | 423/242 |
| 4,269,696 | | 5/1981 | Metrailer | 208/120 |
| 4,295,956 | | 10/1981 | Metrailer | 208/127 |
| 4,302,324 | | 11/1981 | Chen et al. | 208/131 |
| 4,312,742 | | 1/1982 | Hayashi | 208/50 |
| 4,364,741 | | 12/1982 | Villa | 44/51 |
| 4,388,152 | | 6/1983 | Wasson et al. | 201/6 |
| 4,441,887 | | 4/1984 | Funk | 44/51 |
| 4,443,415 | | 4/1984 | Queneau et al. | 423/68 |
| 4,477,259 | | 10/1984 | Funk | 44/51 |
| 4,478,602 | | 10/1984 | Kelley et al. | 44/51 |
| 4,479,804 | | 10/1984 | Chen et al. | 44/1 SR |
| 4,481,101 | | 11/1984 | Yan | 208/50 |
| 4,490,171 | * | 12/1984 | Suzuki et al. | 75/42 |
| 4,519,898 | | 5/1985 | Allan | 208/131 |
| 4,521,277 | | 6/1985 | Calderon et al. | 196/46 |
| 4,547,284 | | 10/1985 | Sze et al. | 208/50 |
| 4,551,232 | | 11/1985 | Calderon et al. | 208/92 |
| 4,631,025 | | 12/1986 | Casper et al. | 432/15 |
| 4,666,585 | | 5/1987 | Figgins et al. | 208/131 |
| 4,828,680 | | 5/1989 | Green et al. . | |
| 4,853,106 | | 8/1989 | Grove et al. | 208/131 |
| 4,874,505 | | 10/1989 | Bartilucci et al. | 208/131 |
| 4,895,636 | | 1/1990 | Chen et al. . | |
| 5,009,767 | | 4/1991 | Bartilucci et al. | 208/85 |
| 5,015,362 | | 5/1991 | Chin . | |
| 5,034,030 | | 7/1991 | Miller et al. | 55/96 |
| 5,110,448 | | 5/1992 | Adams et al. . | |
| 5,114,564 | | 5/1992 | Goyal | 208/131 |
| 5,114,566 | | 5/1992 | Naeger et al. | 208/289 |
| 5,165,902 | | 11/1992 | Bortz et al. | 423/235 |
| 5,215,557 | | 6/1993 | Johnson et al. | 55/122 |
| 5,246,680 | | 9/1993 | Pikkujämsä | 423/244.07 |
| 5,258,115 | | 11/1993 | Heck et al. | 208/131 |
| 5,277,795 | | 1/1994 | Thornhill et al. | 208/251 |
| 5,339,755 | | 8/1994 | Smith | 110/345 |
| 5,350,503 | | 9/1994 | Freymeyer et al. | 208/131 |
| 5,439,658 | | 8/1995 | Johnson et al. | 423/243.07 |
| 5,470,556 | | 11/1995 | Samish | 423/243.08 |
| 5,490,918 | | 2/1996 | Meek | 208/131 |
| 5,496,792 | | 3/1996 | Monticello | 435/282 |
| 5,529,599 | * | 6/1996 | Calderon | 75/10.63 |
| 5,591,326 | | 1/1997 | Shih | 208/251 R |
| 5,635,149 | | 6/1997 | Klingspor et al. | 423/243.08 |
| 5,651,948 | | 7/1997 | Myers et al. | 423/244.07 |

OTHER PUBLICATIONS

Fletcher, Peter, Delayed Coking, *Chem. Engineer,* Sep./Oct.(1983), 21–23.

Janssen et al., Improved Coking Design Can Up Liquid Yields, *Oil & Gas J.* (Jun. 25, 1984) 79–83.

Lieberman, Norman, Shot Coke: Its Origins and Prevention, Oil & Gas J. (Jul. 8, 1985) 45–46.

(List continued on next page.)

*Primary Examiner*—Bekir L. Yildirim
(74) *Attorney, Agent, or Firm*—Standley & Gilcrest LLP

(57) ABSTRACT

A premium "fuel-grade" petroleum coke is produced by modifying petroleum coking technology. Coking process parameters are controlled to consistently produce petroleum coke within a predetermined range for volatile combustible material (VCM) content. The invention includes a process of producing a coke fuel, the method comprising steps: (a) obtaining a coke precursor material derived from crude oil and having a volatile organic component; and (b) subjecting the coke precursor material to a thermal cracking process for sufficient time and at sufficient temperature and under sufficient pressure so as to produce a coke product having a volatile combustible material (VCM) present in an amount in the range of from about 13% to about 50% by weight. Most preferably, the volatile combustible material in the coke product typically may be in the range of from about 15% to about 30% by weight. The present invention also provides methods for (1) altering the coke crystalline structure, (2) improving the quality of the coke VCM, and (3) reducing the concentration of coke contaminants. Fuels made from the inventive coke product and methods of producing energy through the combustion of such fuels are also included. Finally, novel environmental control techniques are developed to take optimal advantage of the unique characteristics of this upgraded petroleum coke.

21 Claims, 5 Drawing Sheets

OTHER PUBLICATIONS

Lieberman, Norman, Good Operating Techiques Improve Coker Yeild, Increase Gas–Oil Production, Oil & Gas J. (Mar. 10, 1986) 53–54.
Lieberman, Norman, Procedure Reduces Coke Cuttng Time for Large Drums, Gas & Oil J. (Nov. 24, 1986) 85–86.
Barnett, Jack, Desalters Can Remove More Than Salts and Sediment, Oil & Gas J. (Apr. 11, 1988) 43–49.
Archuletta et al., Cooperative Corrosion Control and Treatment Program Proves Effective, Gas & Oil J. (Aug. 6, 1990) 60–68.
Elliott, John, Design Operation Factors Can Up Coker Liquid Yields, Gas & Oil J. (Feb. 4, 1991) 41–44.
Filtration Method Efficiently Desalts Crude In Commercial Test, Gas & Oil J. (May 17, 1993) 59–60.
Bansal et al., Improve Your Coking Process, Hydrocarbon Processing (Feb. 1994) 63–66.
Stefani, A., Debottleneck Delayed Cokers For Greater Profitability, Hydorcarbon Processing (Jun. 1996) 99–103.
Harris, J.R., Use Desalting For FCC Feedstocks, Hydrocarbon Processing (Aug. 1996) 63–68.
Dickenson, et al., Refiner Options for Converting and Utilizing Heavy Fuel Oil, Hydorcarbon Processing (Feb. 1997) 57–62.
Auxillary Equipment, Corrosion Focus of Refining Meeting, Oil & Gas J. (Apr. 4, 1994).
Wagoner et al., Bruning Profiles For Solid Fuels, Amer. Soc. Mech. Eng. (Aug. 7, 1967) 1–8.
Reid, William, Ash Chemistry And Its Effect In Broiler Furnaces, Elec. Power Res. Inst. (Dec. 2, 1980) 1–13.
Burning Petroleum Coke: Boiler/Complex FGD or Fluid–Bed Combustor?, (Jul. 7, 1983).
Lieberman, Norman, Time for Coking Cycle Can Be Routinely Halved, Oil & Gas J. (Aug. 29, 1983) 39–44.
Delayed Coking, Hydrocarbon Processing (Sep. 1984) 113.
Kronenberger et al., Troubleshotting the Refinery Desalter Operation, Materials Performance (Jul. 1986) 9–17.
Muzio et al., Dry Sorbent Emission Control Technologies, JAPC Assoc. (May 1987) 642–654.
Deepwater Fires 100% Coke, Sells All FGD Gypsoum Product, Power (Oct. 1988).
Lieberman, Norman, Frequently Asked Questions On Coke Quality Answered, Oil & Gas J. (Mar. 27, 1989) 67–69.
Makansi, Jason, Clean Air Act Amendments: The Engineering Response, Power (Jun. 1991) 11–60.
Herzog et al., Feasibility, Modeling and Economics of Sequestering Power Plant $CO_2$ Emissions In the Deep Ocean, Envior. Progress vol. 10 (Feb. 1991) 64–74.
Elliott, J.D., Maximize Distillate Liquid Products, Hydrocarbon Proc. (Jan. 1992) 75–80.
Sulfur Dioxide Control, Steam 40 (1992) Chapter 35.
Fuel Ash Effects on Boiler Design and Operation, Steam 40 (1992) Chapter 20(ppl–28).
Sources of Chemical Energy, Steam 40 (1992) Chapter 8.
Burners and Combustion Systems for Pulverized Coal, Steam 40 (1992) Chapter 13.
Kent, James, Handbook of Industrial Chemistry, Published by Van Norstrand Reinhold (1992).
Rittenhouse, R.C., Action Builds On The Road To CAA Compliance (Part II), Power Eng. (Jun. 1992) 43–50.
Batra et al, Desing Process Equipment for Corrosion Control, Chem. Eng. Prog. (May 1993) 68–76.
Livengood et al., FG Technologies for Combined Control of $SO_2$ and $NO_x$, Power Eng. (Jan. 1994) 38–42.
Torrens et al., Electric Utility Response to the Clean Air Act Amendments, Power Eng. (Jan. 1994) 43–47.
Coke Quality, Oil & Gas J. (May 2, 1994) 114–115.
Wolsky et al, $CO_2$ Capture From the Flue Gas of Conventional Fossil–Fuel–Fired Power Plants, Envr. Progress vol. 13 (Aug. 1994) 214–219.
Chue et al., Comparison of Activated Carbon and Zeolite 13X for $CO_2$ Recovery From Flue Gas by Pressure Swing Adsorption, Amer. Chem. Soc. (1995) 591–598.
Akai et al., Performance Evaluation of Fossil Power Plant With $CO_2$ Recovery and Sequestering System, Energy Convers. Mgmt. vol. 36 Nos. 6–9(1995) 801–804.
Coking/Catalytic Cracking/Catalytic Reforming, HydroCarbon Processing (Oct. 1996).
Refining 1996, HydroCarbon (Nov. 1996).
Sincero & G.A. Sincero, Environmental Engineering A Design Approach, Types of Control (625–633).
Bisio & A. Boots, Air Pollution Control Methods, The Wiley Encypoledia Energy and the Environment (vol. 1), 85–91.
Kiely, Gerard, Environmental Engineering, (344–345) & (757–776).
Handbook of Petroleum Refining Processes, (Jul. 16–Jul. 29).
Delayed Cooking, Chapter 5 (52–64).
Kirk–Othmer Ency. of Chem. Tehc. 3rd Ed., vol. 17 (194–219).
Kirk–Othmer Ency. of Chem Tech., 4th Ed., vol. 18 (433–469).
Ency. of Chem. Processing and Design, vol. 10 (1–41).

* cited by examiner

PRODUCTION AND USE OF A PREMIUM FUEL GRADE PETROLEUM COKE

BACKGROUND OF THE INVENTION

1. Field of the Invention

This invention relates generally to the field of petroleum coking processes, and more specifically to modifications of petroleum coking processes for the production of a premium-quality, "fuel-grade" petroleum coke. This invention also relates generally to the use of this new formulation of petroleum coke for the production of energy, and more specifically to modifications in conventional, solid-fuel furnaces and environmental control systems to take optimal advantage of its unique properties.

2. Description of Prior Art

Since initial efforts to refine crude oil in the U.S. during the late 1800s, the search for an appropriate use for the heaviest fractions of crude oil (i.e. the "bottom of the barrel") has been a perplexing problem. Initially, many refineries received little to no value from the heaviest fractions of crude oil. Some were noted to simply discard the "bottom of the barrel." Over time, some of the heavy crude oil fractions were used in asphalt products and residual fuel oils. However, the demand for these products was not sufficient to consume increasing production.

As demand for transportation fuels (e.g. gasoline, diesel, and aviation fuels) increased in the early 1900s, thermal cracking processes were developed to convert the heavy crude oil fractions into lighter products. These refinery processes evolved into the modern coking processes that predominate the technology currently used to upgrade the heaviest fractions of the crude oil. These processes typically reduce the quantity of heavy oil fractions, but still produce unwanted by-products (e.g. petroleum coke) with marginal value.

A. Production of Petroleum Coke, Coking Processes

In general, modern coking processes employ high-severity, thermal decomposition (or "cracking") to maximize the conversion of very heavy, low-value residuum feeds to lower boiling hydrocarbon products. Coker feedstocks typically consist of non-volatile, asphaltic and aromatic materials with "theoretical" boiling points exceeding 1000° F. at atmospheric pressure. The boiling points are "theoretical" because these materials coke or crack from thermal decomposition before they reach such temperatures.

Coking feedstocks normally consist of refinery process streams which cannot economically be further distilled, catalytically cracked, or otherwise processed to make fuel-grade blend streams. Typically, these materials are not suitable for catalytic operations because of catalyst fouling and/or deactivation by ash and metals. Common coking feedstocks include atmospheric distillation residuum vacuum distillation residuum, catalytic cracker residual oils, hydrocracker residual oils, and residual coils from other refinery units. Consequently, coking feedstocks vary substantially among refineries. Their composition and quantity primarily depend on (1) the input crude oil blend, (2) refinery processing equipment, and (3) the optimized operation plan for any particular refinery. In addition, contaminant compounds, which occur naturally in the crude oil, generally have relatively high boiling points and relatively complex molecular structures. Consequently, these contaminant compounds, containing sulfur and heavy metals, tend to concentrate in these residua. Many of the worst process streams in the refinery have become coker feedstock, and their contaminants usually end up in the petroleum coke by-product. For this reason, the coking processes have often been labeled as the "garbage can" of the refinery.

There are three major types of modern coking processes currently used in refineries to convert the heavy crude oil fractions into lighter hydrocarbons and petroleum coke: Delayed Coking, Fluid Coking®, and Flexicoking®. In all three of these coking processes, the petroleum coke is considered a by-product that is tolerated in the interest of more complete conversion of refinery residues to lighter hydrocarbon compounds, referred to as "cracked liquids" throughout this discussion. These cracked liquids range from pentanes to complex hydrocarbons with boiling ranges typically between 350 and 950° F. The heavier cracked liquids (e.g. gas oils) are commonly used as feedstocks for further refinery processing that transforms them into transportation fuel blend stocks.

The delayed coking process has evolved with many improvements since the mid-1930s. Essentially, delayed coking is a semi-continuous process in which the heavy feedstock is heated to a high temperature (between 900° F. and 1000° F.) and transferred to large coking drums. Sufficient residence time is provided in the coking drums to allow the thermal cracking and coking reactions to proceed to completion. The heavy residua feed is thermally cracked in the drum to produce lighter hydrocarbons and solid, petroleum coke. One of the initial patents for this technology (U.S. Pat. No. 1,831,719) discloses "The hot vapor mixture from the vapor phase cracking operation is, with advantage, introduced into the coking receptacle before its temperature falls below 950° F., or better 1050° F., and usually it is, with advantage, introduced into the coking receptacle at the maximum possible temperature." The "maximum possible temperature" in the coke drum favors the cracking of the heavy residua, but is limited by the initiation of coking in the heater and downstream feed lines, as well as excessive cracking of hydrocarbon vapors to gases (butane and lighter). When other operational variables are held constant, the "maximum possible temperature" normally minimizes the volatile material remaining in the petroleum coke by-product. In delayed coking, the lower limit of volatile material in the petroleum coke is usually determined by the coke hardness. That is, petroleum coke with <8 wt. % volatile materials is normally so hard that the drilling time in the decoking cycle is extended beyond reason. Various petroleum coke uses have specifications that require the volatile content of the petroleum coke by-product be <12%. Consequently, the volatile material in the petroleum coke by-product typically has a target range of 8–12 wt. %. Prior art in the delayed coking process, including recent developments, has attempted to maximize the production of cracked liquids with less coke production. In this manner, the prior art of delayed coking has attempted to minimize coke yield and the amount of volatile materials it contains.

Fluid Coking®, developed since the late 1950s, is a continuous coking process that uses fluidized solids to increase the conversion of coking feedstocks to cracked liquids, and further reduce the volatile content of the product coke. In Fluid Coking®, the coking feedstock blend is sprayed into a fluidized bed of hot, fine coke particles in the reactor. Since the heat for the endothermic cracking reactions is supplied locally by these hot particles, this permits the cracking and coking reactions to be conducted at higher temperatures (about 480–565° C. or 900–1050° F.) and shorter contact times than in delayed coking. Roughly 15–25% of the coke is burned in an adjacent burner vessel in order to create the hot coke nuclei to contact the feed in the reactor vessel, and satisfy the process heat requirements. The Fluid Coking technology effectively removes the lower limit of volatile content in the petroleum coke, associated with delayed coking. The volatile content of the petroleum coke produced by the Fluid Coking® technology is typically minimized (or reduced), within the range of 4–10 wt. %. Consequently, the quantity of petroleum coke, produced by a given feedstock, and its volatile content are significantly reduced in the Fluid Coking® technology (vs. delayed coking).

Flexicoking® is an improvement of the Fluid Coking® process, in which a third major vessel is added to gasify the product coke. A coking reactor, a heater (vs. burner) vessel, and a gasifier are integrated into a common fluidized-solids circulating system. The "cold coke" from the reactor is partially devolatilized in the heater vessel. In the gasifier, over 95% of the gross product coke is gasified to produce either low heating-value fuel gas or synthesis gas to make liquid fuels or chemicals. In this manner, the net coke yield is substantially reduced. The purge coke (~5% of the product coke) from the Flexicoking® process normally contains about 99% of the feed metals and has a volatile content of 2–7 wt %.

Through the years, improvements in the coking processes have been substantially devoted to increasing the yield and recovery of cracked liquids and decreasing the coke yield. Thus, the content of volatile material in the resulting petroleum coke has been continually decreased, where possible. Various patents disclose improvements to the delayed coking process that include, but are not limited to, (1) coker designs that reduce drum pressures (e.g. 25 to 15 psig), (2) coker designs to provide virtually no recycle, and (3) periodic onstream spalling of heaters to increase firing capabilities and run length at higher heater outlet temperatures. These technology advances have been implemented in an effort to maximize the cracked liquid yields of the delayed coker and reduce petroleum coke yields and volatile content.

Other modifications of these coking processes introduce various wastes for disposal. Several patents disclose various means to inject certain types of oily sludges. Other prior art uses these coking processes for the disposal of used lubricating oils. Additional patents disclose the use of these coking processes for the disposal of other wastes. In general, these patents discuss the potential limited impact on the coke yield and volatile content, and promote other means to negate any increases. Also, these waste disposal techniques often increase the ash content of the coke and can introduce additional, undesirable impurities, such as sodium. Consequently, the objectives of these patents are to reuse or dispose of these wastes rather than enhance the petroleum coke properties.

B. Uses of Petroleum Coke

The uses of the petroleum coke by-products from these coking processes depend primarily on its (1) physical properties and (2) chemical composition (i.e. degree of contamination). The physical properties (density, crystalline structure, etc.) of the petroleum coke by-product are determined by various factors, including coking feedstock blend, coking process and operation, and volatile content of the coke. The chemical composition and degree of contamination of the petroleum coke is primarily determined by the composition of the coking feedstock blend. That is, most of the contaminant compounds (e.g. sulfur, nitrogen, and various metals) in the petroleum coke by-product come from heavy, complex chemical structures in the coking feedstocks, which normally come from the refinery's crude oil blend. Conversely, the contaminants in the refinery's crude oil blend ultimately concentrate in the petroleum coke. Consequently, light, sweet crudes generally have less contaminants and allow the production of higher value petroleum coke by-products. However, crude oils are becoming increasingly heavy and sour, increasing the production of low-grade petroleum coke.

Premium and intermediate grades of petroleum cokes have low to moderate levels of sulfur (e.g. 0.5–2.5%) and heavy metals (vanadium, nickel, etc.). These grades of coke have various uses as electrodes and metallurgical carbon in the production of aluminum and steel. In some applications, the raw petroleum coke is further processed by calcining to remove volatile material and increase the coke density. Petroleum coke that cannot meet the required specifications of these higher-value markets is classified as "fuel-grade" petroleum coke. As such, this poorest grade of petroleum coke typically has high concentrations of sulfur (2.5–5+ wt. %) and/or heavy metals, including vanadium and nickel.

"Fuel-grade" petroleum coke is actually a misnomer. The traditional "fuel-grade" petroleum coke actually performs very poorly as a fuel. First of all, traditional "fuel-grade" petroleum coke cannot sustain self-combustion due to its poor fuel properties and combustion characteristics. Secondly, its high sulfur content (e.g. >2.5 wt. %) creates substantial environmental problems, particularly in the United States. Thirdly, high concentrations of certain metals can be precursors for post-combustion, liquid salts that deposit on heat transfer surfaces, reducing efficiency and/or causing accelerated corrosion. Finally, high concentrations of sulfur and/or metals can detrimentally effect product quality, when used as fuel directly in chemical processes (e.g. concrete kilns). Consequently, traditional "fuel-grade" petroleum coke can only be used in conventional furnaces when combined with other fuels (often requiring separate fuel processing and management systems). Alternatively, specially designed combustion systems, that are cumbersome and expensive, can use this coke as fuel. Until these deficiencies are addressed, the traditional "fuel-grade" petroleum coke will continue to be a very low value product. In fact, traditional "fuel-grade" petroleum coke could be classified as a hazardous waste in the United States, if its value continues its downward trend and refiners receive no sales value as a product. In this scenario, costs of hazardous waste disposal could dramatically reduce refinery profitability, and cause the shutdown of many refineries across the United States.

Numerous technologies were apparently developed to modify coking feedstocks and produce petroleum coke of sufficient quality for non-fuel uses of higher value. Many patents disclose various technologies for removing or diluting certain undesirable contaminants in the petroleum coke. As such, they go far beyond the degree of decontamination that is required for petroleum coke used as a fuel. Accordingly, simpler approaches that are less expensive and less complicated are desirable for the lower level of decontamination required for petroleum coke used as a fuel.

Various combustion technologies have been developed to overcome the deficiencies in "fuel-grade" coke, but no prior art successfully addresses these problems by upgrading the coke via the coking process. The prior art has failed to upgrade the quality of "fuel-grade" petroleum coke sufficiently to use in conventional, solid-fuel combustion systems (e.g. high heat capacity furnaces with suspension burners firing pulverized fuel, such as coal). Specially designed combustion systems (noted above) include fluidized bed combustion, pyrolysis/gasification systems, and low heat capacity furnaces (i.e. without heat absorption surfaces). In general, these systems are cumbersome, expensive, and have significant problems in scaling size upward. Several patents also disclose technologies to grind and stabilize coke/oil mixtures for use in conventional combustion systems. However, the quality of the traditional petroleum coke used in these fuel mixtures normally limits (1) the particle size distribution of the solids and (2) the degree of combustion (i.e. carbon burnout).

In summary, prior art does not address the major problems associated with traditional "fuel-grade" petroleum coke:

1. There remains a major need to produce "fuel-grade" petroleum coke that is able to sustain self-combustion with acceptable combustion efficiencies.
2. Secondly, no known prior art satisfactorily resolves the problems associated with the formation of sticky, corrosive salts in the combustion process, due to certain contaminants in the petroleum coke.
3. Finally, prior art does exist for the desulfurization and demetallization of petroleum coke, but it is complicated and expensive. Simpler approaches are needed for the lower level of decontamination required for petroleum coke used as a fuel.

OBJECTS AND ADVANTAGES OF THE INVENTION

Accordingly, it is an object of the present invention to provide a petroleum coke fuel that is able to (1) sustain self-combustion with acceptable combustion efficiencies, (2) sufficiently reduce the corrosive ash deposits harmful to the combustion system, and (3) reduce the need for complicated and expensive coke decontamination processes and environmental control systems, including elaborate pollution control equipment in the combustion system.

The present invention successfully addresses the problems associated with traditional "fuel-grade" petroleum coke, which other technologies have failed to do. This invention provides the following unique features, that produce new and unexpected results:

1) Modifications in the coking process provide the ability to control the quantity and quality of volatile combustible material (% VCM in the petroleum coke. Acceptable levels of porous, combustible carbon residue in the product coke (related to the crystalline structure of the coke) are also assured by these and further modifications. Consequently, the present invention produces a petroleum coke that is capable of self-combustion. That is, the upgraded petroleum coke can be successfully burned in conventional, solid-fuel furnace systems without auxiliary fuel or the need to mix with other fuels.
2) Process modifications reduce quantities of certain salt and metal contaminants to acceptable levels in the petroleum coke. These modifications address potentially problematic combustion products (sticky, corrosive salts) that deposit on downstream heat exchange and pollution control equipment.
3) Combustion process modifications address high sulfur levels in the petroleum coke that are environmentally prohibitive. Complicated and expensive desulfurization technologies of the prior art are not required for petroleum coke decontamination. These modest combustion process modifications offer a simpler approach to the control of sulfur oxide and particulate emissions. Similar process modifications (further embodiments of this invention) can provide the opportunity to reduce other flue gas emissions, including nitrogen oxides, carbon dioxide, air toxics, etc. In this manner, the optimal reductions in particulates, sulfur oxides, and other undesirable flue gas components can be achieved.

Utility of the Invention

The present invention provides a superior "fuel-grade" petroleum coke for many solid-fuel and/or chemical feedstock applications while improving overall operations, maintenance, and profitability in the oil refinery.

The present invention provides the means to control the concentrations of volatile combustible material, crystalline structure, and undesirable contaminants in a manner that produces a premium, fuel-grade petroleum coke. This upgraded petroleum coke has qualities that make it superior to the traditional "fuel-grade" petroleum coke, various types of coals, and other solid fuels. In most solid fuel applications, these improved characteristics provide potential users better combustion, higher energy efficiency, substantially improved pollution control, and significantly lower operating and maintenance costs. Alternatively, this premium fuel-grade coke can be partially oxidized via gasification processes to provide chemical feedstocks or low-quality, gaseous fuels.

The present invention produces a high-value product from the "bottom of the barrel" for many refineries. The present invention is also less sensitive (compared to prior art) to undesirable contaminants in the crude oil mixture being processed by a typical refinery. Consequently, the present invention improves the flexibility to process various crudes, including low-cost crudes, that are heavy, sour and/or contain high levels of metals or asphaltenes. As the world supplies of light, sweet crude decreases, this benefit has greater utility, since much greater quantities of "fuel-grade" coke will be produced from the remaining heavy, sour crude oils. In addition, the process modifications of this invention are expected to (1) improve operation and maintenance of the coker process, (2) potentially increase coker and refinery throughput, and (3) improve other refinery operations. All of these factors potentially improve the overall refinery profitability.

Further objects and advantages of this invention will become apparent from consideration of the drawings and ensuing descriptions.

SUMMARY OF THE INVENTION

It has been discovered that an upgraded petroleum coke can have much better fuel properties and combustion characteristics than coals with significantly higher (or comparable) levels of volatile combustible materials (VCM). In addition, the unique characteristics of this upgraded petroleum coke create the opportunity for applications of novel environmental control technologies to meet or exceed environmental requirements. Surprisingly, these novel and unexpected results can be produced with modest modifications to the existing coking processes and combustion systems. However, both the production and use of this new formulation of petroleum coke are contrary to conventional wisdom and current trends in the petroleum coking processes and solid fuel combustion systems.

1. Coking Processes

Conventional wisdom and current trends in the petroleum coking processes focus on coking designs and operations that (1) maximize the production and recovery of cracked liquid hydrocarbons and (2) minimize the level of volatile combustible material in the resulting coke. In contrast, the modified coking process of the present invention gives priority to producing a petroleum coke with consistently higher volatile combustible material of sufficient quality for self-combustion. This modified process also promotes a coke crystalline structure that is more conducive to good combustion. In many cases, low-level decontamination of the petroleum coke to acceptable levels is also achieved to eliminate (or reduce) the formation of corrosive ash deposits in the combustion process. Surprisingly, the present invention, in all its embodiments, can produce a premium, "fuel-grade" petroleum coke, capable of self-combustion with superior fuel properties and combustion characteristics, while decreasing cracked liquid conversion efficiency by <15% (preferably <5%). The present invention discusses various means to offset (or limit) the loss of cracked liquid yield. In certain situations, the present invention can upgrade the petroleum coke fuel, while actually increasing overall cracked liquids production, due to potential increases in coker and/or refinery throughput.

In general terms, the invention includes a process of producing a coke fuel, the method comprising steps: (a) obtaining a coke precursor material derived from crude oil, and having a volatile organic component; and (b) subjecting the coke precursor material to a thermal cracking process for sufficient time and at sufficient temperature and under sufficient pressure so as to produce a coke product having a volatile combustible material (VCM) present in an amount in the range of from about 13% to about 50% by weight. Most preferably, the volatile combustible material in the coke product typically may be in the range of from about 15% to about 30% by weight. The thermal cracking process of the present invention may include a process selected from the group consisting of delayed coking processes and Fluid Coking® processes. As used herein, "volatile combustible material" (VCM) is defined by ASTM Method D 3175. In the present invention, all the VCM is contained in the coke precursor material derived from crude oil or added to the coking process; as contrasted with any substantial volatile organic component (e.g. fuel oil) that has been added to a coke product after the coking process is complete.

In some cases, a consistently higher VCM level will be all that is necessary to provide petroleum coke capable of self-combustion. Process controls of the prior art typically minimize VCM in the by-product petroleum coke. That is, coking units in the prior art typically have operational setpoints to produce by-product petroleum coke with VCM levels below 12%. In contrast, the present invention discusses various means to increase and consistently maintain higher coke VCM levels for various coking processes, including delayed and Fluid® coking processes. A "minimum acceptable" VCM specification (e.g. >15% VCM) is discussed as the preferred means of maintaining product quality.

In many cases, altering the petroleum coke crystalline structure will also be required to produce petroleum coke capable of self-combustion. In most (but not all) cases, altering the crystalline structure will enhance combustion characteristics and reduce the "minimum-acceptable" VCM specification. The present invention discusses various means to promote favorable coke crystalline structure. In the preferred embodiment, the coker process changes that increase and consistently maintain the desired VCM level also promote greater production of the more desirable sponge coke (vs. shot coke or needle coke). That is, the organic compounds, creating the higher VCM in the coke, are expected to alter the coke formation mechanisms (i.e. thermal vs. asphaltic coke) to favor sponge coke production. The sponge coke crystalline structure is preferable due to higher porosity and softness, which greatly improve its combustion characteristics. Further embodiments are provided to inhibit the formation of undesirable dense, spherical coke, called "shot coke." Consequently, the present invention promotes sponge coke crystalline structure that favors good combustion and maintains acceptable levels of shot coke. A "minimum-acceptable" sponge coke specification is discussed as one means of maintaining coke crystalline quality. That is, process control methods will consistently achieve a coke crystalline structure that preferably contains 40–100% sponge coke (vs. shot coke); most preferably 60–100% sponge coke (vs. shot coke). Alternatively, a "maximum-acceptable" shot coke specification or a specification for average coke density (e.g. gm/cc) can provide alternative measures for process control of a particular coker design and feedstock.

In other cases, the addition of higher quality VCM (e.g. VCM with boiling points of about 250–850° F. and heating values of 16–20,000 Btu/lb) may be necessary to produce petroleum coke capable of self-combustion. Alternatively, higher quality VCM in the petroleum coke can be used to reduce the overall VCM specification (i.e. minimum-acceptable VCM). The present invention discusses various means to add higher quality VCM within the coking process, and achieve uniform integration within the coke. In this manner, a softer coke crystalline structure with higher porosity is maintained, while further improving the upgraded coke's combustion characteristics.

In many (but not all) cases, low-level decontamination of the petroleum coke may be necessary to assure acceptable levels of sulfur, sodium, and other metals for the combustion process. In the preferred embodiment, the coke precursor material is subjected to an efficient desalting process prior to the thermal cracking process to reduce the concentration of certain undesirable contaminants in the upgraded petroleum coke. The preferred desalting method uses three stages of conventional, refinery desalting processes. Alternatively, filtration, catalytic, and other efficient desalting methods can be used. Any of these desalting processes will remove various contaminants to various degrees. However, sodium is the contaminant of primary concern to prevent problematic ash products (e.g. sticky, corrosive salts) from the combustion of most "fuel-grade" petroleum coke. The coke precursor material preferably will contain less than 15 ppm by weight sodium, and most preferably less than 5 ppm by weight sodium. Further embodiments of the present invention describe other means for achieving sodium, sulfur, and metals decontamination objectives noted above. Desulfurization and demetallization embodiments are discussed as alternatives to enhance environmental control options and also improve the prevention of problematic ash products.

2. Solid Fuel Combustion Systems

Conventional wisdom and current trends of solid-fuel combustion systems are moving toward further use of traditional, "fuel-grade" petroleum coke as (1) a periodic "spiking" fuel, (2) continual use in coal/coke fuel blends, or (3) primary fuel in complex, specially designed combustion systems. In the first two cases, traditional petroleum coke typically makes up less than 20% of the blend and often requires a separate fuel preparation system. In contrast, the present invention produces a Premium "Fuel-Grade" Petroleum Coke that has great value as a replacement for various solid fuels, including numerous coals. The primary use is expected to be a direct replacement of various coals in existing coal-fired boilers (utility, industrial, or otherwise). That is, the present invention includes a new formulation of coke product made in accordance with a process according to the present invention, in all of its embodiments. The present invention also includes a method for producing energy, the method comprising generally combusting a fuel, the fuel comprising coke, the coke comprising volatile combustible material (VCM) in an amount in the range from about 13% to about 50% by weight. Preferably, the volatile combustible material in the coke is in the range from about 15% to about 30% by weight.

The method of the present invention also includes a method of producing energy using a fuel that comprises mixtures of the upgraded coke of the present invention, and other fuels, including coke and solid fuels (e.g. coal), or coke and liquid fuels (e.g. fuel oil), or coke and gaseous fuels (e.g. natural gas) or any combination of these; and preferably consisting essentially of the upgraded coke of the present invention as described herein. Where the coke is mixed with coal, it is preferred that the weight ratio of coke to coal in said mixture be greater than about 1:4. Alternatively, the method of producing energy in accordance with the present invention may feature a heat release rate of the coke in such a fuel mixture greater than 20%. However, it is preferred that the fuel consists essentially of the upgraded coke comprising volatile combustible material in an amount in the range from about 13% to about 50% by weight, most preferably in the range of about 15% to about 30% by weight. Consequently, the method of the present invention allows for the achievement of optimal combustion properties while also allowing the control of costs.

Conventional wisdom and current trends of environmental controls for solid-fuel combustion systems is moving toward (1) low-sulfur energy sources (solid-fuels and otherwise), (2) extensive system modifications to add complex, expensive environmental controls, and (3) repowering conversions to alternative energy technologies with lower environmental emissions. Many coal-fired, utility boilers have been switched to low-sulfur coal to comply with the first phase of acid rain control provisions under the Clean Air Act Amendments of 1990. Complex, expensive environmental controls and repowering options are being evaluated for compliance in Phase 2.

In contrast, the method of the present invention may optionally and preferably include a method for producing energy, as described and a method for removing sulfur oxides and/or other undesirable components from its flue gas. The present invention uses novel techniques to burn the premium, "fuel-grade" petroleum coke with higher sulfur content and obtain lower sulfur oxide emissions. The unique properties of the upgraded petroleum coke allow it to be used as the primary fuel in existing, pulverized coal boilers. In most cases, use of the upgraded petroleum coke as the primary fuel, unleashes >90% of the capacity in the existing particulate control device (PCD), due to its much lower ash content. In these applications, the existing particulate control devices can be readily converted to emissions control systems that provide sufficient control of sulfur oxides (SOx), carbon dioxide, nitrogen oxides (NOx), air toxics, and/or other undesirable flue gas components. The method for removing undesirable components (1) converts the undesirable components to collectible particulates upstream of the existing PCD and (2) collects such particulates in the existing particulate control device. That is, the method of the present invention for producing energy further includes a method for removing undesirable flue gas components. This method generally comprises (1) an injection of conversion reagents with sufficient mixing and sufficient residence time at sufficient temperature to convert undesirable flue gas components to collectible particulates upstream of a particulate control device (PCD) and (2) collecting said particulates in particulate control device, said particulate control device includes, but is not limited to, a PCD process selected from the group consisting of electrostatic precipitators (dry or wet), filtration, cyclones, and conventional wet scrubbers.

In one embodiment, the unreacted conversion reagents of this flue gas conversion process can be effectively recycled to increase reagent utilization and performance. The recycle rate preferably exceeds 5% by weight of the collected flyash. This level of reagent recycle is a unique feature of this flue gas conversion process, due to the fuel properties and combustion characteristics of the upgraded coke.

In another embodiment, the spent flue gas conversion reagents can be regenerated and reused. The regeneration rate can exceed 70% by weight of the collected flyash, and preferably less than 30% of the collected fly ash is disposed as a purge (or blowdown) stream, containing high concentrations of impurities. The regeneration method includes, but is not limited to, a process selected from the group of hydration, precipitation, and other unit operations. The purge stream can be used as a resource for valuable metals, which are extracted and purified. This type of reagent regeneration can (1) substantially decrease reagent make-up requirements and costs, (2) dramatically reduce flyash disposal and costs, (3) reduce $CO_2$ emissions, (4) create a resource for valuable metals, and (5) provide the means to economically improve the flue gas conversion process via the use of more reactive reagents. The regeneration of conversion reagents is a unique feature of this flue gas conversion process, due to the fuel properties and the combustion characteristics of the upgraded coke.

For SOx removal, the flue gas conversion process of the present invention is similar to dry sorbent injection and dry scrubber technologies, but has novel improvements due to the unique properties of the upgraded petroleum coke of the present invention. In addition to the recycling and regeneration of reagents noted above, these novel improvements include increased reagent reactivity, improved reagent utilization, shorter residence times, and greater opportunity for salable products. All of these improvements over the prior art increase SOx removal efficiencies and reduce costs.

The present invention also discusses embodiments to integrate and/or optimize various environmental control techniques. The flue gas conversion process may be used in coordination with traditional wet or dry SOx scrubbing systems to improve or optimize control of various undesirable flue gas components. Also, upgraded cokes with low sulfur content (e.g. sweet crude feedstocks, coker feedstock desulfurization, etc.) can provide greater flexibility in the use of the available PCD capacity (i.e. other than SOx). Furthermore, the integration of activated coke technology is also discussed for the combined control of SOx, NOx, carbon dioxide and air toxics.

In the practical application of the present invention, the optimal combination of methods and embodiments will vary significantly. That is, site-specific, design and operational parameters of the particular coking process and refinery must be properly considered. These factors include (but should not be limited to) coker design, coker feedstocks, and effects of other refinery operations. In addition, site-specific, design and operational parameters of the particular solid-fuel combustion system and its environmental controls must be properly considered. These factors include (but should not be limited to) combustion system design, current fuel characteristics, design of environmental controls, and environmental requirements. Consequently, case-by-case analyses (often including pilot plant tests) are required to address site-specific differences in the optimal application of the present invention. The present invention discusses methods to optimize the production and use of the upgraded petroleum coke for each particular application.

DETAILED DESCRIPTION OF THE PREFERRED EMBODIMENT

In view of the foregoing summary, the following presents a detailed description of the preferred embodiments of the present invention, currently considered the best mode of practicing the present invention. The discussion of the preferred embodiment is divided into two major subjects: (1) the production of premium "fuel-grade" petroleum coke in a modified delayed coking process, and (2) the use of this petroleum coke in conventional, pulverized-coal (PC) utility boilers. Example 1 is provided at the end of this discussion to illustrate the preferred embodiment of the present invention.

1. Production of Premium "Fuel-Grade" Petroleum Coke: Modified Delayed Coking Process The discussion of the production of premium, "fuel-grade" petroleum coke in a modified delayed coking process is divided into the following topics: (a) traditional delayed coking: process description, (b) process control of the prior art, (c) coke formation mechanisms and various crystalline structures, (d) volatile combustible materials (VCM) in the petroleum coke, (e) process control of the present invention (VCM and crystalline structure), (f) low-level decontamination of coker feedstocks: 3-stage desalting operation, and (g) impacts of the present invention on refinery operations.

A. Traditional Delayed Coking: Process Description

Figure 1:
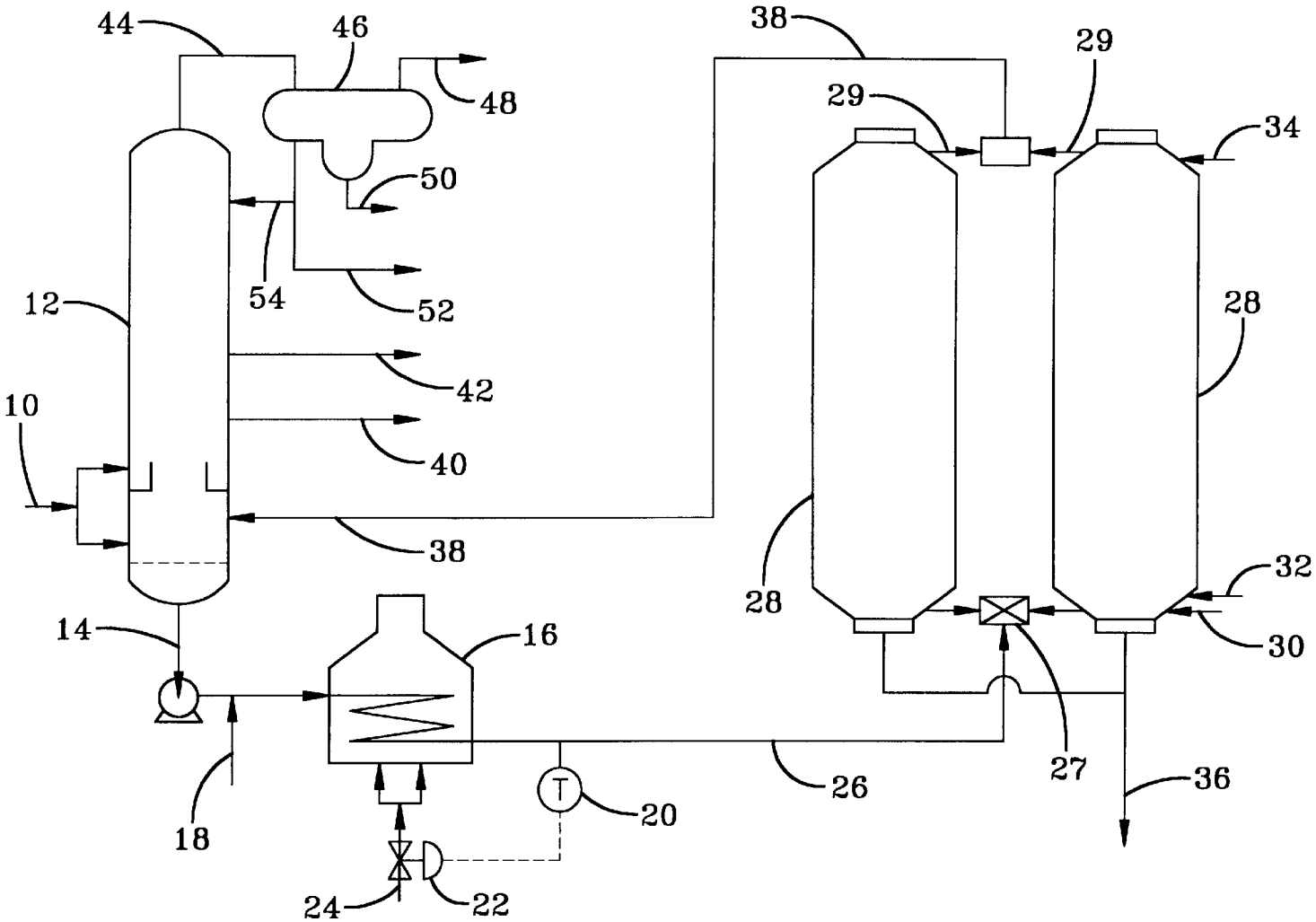
FIG. 1 shows a basic process flow diagram for key elements of a traditional delayed coking process.

FIG. 1 is a basic process flow diagram for the traditional delayed coking process of the prior art. The delayed coking process equipment for the present invention is essentially the same, but the operation, as discussed below, is substantially different. Delayed coking is a semi-continuous process with parallel coking drums that alternate between coking and decoking cycles.

In the coking cycle, coker feedstock is heated and transferred to the coke drum until full. Hot residua feed 10 is introduced into the bottom of a coker fractionator 12, where it combines with condensed recycle. This mixture 14 is pumped through a coker heater 16, where the desired coking temperature (normally between 900° F. and 950° F.) is achieved, causing partial vaporization and mild cracking. Steam or boiler feedwater 18 is often injected into the heater tubes to prevent the coking of feed in the furnace. Typically, the heater outlet temperature is controlled by a temperature gauge 20 that sends a signal to a control valve 22 to regulate the amount of fuel 24 to the heater. A vapor-liquid mixture 26 exits the heater, and a control valve 27 diverts it to a coking drum 28. Sufficient residence time is provided in the coking drum to allow the thermal cracking and coking reactions to proceed to completion. By design, the coking reactions are "delayed" until the heater charge reaches the coke drums. In this manner, the vapor-liquid mixture is thermally cracked in the drum to produce lighter hydrocarbons, which vaporize and exit the coke drum. The drum vapor line temperature 29 (i.e. temperature of the vapors leaving the coke drum) is the measured parameter used to represent the average drum temperature. Petroleum coke and some residuals (e.g. cracked hydrocarbons) remain in the coke drum. When the coking drum is sufficiently full of coke, the coking cycle ends. The heater outlet charge is then switched from the first coke drum to a parallel coke drum to initiate its coking cycle. Meanwhile, the decoking cycle begins in the first coke drum.

In the decoking cycle, the contents of the coking drum are cooled down, remaining volatile hydrocarbons are removed, the coke is drilled from the drum, and the coking drum is prepared for the next coking cycle. Cooling the coke normally occurs in three distinct stages. In the first stage, the coke is cooled and stripped by steam or other stripping media 30 to economically maximize the removal of recoverable hydrocarbons entrained or otherwise remaining in the coke. In the second stage of cooling, water or other cooling media 32 is injected to reduce the drum temperature while avoiding thermal shock to the coke drum. Vaporized water from this cooling media farther promotes the removal of additional vaporizable hydrocarbons. In the final cooling stage, the drum is quenched by water or other quenching media 34 to rapidly lower the drum temperatures to conditions favorable for safe coke removal. After the quenching is complete, the bottom and top heads of the drum are removed. The petroleum coke 36 is then cut, typically by hydraulic water jet, and removed from the drum. After coke removal, the drumheads are replaced, the drum is preheated, and otherwise readied for the next coking cycle.

Lighter hydrocarbons 38 are vaporized, removed overhead from the coking drums, and transferred to a coker fractionator 12, where they are separated and recovered. Coker heavy gas oil (HGO) 40 and coker light gas oil (LGO) 42 are drawn off the fractionator at the desired boiling temperature ranges: HGO: roughly 650–870° F.; LGO: roughly 400–650° F. The fractionator overhead stream, coker wet gas 44, goes to a separator 46, where it is separated into dry gas 48, water 50, and unstable naptha 52. A reflux fraction 54 is often returned to the fractionator.

In general, delayed coking is an endothermic reaction with the furnace supplying the necessary heat to complete the coking reaction in the coke drum. The exact mechanism of delayed coking is so complex that it is not possible to determine all the various chemical reactions that occur, but three distinct steps take place:

1. Partial vaporization and mild cracking of the feed as it passes through the furnace
2. Cracking of the vapor as it passes through the coke drum
3. Successive cracking and polymerization of the heavy liquid trapped in the drum until it is converted to vapor and coke.

B. Process Control of the Prior Art

In traditional delayed coking, the optimal coker operating conditions have evolved through the years, based on much experience and a better understanding of the delayed coking process. Operating conditions have normally been set to maximize (or increase) the efficiency of feedstock conversion to cracked liquid products, including light and heavy coker gas oils. More recently, however, the cokers in some refineries have been changed to maximize (or increase) coker throughput. In both types of operation, the quality of the byproduct petroleum coke is a relatively minor concern. In "fuel-grade" coke operations, either mode of operation detrimentally affects the fuel properties and combustion characteristics of the coke, particularly VCM content and crystalline structure.

In general, the target operating conditions in a traditional delayed coker depend on the composition of the coker feedstocks, other refinery operations, and coker design. Relative to other refinery processes, the delayed coker operating conditions are heavily dependent on the feedstock blends, which vary greatly among refineries (due to varying crude blends and processing scenarios). The desired coker products and their required specifications also depend greatly on other process operations in the particular refinery. That is, downstream processing of the coker liquid products typically upgrades them to transportation fuel components. The target operating conditions are normally established by linear programming (LP) models that optimize the particular refinery's operations. These LP models typically use empirical data generated by a series of coker pilot plant studies. In turn, each pilot plant study is designed to simulate the particular refinery's coker design. Appropriate operating conditions are determined for a particular feedstock blend and particular product specifications set by the downstream processing requirements. The series of pilot plant studies are typically designed to produce empirical data for operating conditions with variations in feedstock blends and liquid product specification requirements. Consequently, the coker designs and target operating conditions vary significantly among refineries.

In common operational modes, various operational variables are monitored and controlled to achieve the desired delayed coker operation. The primary independent variables are feed quality, heater outlet temperature, coke drum pressure, and fractionator hat temperature. The primary dependent variables are the recycle ratio, the coking cycle time and the drum vapor line temperature. The following target control ranges are normally maintained during the coking cycle for these primary operating conditions:

1. Heater outlet temperatures in the range of about 900° F. to about 950° F.,
2. Coke drum pressure in the range of about 15 psig to 100 psig: typically 20–30 psig,
3. Hat Temperature in the range of
4. Recycle Ratio in the range of 0–100%; typically 10–20% and a
5. Coking cycle time in the range of about 15 to 24 hours; typically 18–24 hours
6. Drum Vapor Line Temperature 50 to 100° F. less than the heater outlet temperature: typically 850–900° F.

These traditional operating variables have primarily been used to control the quality of the cracked liquids and various yields of products, with minor attention to controlling the respective composition of the by-product petroleum coke. Throughout this discussion, "cracked liquids" refers to hydrocarbon products of the coking process that have 5 or more carbon atoms. They typically have boiling ranges between 97 and 870° F., and are liquids at standard conditions. Most of these hydrocarbon products are valuable transportation fuel blending components or feedstocks for further refinery processing. Consequently, cracked liquids are normally the primary objective of the coking process.

Since the mid-1930s, better understanding of the delayed coking process and technological advances have continually maximized (or increased) the efficiency of feedstock conversion. Feedstock conversion is often cited as liquid yield (i.e. barrel of cracked liquid product per barrel of feed). Increasing the yield of cracked liquids is generally accomplished by changing the operating conditions to affect (1) the balance between cracking and coking reactions and/or (2) the vaporization and recovery of the cracked liquid products. Though the specific operating conditions vary among refineries, the following rules of thumb have been noted as guidelines for reductions in coke yield, and associated increases in the yield of cracked liquids:

1. Each 10° F. increase in coke-drum vapor line temperature reduces coke yield on feed by 0.8 wt. % and increases gas and distillates by 1.1 volume % on feed.
2. Each 8 psi reduction in the coke drum pressure reduces the coke yield on feed by 1.0 wt. % and increases liquid yield by 1.3 volume % on feed.
3. Reducing the recycle by 10 vol. % on feed reduces the coke yield by 1.2 wt. % on feed and increases the liquid plus gas yield by 1.0 vol. % on feed.
4. Reducing the virgin gas oil content of the coker feed by 10% reduces coke yield by 1.5 wt %.

Technology advances have also been implemented in the effort to maximize the liquid yields of the delayed coker. These include, but are not limited to, (1) coker designs to reduce drum pressure to 15 psig, (2) coker designs to provide virtually no recycle, and (3) periodic onstream spalling of heaters to increase firing capabilities and run length at higher heater outlet temperatures.

Over the past ten years, some refineries have switched coker operating conditions to maximize (or increase) the coker throughput, instead of maximum efficiency of feedstock conversion to cracked liquids. Due to processing heavier crude blends, refineries often reach a limit in coking throughput that limits (or bottlenecks) the refinery throughput. In order to eliminate this bottleneck, refiners often change the coker operating conditions to maximize (or increase) coker throughput in one of two ways:

1. If the coker is fractionator (or vapor) limited, increase the drum pressure (e.g., 20 to 25 psig.)
2. If the coker is drum (or coke make) limited, reduce the coking cycle time (e.g., 20 to 16 hours)

Both of these operational changes increase the coker throughput. Though either type of higher throughput operation reduces the efficiency of feedstock conversion to cracked liquids (i.e. per barrel of feed basis), it often maximizes (or increases) the overall quantity (i.e. barrels) of cracked liquids produced. These operational changes also tend to increase coke yield and coke VCM, as noted previously. However, any increase in drum pressure or decrease in coker cycle time is usually accompanied by a commensurate increase in heater outlet and drum vapor line temperatures to offset (or limit) any increases in coke yield or VCM.

The current trend in delayed coking includes capital improvements to the original coker design to eliminate bottlenecks and maximize (or increase) both coker liquid yields and coker throughput, to the extent possible. Limits on coke heaters, coke drums, and fractionators are removed by employing equipment modifications that incorporate technology advancements. These modifications will normally address the refinery's projected coker feedstock composition and quantity. The timing of these modifications is likely to depend on many factors, including (1) justification via the loss of cracked liquids to increased coke yields, and (2) the refinery's capital investment criteria (e.g., alternative projects and higher operational risk factors, such as increased environmental regulations).

In both types of process control in the prior art, the VCM content of the byproduct coke is used mostly as a post-mortem gauge of successful operation, NOT as an essential operational variable. The coke VCM is measured after the batch operation is complete. Pilot plant studies are used to predict the coke VCM for a particular set of operating conditions, feedstock, and coker design. However, the scaled-up commercial operation may stray from target VCM levels, due to less than ideal conditions. If needed, adjustments in operating conditions are usually made based on experience for future coking batches. Typically, the target operating range for coke VCM in delayed coking is 8–12 wt. %. If the coke VCM is lower than 8 wt. %, the coke is usually too hard to cut from the drum within the normal decoking cycle time. A coke VCM greater than 12 wt. % is normally considered poor conversion efficiency. Also, some grades of anode and needle coke have a maximum VCM product specification (typically <12 wt. %) that assures proper density characteristics. Accordingly, the normal operating conditions for both maximum conversion and maximum throughput modes are continually modified to achieve the lowest possible coke VCM in the long-term, with acceptable coker operation. Consequently, the process control options of the prior art detrimentally impact the fuel properties and combustion characteristics of "fuel-grade" coke. That is, the coke VCM content and/or crystalline structure of the by-product coke are not normally sufficient to sustain self-combustion.

Delayed coker process controls of the prior art (i.e. maximum conversion and/or maximum throughput) also tend to promote the production of undesirable coke crystalline structure. These operating conditions typically promote the formation of shot coke, particularly for heavy feedstocks. In some refineries, sponge coke can predominate shot coke. However, the sponge coke in this shot/sponge coke blend will tend to have low porosity due to its low VCM. This latter outcome is more likely with the operating conditions that maximize coker throughput. In either operational mode of the prior art, the byproduct coke tends to have crystalline structures of shot coke and/or sponge coke with low porosity and low VCM. As discussed later, these crystalline structures are not desirable for good combustion characteristics.

In conclusion, the operating conditions of the prior art give first priority to maximizing the efficiency of feedstock conversion to cracked liquid products or maximizing coker throughput. In either case, the petroleum coke is a byproduct that is tolerated in the interest of the maximum production of cracked liquid hydrocarbons, barrel per barrel of feed or total barrels. The VCM content and crystalline structure of the resultant coke is a relatively minor concern (by comparison), especially for "fuel-grade" petroleum coke. As such, the process control of the prior art is not conducive to produce a high-quality, "fuel-grade" coke.

C. Coke Formation Mechanisms and Various Crystalline Structures

Coking processes, in general, are high-severity, thermal cracking (or destructive distillation) operations to convert petroleum residua into distillates, hydrocarbon gases, and coke. The residua feed is typically heated to temperatures exceeding 900° F. Thermal decomposition of the high-molecular, hydrocarbon structures takes place in both the liquid and gaseous phases. The breaking of chemical bonds in the liquid phase typically produces lighter hydrocarbon compounds that vaporize below the drum temperature (e.g. <870° F.). The remaining liquids (normally complex hydrocarbon structures with highly aromatic content) polymerize to form coke. Thermal decomposition will continue in the gaseous phase (producing lighter and lighter compounds) until there is not sufficient activation energy to initiate the endothermic cracking reaction. The cracking and coking reactions occur simultaneously, and their degrees of completion primarily depend on the temperature, residence time, and pressure in the reaction system. The remainder of this discussion primarily focuses on the thermal cracking of the liquid phase and the subsequent formation of coke.

The formation of coke in the delayed coking process occurs primarily by two independent coking mechanisms: Thermal Coke and Asphaltic Coke. The thermal coking mechanism is caused by an endothermic reaction: the cross-liking of aromatic rings contained in the petroleum residue of the coker feed. This thermal coke mechanism is substantially reduced by operating conditions (e.g. higher operating temperatures) that increase the production of cracked liquid hydrocarbons. The asphaltic coke mechanism is initiated as solutizing oils are removed by thermal cracking and aromatic cross-linkage from the coker charge. The large asphaltene and resin molecules precipitate out of solution to form a solid without much change in structure. The asphaltic coke mechanism (1) is a physical change with no heat of reaction, (2) is not affected by modified coker operating conditions, and (3) is purely a function of the asphaltene and resin content in the coker feedstock. The relative degrees of these two coking mechanisms have been noted to determine the crystalline structure of the delayed coke.

Petroleum coke from a delayed coker has three major types of crystalline structure: needle coke, sponge coke, and shot coke. Needle coke is formed via virtually all thermal coke mechanism: >95% of the coke from the cross-liking of aromatics contained in a low-asphaltene coker feedstock (e.g. FCC slurry oil). Sponge coke and shot coke are formed by combinations of thermal and asphaltic coking mechanisms. When the ratio (R) of asphaltic coke to thermal coke falls below a certain level, sponge coke is formed. Conversely, when R exceeds a certain level, shot coke is formed. This ratio R is difficult to measure. Furthermore, the boundary between shot coke and sponge coke is not definite, but fuzzy, and is expected to vary with coker feedstocks. In fact, the combination of shot coke and sponge coke has been noted to form in the same coking cycle due to temperature variations across the coke drum. However, limited plant data suggest the crossover point for shot (vs. sponge) coke formation is roughly R>0.7–1.5.

D. Volatile Combustible Materials SCM) in the Petroleum Coke

Many in the oil refining industry surprisingly believe that virtually all of the volatile material in the petroleum coke is valuable, cracked liquids trapped in the coke. This mistaken belief apparently occurs due to a major difference in the definition of "volatile materials" for the oil refining industry versus combustion science. The oil refining industry commonly refers to non-volatile, asphaltic and aromatic materials, contained in the coker feedstocks, as 1000 plus materials, which have "theoretical" boiling points exceeding 1000° F. at atmospheric pressure. The boiling points are "theoretical" because these materials crack or coke from thermal decomposition before they reach such temperatures. As such, the oil refining industry considers materials with boiling points <1000° F. as "volatile materials." In contrast, combustion science (via ASTM Test Method D-3175) defines volatile combustible materials (VCM) as the weight percent of the fuel that is vaporized at temperatures less than 950° C. (1742° F.). Therefore, materials that are vaporized between 1000° F. and 1742° F. are considered volatile materials by combustion science, but not by the oil refining industry, in general. Consequently, the VCM in the petroleum coke is expected to be a combination of:

(1) unreacted coker feedstocks that vaporize between residua BP Cutpoints (e.g. 1000° F.) and 1742° F.;

(2) cracked components that vaporize between drum temperature (e.g. 870° F.) and 1742° F.; and (3) cracked components that vaporize below drum temperature (e.g. 870° F.) trapped in the coke.

Since steam stripping of the porous petroleum coke is typically conducted for 1 to 3 hours in the decoking cycle, the VCM of traditional coke is expected to consist mostly of (1) and (2). However, under certain conditions, the coke VCM may have weak chemical bonds to the coke that prevent steam stripping. The activation energies required to break these weak chemical bonds can be provided by the initial phases of combustion or ASTM Method D 3175. Note: The drum temperatures for the cracked components of (2) and (3) need to be adjusted for drum pressures to determine comparable boiling points at equivalent conditions. Throughout this patent application, "volatile combustible materials" or "VCM" will refer to volatile combustible materials as defined by the American Society for Testing and Materials (ASTM Method D 3175. This method stipulates a temperature of 950±20° C. for seven minutes for volatile matter content determinations.

The VCM in the coke from a delayed coker is primarily a function of (1) feed properties, (2) drum temperature, (3) drum residence time and (4) the level of steam stripping in the decoking cycle. Though these parameters are noted to affect the VCM content of the petroleum coke, the current operating variables have no direct relationship with coke VCM. The specific impacts of these parameters are very dependent on the feedstock composition and coker design, and vary among refineries. Based on years of experience, general rules of thumb regarding VCM impacts have been developed and are provided below.

1. With operating conditions held constant, a decrease in feedstock gravity typically decreases the coke VCM. The properties of the coker feedstocks play a major role in determining the petroleum coke's VCM content. As noted above, the coke's volatile combustible materials consist of certain cracked components, as well as unreacted feedstock components in the coke drum. Consequently, the coke VCM is dependent on the various types/qualities of the organic compounds in the feedstock and the relative quantities of these feedstock components.
2. With other operating conditions held constant, a reduction in coke drum pressure has been noted to decrease coke VCM for a given feedstock. The coke drum pressure significantly affects the coke VCM. A reduction in coke drum pressure increases the vaporization of heavier cracked liquids or unreacted feedstocks. Thus, the coke VCM is effectively decreased by the release of these compounds that would otherwise remain with the coke. However, the degree of coke VCM reduction is not easy to quantify and predict for a specified level of pressure change.
3. Reductions in cycle time have been noted to increase the coke VCM. The drum residence time significantly affects the VCM in the petroleum coke. As the coking cycle time decreases, the drum fill rate increases, and the residence time for thermal cracking and coking mechanisms decreases. Consequently, the reactions are less complete, leaving more unreacted or partially reacted feedstock on the coke as volatile combustible materials.
4. With other operating conditions held constant, an increase in the drum vapor line temperature is noted to decrease the coke VCM for a given feedstock. The drum temperature is a major factor in determining the VCM in the petroleum coke. The local temperatures in the drum determine the degrees of thermal cracking and coking of the feedstock components. The temperature of the vapors leaving the drum during the coking cycle (i.e. drum vapor line temperature) is often used as the measured parameter to represent the average coke drum temperature. This temperature is typically 50–100° F. lower than the heater outlet temperature. The temperature difference is primarily due to a combination of heat losses: (1) the endothermic reactions of the thermal cracking and coking mechanisms, (2) vaporization energy of the cracked components, and (3) drum heat loss. Since the asphaltic coking mechanism is a physical change with no heat of reaction, the drum vapor line temperature (e.g. 870° F.) will likely differ significantly for various feedstocks. That is, different proportions of thermal coke and asphaltic coke mechanisms will impact the drum vapor line temperature differently. For a given feedstock, a higher drum vapor line temperature will cause greater cracking reactions and/or vaporize heavier cracked components, reducing the coke VCM. The drum vapor line temperature is normally controlled by the heater outlet temperature and the amount of condensed recycle.
5. The steam-stripping step of the decoking cycle is noted to decrease the coke VCM. The steam stripping during the decoking cycle has less significant impact on the coke VCM. For example, omitting the "big steam" step (the initial 0.5–1 hour of the decoking cycle) will leave slightly more wax-tailing-type material on the coke. Again, the coke VCM, under certain conditions, may have weak chemical bonds to the coke that prevent steam stripping.

E. Process Control of the Present Invention

The primary improvements of the present invention are modifications to the operating conditions of the delayed coking process, in a manner that is not suggested by prior art. In fact, these changes in operating conditions are contradictory to the teachings and current trends in the prior art. As noted previously, the operating conditions of the prior art give first priority to maximizing the efficiency of feedstock conversion to cracked liquid products or maximizing coker throughput. In contrast, the operating conditions of the present invention give first priority to increase and consistently maintain the concentration of volatile combustible material (VCM) in the resulting petroleum coke to 13–50 weight % VCM (preferably 15–30% VCM). Second priority is given to consistently provide a minimum-acceptable level of sponge coke in the product coke. The third priority is THEN given to maximize coker throughput and/or the conversion of coker feedstock blend to cracked liquid products. In many cases, the reduction of cracked liquids yield is expected to be <5% due to optimization of embodiments of the present invention that reduce the overall VCM increase and/or minimum sponge coke, required for acceptable combustion. In some cases, implementation of the present invention can actually increase overall cracked liquids production via increased coke throughput capacity. The operating conditions required to achieve the objectives of the present invention were surprisingly modest, yet specific, relative changes from the prior art.

As discussed previously, delayed coker operating conditions vary greatly among refineries, due to various coker feedstocks, coker designs, and other refinery operations. Therefore, specific operating conditions (i.e. absolute values) for various refinery applications are not completely possible for the present invention. However, specific changes relative to existing operating conditions provide specific methods of operational change to achieve the desired objectives.

INCREASED VCM IN DELAYED COKE

Modifications in the delayed coker operating conditions are necessary to achieve the production of a premium "fuel-grade" petroleum coke. These modifications increase and consistently maintain the quantity and quality of VCM content in the petroleum coke at a specified level. This new product specification for coke VCM should be the minimum level that achieves a stable combustion during various operating/load conditions for the end-user in its particular combustion system. The VCM product specification is expected to be in the target range of 13–50 weight percent (preferably 15–30 wt. %). From the refiner's perspective, the increase in VCM should be minimized and would preferably come from feedstock and/or cracked components that are vaporized between 1000° F. and 1742° F. These components are less valuable to the refiner and could conceivably include unreacted feedstock and residual compounds after thermal cracking, as noted above. From a combustion perspective, a certain amount of the VCM increase should come from higher quality VCM components that vaporize <1000° F. (preferably <850° F.) to help initiate combustion of the coke. In fact, each combustion system will likely have an optimal blend of volatile components (i.e. >1000° F. vs. <1000° F.) that minimize the overall VCM specification. Thus, the ideal modifications to operational variables would achieve this optimal blend of volatile components that minimize the overall VCM increase in the petroleum coke, and provide narrow VCM target range for quality control.

As noted above, many operational variables indirectly affect the coke VCM. As such, the selection of the appropriate modifications in the delayed coker operating conditions is not straightforward. In many cases, changes in the feedstock gravity and reductions in coker cycle time tend to increase the coke VCM, but provides limited change in VCM quality. Increases in drum pressure tend to increase the quality and quantity of coke VCM, but can be difficult to control coke VCM within a narrow target range. The reduced steam stripping in the decoking cycle has been noted to have limited effect on coke VCM content. However, reduced coke drum temperatures tend to increase and maintain both the quality and quantity of coke VCM. Reduced coke drum temperatures can decrease the cracking reactions, increasing unreacted feedstock and partially cracked components. In most cases, it provides a lower vaporization temperature in the coke drum, leaving lighter cracked or unreacted hydrocarbon components (i.e. higher quality VCM) integrated in the coke. In addition, the coke VCM content can be more predictable via reduced drum temperatures (vs. other operational variables). As such, coke VCM content can be readily controlled within a specified range. Furthermore, reduced coke drum temperatures have the added benefit of improving the coke crystalline structure (See below). Consequently, reduced coke drum temperatures was selected as the preferred means of increasing coke VCM to achieve the objectives of the present invention.

Based on this analysis, the simplest and preferred means of increasing and maintaining the volatile content of the coke (i.e. to a consistent level between 13 and 50 wt. % VCM) would result from a reduction of the average drum temperature by 5–80° F. (preferably 5–40° F.). That is, an average drum vapor line temperature of 770 to 850° F. can provide VCM levels of 15–30% for many coker feedstocks. However, as noted earlier, coker feedstocks vary considerably among refineries, and can attain 15–30% VCM outside of this temperature range. In these situations, the relative temperature drop from the existing average drum temperature is expected to be similar. This lower drum temperature would sufficiently reduce the cracking and coking reactions to produce the desirable increase in VCM in the petroleum coke for many existing refineries. While it is believed this result is primarily due to (1) reductions in cracking reactions and (2) increases in unreacted coker feedstock and partially cracked liquids remaining with the resultant petroleum coke, the present invention should not be bound by this.

The simplest means to achieve the lower average drum temperature is to decrease the heater outlet temperature, accordingly. That is, the heater outlet temperature is the primary independent variable that can be controlled to achieve lower average drum temperature. Changing the set point for the temperature controller 22 can reduce the fuel rate, and lower the heater outlet temperature to the desired level. However, as noted above, there is no direct relationship between the heater outlet temperature, the average drum temperature, and VCM in the resulting petroleum coke. More specifically, the volatile content of the coke significantly depends on the composition of the coker feed and the relative impacts of the competing cracking and coking reactions on its components. Thus, the VCM varies significantly due to the different compositions in various coker feedstock blends. Consequently, the optimal heater outlet temperature (to consistently produce the desirable VCM content in the coke) is expected to require the development of empirical data in pilot plant studies for different coker designs and coker feedstocks. Ideally, this new empirical data would not only address the impact of various crude oil mixtures processed in the refinery, but also evaluate the impact of other refinery operations. This type of temperature control is analogous to other coker process controls.

Regardless of the types of volatile components, the VCM increase will usually create additional porosity of the residual carbon in the combustion process. That is, the vaporization of these components in the combustion process create greater voids and, thus, more oxidation reaction sites in the residual carbon. In addition, a VCM increase and the associated porosity increase are also expected to further decrease the hardness of the coke. In many cases, the softer petroleum coke can be ground to smaller particle size distribution at the same or less energy in the current pulverization equipment. Consequently, both greater porosity and lower hardness provide better combustion characteristics, and reduce the overall VCM specification required to achieve acceptable combustion.

ACCEPTABLE DELAYED COKE CRYSTALLINE STRUCTURE

Sponge coke is the most desirable crystalline structure for fuel-grade petroleum coke. Needle coke is too dense for good combustion properties. Shot coke is spherical in shape, and is usually denser and harder than sponge coke. These characteristics make shot coke difficult to grind to a desired particle size distribution and more difficult to burn, particularly its carbon residue. Sponge coke, on the other hand, has a high porosity that increases with VCM. This high porosity makes sponge coke much softer; easier to drill from the coke drum and easier than other cokes (and most coals) to grind to the desired particle size distribution for optimal combustion characteristics. The high porosity of sponge coke (vs. most coals) also provides a greater (or comparable) density of oxidation reaction sites in the carbon residue after the initial combustion. This combustion characteristic promotes better carbon burnout, which translates to shorter residence time requirements, lower burnout temperature requirements, and higher combustion efficiency.

Consequently, the second priority of the present invention's process control is to consistently maintain levels of sponge coke above a "minimum-acceptable" specification. As noted previously, the sponge coke crystalline structure has higher porosity and lower hardness (discussed below) than shot or needle coke. These qualities are more conducive to good combustion characteristics. Ideally, the entire coke product would be sponge coke crystalline structure with higher VCM (e.g. 15–30 wt. %). This high-VCM sponge coke has significantly greater porosity and lower hardness than traditional sponge coke crystalline structure with lower VCM (e.g. 8–12% wt. %). However, with the high level of asphaltenes and resins in modern, heavy coker feedstocks, this ideal may be difficult to achieve. Even so, the ratio of asphaltic to thermal coking mechanisms must be reduced sufficiently to consistently provide at least the minimum acceptable level of sponge coke for good combustion by the end-user. Since the degree of the asphaltic coking mechanism is primarily a function of coker feedstock, an increase in the thermal coking mechanism will likely achieve the desired result.

In the preferred embodiment, the decrease in heater outlet temperature lowers the average drum temperature to increase coke VCM (See above). This lower drum temperature favors the thermal coking mechanism and promotes the formation of high porosity sponge coke (versus shot coke). In this manner, the lower drum temperature of the preferred embodiment is expected to increase the degree of thermal coking mechanism sufficiently to reduce shot coke to acceptable levels. The new product specification for "minimum-acceptable" sponge coke should be the minimum sponge coke required to achieve a stable combustion during various operating/load conditions for the end-user in its particular combustion system. It should be noted that a low "acceptable" sponge coke specification may be caused by or require a higher VCM specification. Consequently, the sponge coke and VCM specifications can be optimized for each application relative to the particular refinery and coke end-user (SEE Optimal Fuel Embodiment). The "minimum-acceptable" sponge coke product specification is expected to be in the target range of 40–100 weight percent (preferably 60–100%), for combustion systems designed for bituminous coals.

Alternatively, a "maximum-acceptable" shot coke specification or a specification for average coke density (gm/cc) can provide other product quality measures for process control of a particular coker design and feedstock. A "maximum-acceptable" shot coke specification has the reverse logic of the above discussion. Consequently, a new product specification for "maximum-acceptable" shot coke should be the maximum shot coke that achieves a stable combustion during various operating/load conditions for the end-user in its particular combustion system. A "maximum-acceptable" shot coke product specification is expected to be in the target range of 0–60 weight percent (preferably 5–30%), for combustion systems designed for bituminous coals. Similarly, a product specification for average coke density could be developed to provide coke quality control. That is, the desirable high VCM sponge coke (e.g. 0.75–0.85 gm/cc) has a significantly different density than shot coke (e.g. 0.9–1.0 gm/cc) or needle coke. Consequently, the maximum average coke density specification would likely reflect the composition of the upgraded petroleum coke for the "minimum-acceptable" sponge coke or the "maximum-acceptable" shot coke specifications.

F. Low-Level Decontamination of Coker Feedstocks; 3 Stage Desalting Operation

As noted previously, the combustion of petroleum cokes containing high concentrations of sulfur, sodium, and some heavy metals (e.g. vanadium and nickel) has caused great apprehension due to potential slagging and corrosion of the firebox and downstream equipment. However, the effects of petroleum coke's high metals content in combustion and heat transfer equipment is not well understood or defined. The amount of slag formation on tubes (and associated corrosion) depends on the ultimate composition of the ash resulting from competing oxidation reactions. An analysis of potential ash constituents from the combustion of these petroleum cokes (See Table 1) indicates that compounds with melting points <2500° F. predominantly contain sodium (e.g. various sodium sulfates and various sodium vanadates). Only four major compounds without sodium are in this class: vanadium pentoxide, nickel sulfate, aluminum sulfate, and ferric sulfate. However, the lower oxides of these metals (i.e. V, Ni, Al, and Fe) can be predominant (e.g. in a limited oxidation environment) and have melting points in excess of 2850° F. Also, ferric sulfate and certain sodium sulfates decompose at a temperature near their melting points. Based on this analysis, the primary element that forms compounds with detrimental firebox effects is sodium. Thus, as long as the sodium content of the coke remains low, the high vanadium, nickel, and aluminum contents do not appear to create significant ash fusion and associated corrosion. Even with higher sodium levels in the crude, improvements in desalter operations can provide the needed control.

Traditional desalting operations in oil refineries are primarily designed to remove various water-soluble impurities and suspended solids that are usually present in the crude oils from contamination in the ground or in transportation. The prior art of desalting focuses on the removal of salts in a manner that substantially reduces corrosion, plugging, and catalyst poisoning or fouling in downstream processing equipment. Most, if not all, oil refineries have desalting operations. One to two stages of desalting units in series are typically used to pretreat the crude oils prior to the atmospheric crude oil distillation columns. A third desalter stage can be added for vacuum distillation residuals and other coker feedstocks, where undesirable components normally concentrate. One stage is common, two stages are typical, but few installations use three. The additional stages can increase reliability and obtain additional reduction in the salt (and thus sodium) content of the crude oil and downstream products. For example, typical salt contents of crude oil range from 260–300 g/100 $m^3$ or roughly 40 pounds per thousand barrels (ptb) of crude. The first stage can be designed and operated to reduce the salt content by >90% to <4.0 ptb (significantly <15 ppm sodium content). Two-stage desalter operations can be designed and operated to reduce the salt content by >99% to <0.2 ptb (significantly <5 ppm sodium content). Finally, a third stage desalter can be designed and operated to reduce the sodium content of typical vacuum residuals to <1.5 ptb (or <5 ppm sodium). This level typically translates to <25 ppm (or <0.05 lb./Ton) of sodium in the petroleum coke. Consequently, current desalting technology is capable of sufficiently reducing sodium in the petroleum coke to levels that inhibit (and substantially reduce) sodium compounds that cause ash problems in combustion systems. Furthermore, the additional stages also provide incremental reductions in other metals (Vanadium, Nickel, etc.) and particulates that promote the precipitation of shot coke.

The present invention does not claim novel desalting technology, but provides a novel application of such technology to eliminate (or substantially reduce) potential ash problems associated with the combustion of petroleum coke. Therefore, further description of readily available desalting technologies was not deemed appropriate, at this time. However, modifications to existing, desalter operations may be required to achieve acceptable sodium levels in the petroleum coke. That is, the actual performance of the current desalter operation at specific refineries depends on various design factors and operating conditions. In the past, the increased investment cost for multiple stages was usually justified by reducing the problems in downstream processing equipment (corrosion, plugging, & catalyst poisoning or fouling); not sodium levels for petroleum coke combustion. Consequently, the installed desalting technologies may not be currently designed and/or operated to accomplish this objective.

The preferred embodiment of the present invention uses three desalting stages to pretreat the crude oil (stages 1 and 2) and coker feedstock components (stage 3). The 3-stage desalting system (1) minimizes or substantially reduces the concentration of sodium in the resultant petroleum coke, (2) promotes additional removal of other metals: Vanadium, Nickel, Aluminum, etc., and/or (3) provides greater reduction in particulates that promote the precipitation of shot coke.

Trace quantities of acid, caustic, and other chemical or biological additives can be injected into any or all stages to promote removal of specific undesirable compounds. For example, trace quantities of acid can be added to the water wash in the first stage to promote additional removal of sodium, other alkali and alkaline earth metals, and heavy metal compounds in the crude oil. Trace quantities of caustic can be added to the water wash in the second stage to promote additional removal of sulfur compounds in the crude oil. However, sodium compounds, such as sodium hydroxide, should not be used, and reintroduce higher levels of sodium. Trace quantities of other chemical additives can be added to the water wash in the third stage to promote removal of other compounds of concern. However, since our primary goal is the removal of sodium and other metals, trace quantities of acid in all three stages can be desirable to maximize their reduction.

G. Impacts of the Present Invention on Refinery Operations

The above embodiment of the present invention is also preferred because it is expected to cause additional positive impacts on various refinery operations. First of all, the reduced drum temperature (and associated decrease in heater outlet temperature) can normally improve the delayed coker's operation & maintenance and the quality of its cracked liquid products. Secondly, any reduction of shot coke crystalline structure can substantially reduce coker operational problems, as well as improving combustion characteristics. Thirdly, the 3-stage desalting operation improves the operation and maintenance of the coker and other refinery operations. Finally, all of these operational changes can also provide greater flexibility in debottlenecking options for increasing the coker and/or refinery throughput capacities. Most of these advantages lead to higher coker throughput and/or lower operating and maintenance costs in long-term.

TABLE 1

MELTING POINTS OF PETROLEUM COKE ASH CONSTITUENTS

| CHEMICAL COMPOUND | | MELTING POINT, ° F. |
|---|---|---|
| CALCIUM OXIDE | $CaO$ | 4662 |
| NICKEL OXIDE | $NiO$ | 3795 |
| ALUMINUM OXIDE | $Al_2O_3$ | 3720 |
| - VANADIUM TRIOXIDE | $V_2O_3$ | 3580 |
| - VANADIUM TETROXIDE | $V_2O_4$ | 3580 |
| SILICON DIOXIDE | $SiO_2$ | 3130 |
| FERRIC OXIDE | $Fe_2O_3$ | 2850 |
| CALCIUM SULFATE | $CaSO_4$ | 2640 |
| * SODIUM SULFATE | $Na_2SO_4$ | 1625 |
| *-SODIUM ORTHOVANADATE | $3\text{-}Na_2O.V_2O_5$ | 1560 |
| NICKEL SULFATE | $NiSO_4$ | 1545 |
| ALUMINUM SULFATE | $Al_2(SO_4)_3$ | 1420 |
| - VANADIUM PENTOXIDE | $V_2O_5$ | 1275 |
| *-SODIUM PYROVANADATE | $2\text{-}Na_2O.V_2O_5$ | 1185 |
| *-SODIUM METAVANADATE | $Na_2O.V_2O_5(NaVO_3)$ | 1165 |
| *-SODIUM VANADYLVANADATES | $Na_2O.V_2O_4.V_2O_5$ | 1160 |
| * SODIUM FERRIC SULFATE | $Na_3Fe(SO_4)_3$ | 1000 |
| *-SODIUM VANADYLVANADATES | $5\text{-}Na_2O.V_2O_4.11\text{-}V_2O_5$ | 995 |
| FERRIC SULFATE | $Fe_2(SO_4)_3$ | 895[a] |
| * SODIUM PYROSULFATE | $Na_2S_2O_7$ | 750[a] |
| * SODIUM BISULFATE | $NaHSO_4$ | 480[a] |

* SODIUM COMPOUNDS
- VANADIUM COMPOUNDS
[a]DECOMPOSES AT A TEMPERATURE AROUND THE MELTING POINT

The reduced average drum temperature of the preferred embodiment not only increases the coke VCM to the desired level, but also provides other advantages in the coker operation. First, the lower drum temperature favors thermal coke formation and promotes higher porosity sponge coke. This upgraded petroleum coke is substantially softer than the traditional petroleum coke due to its higher VCM, higher porosity, and acceptable levels of shot coke. Therefore, drilling of this softer petroleum coke in the decoking cycle is less cumbersome, reducing decoking time and associated maintenance. Secondly, a lower drum vapor line temperature also reduces vapor limits without increasing drum pressure and operating costs. In addition, the lower vapor velocities from the coke drums normally decrease the entrainment of coke fines to the fractionator in the coking cycle. Thirdly, lowering the heater outlet temperature to achieve the lower drum temperature can increase the drum fill rate, reducing drum limits and coking cycle time. Finally, the reduced outlet temperature of the coker heater reduces the severity of the delayed coker operation, and consequently improves the coker operation and maintenance. This coker operational change decreases the energy consumption and cost for each barrel processed. The lower outlet temperature also reduces the potential for coking in the heater, onstream spalling, and its subsequent failure. Reducing these factors usually increases heater run life, which is a primary factor in coker run life. Also, the lower target outlet temperature typically increases coker heater throughput capacity for a given beater and feedstock. As such, the reduced outlet temperature provides a greater opportunity for an increased drum fill rate, reducing drum limits and coking cycle time. Reduction in both coking and decoking cycles can lead to increased coker throughput.

The reduced heater outlet temperature is also expected to improve the quality of the cracked liquid products. The subsequent thermal cracking is less severe and creates less olefinic components in the gas oils. The olefinic components tend to be unstable and form gum or sediments. As such, they are undesirable in downstream processing (e.g. catalytic cracking). In addition, the less severe cracking normally decreases the end point and carbon residue of the heavy coker gas oil. The heavy residuum in the coker heavy gas oil can create problems in downstream processing equipment. For example, the heavy residuum in the feed of fluid catalytic cracking units (FCCUs) often turns into coke on catalyst, which can occupy the reaction sites of the catalyst, decreasing catalyst activity and process conversion (or efficiency). In addition, increasing the coke on catalyst normally increases the severity of catalyst regeneration. In turn, severe catalyst regeneration typically increases catalyst attrition, particulate emissions, and catalyst make-up requirements. Consequently, the preferred embodiment of the present invention can avoid these problems, improving downstream operations and product quality.

Improved coke crystalline structure often reduces operation and maintenance in delayed coker. Besides improving coke grindability and combustion, reducing the production of shot coke to acceptable levels improves coker operation and reduces safety hazards. Shot coke contributes significantly to the following problems: (1) Plugging the bottom coke nozzle; inhibiting proper cooling steam, quench water, and drainage; increasing coking cycle, (2) Channeling of quench water; creating coke drum hot zones and dangerous conditions during cutting, and (3) Coke pouring out of the drum; endangering cutting crew. Consequently, reductions in the shot coke alleviate these operational problems. In addition, the softer sponge coke with the higher VCM is less likely to produce coke fines from the decoking operation. In turn, less coke fines reduces erosion of the coke cutting nozzles.

The 3-stage desalting operation can improve the operation and maintenance of the delayed coker and other refinery operations. Sodium levels >15–30 ppm in the coker feedstocks are known to accelerate heater coking. The efficient desalting normally (1) inhibits coking in the heater, (2) decreases the need for onstream spalling, and (3) increases coker heater run life. Efficient removal of certain particulates also inhibits the formation of shot coke. Most importantly, high efficiency desalting substantially decreases corrosion in atmospheric and vacuum crude distillation units and other downstream operations.

Finally, all of these operational changes can also provide greater flexibility in coker and refinery debottlenecking options. As coker feedstocks change over time, coker throughput (and often refinery throughput) is limited by the particular coker design. Major design limitations are alleviated:

(1) Heater (or Temperature) Limited: Reduced heater outlet temperature (as noted above) provides the opportunity to safely increase heater capacity with reduced heater coking and online spalling, while increasing heater (and potentially coker) run life(s).

(2) Fractionator (or Vapors) Limited: Reduced severity in thermal cracking will reduce the cracked vapors per barrel going to the fractionator; potentially increasing coker capacity. (3) Coke Drum (or Coke Make) Limited: Increased drum fill rate and decreased cutting time can be used to reduce coking and decoking cycles to increase coker throughput.

(4) Sour Crude Processing: High efficiency desalting reduces corrosion in various refinery processes and increases the refinery's tolerance of higher crude sulfur levels.

(5) Heavy Crude Processing: Decreased cycle time can increase coker throughput capacity, even with increased coke yield (e.g. 2 hr ~10–15%) and allow heavier crude residua content Since the coker is often the bottleneck in the crude throughput of many refineries, debottlenecking the coker can also translate into increased refinery throughput. In addition, factors (4) and (5) provide greater flexibility in crude blends and the ability to process inexpensive heavy, sour crudes. Thus, the overall changes in coker operation are expected to include optimization of various coking parameters, crude blends, and other refinery operations, and maximization of coker and refinery throughputs.

2. Use of Premium "Fuel-Grade" Petroleum Coke: Conventional Utility Boilers

The preferred use of this new formulation of petroleum coke is the replacement of most types of coals in conventional, pulverized-coal (PC) boilers, utility, industrial, and otherwise. As noted above, the upgraded petroleum coke of the present invention has fuel characteristics that are superior to many coals, which are currently used in conventional PC utility boilers. The discussion of this preferred embodiment includes (a) a basic description of a conventional PC utility boiler system with traditional particulate control devices, (b) the combustion process of the prior art, (c) the combustion process of the present invention and its improvements, (d) the environmental controls of the prior art, and (e) the environmental controls of the present invention and their impacts. Finally, an example is provided, at the end of this discussion, to illustrate the principles and advantages of the preferred embodiment of the present invention.

When appropriate, comparisons are made to typical bituminous coals, only for the sake of examples. Similar comparisons exist for other coals, as well. The most important improvements in the use of the upgraded petroleum coke are the abilities to maintain stable combustion without auxiliary fuels and substantially reduce environmental emissions. In particular, only modest modifications are required to substantially reduce emissions of sulfur oxides, while burning a fuel with significantly higher (or comparable) sulfur content in the fuel.

A. Conventional Pulverized-Coal (PC) Utility Boiler; Process Description

As defined here, conventional, pulverized-coal utility boilers include (but are not limited to) various coal combustion systems us ed by power utilities to produce steam and subsequently electricity via steam turbines. Typically, the coal combustion system employs horizontally-fired coal burners that produce intense flames in a high heat capacity furnace. A high heat capacity furnace has tremendous capacity to absorb the intense heat released by the combustion of the coal. The most common type of high heat capacity furnace is lined with tubes filled with water, often called a water-wall furnace. The horizontally-fired burners are normally suspension burners, which convey fine, pulverized coal particles via air (i.e. suspended by air) to the combustion zone. Pulverized coal (PC) is usually provided to the burners by a single, fuel processing/management system, which pulverizes, classifies, and regulates the flow of the coal. Pulverization to the desirable particle size distribution of coal particles is key to achieving good combustion characteristics. Also, the coal combustion system normally includes additional flue gas he at exchange, sootblowing equipment, and various temperature controls to optimize efficient use of energy.

Figure 2:
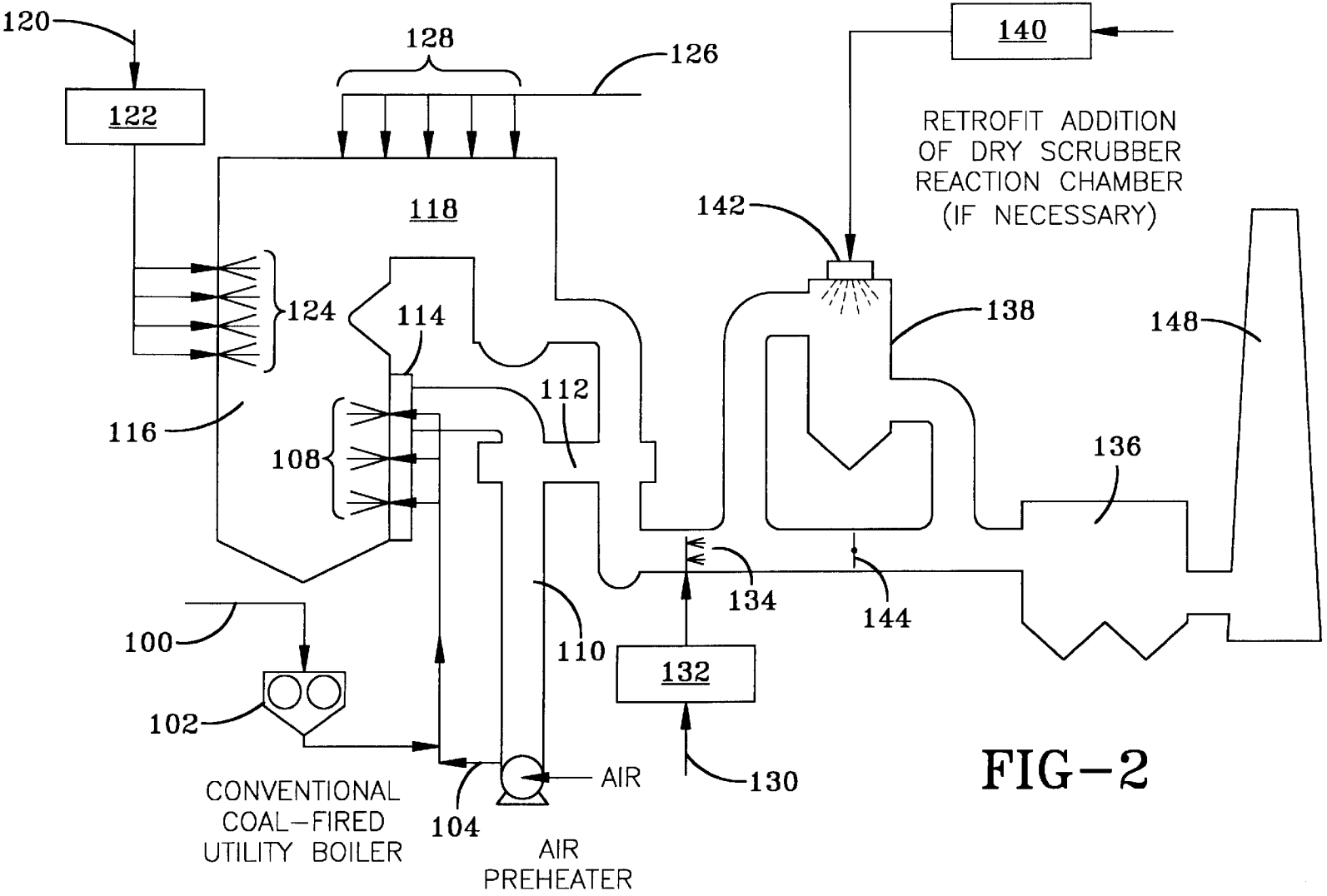
FIG. 2 shows a basic process flow diagram for a conventional, coal-fired utility boiler with traditional particulate control device (PCD): Baghouse, electrostatic precipitator (ESP), or other. In this case, the combustion system has been modified to include reaction vessel(s) and/or reagent injection system(s) for control of undesirable flue gas components.

In the preferred embodiment of the present invention, a conventional, pulverized-coal utility boiler with a traditional particulate control device is modified to convert sulfur oxides to dry particulates upstream of the existing particulate control device(s). The prior art has been modified to achieve this objective with Option 1: a retrofit addition of flue gas conversion reaction chamber(s) and reagent injection system(s) and/or Option 2: dry reagent injection system (s) in the combustion system. FIG. 2 shows a basic process flow diagram for this modified system burning a pulverized solid fuel as the primary fuel. Auxiliary fuel, such as natural gas or oil, is used for start-up, low-load, and upset operating conditions. The solid fuel 100 is introduced into the fuel processing system 102, where it is pulverized and classified to obtain the desired particle size distribution. A portion of combustion air (primary air) 104 is used to suspend and convey the solid-fuel particles to horizontally-fired burners 108. Most of the combustion air (secondary air) 110 passes through an air preheater 112, where heat is transferred from the flue gas to the air. The heated combustion air (up to 600° F.) is distributed to the burners via an air plenum 114. The combustion air is mixed with the solid fuel in a turbulent zone with sufficient temperature and residence time to initiate and complete combustion in intense flames. The intense flames transfer heat to water-filled tubes in the high heat capacity furnace 116 primarily via radiant heat transfer. The resulting flue gas passes through the convection section 118 of the boiler, where heat is also transferred to water-filled tubes primarily via convective heat transfer. At the entrance to the convection section 118, certain dry reagents can be mixed with the flue gas to convert undesirable flue gas components (e.g. sulfur oxides) to dry particulates (i.e. preferred embodiment: option 2). The sorbents 120 pass through a reagent preparation system 122 and are introduced into the flue gas via a reagent injection system 124. Steam or air 126 is normally injected through sootblowing equipment 128 to keep convection tubes clean of ash deposits from the fuel and formed in the combustion process. The flue gas then passes through the air preheater 112, supplying heat to the combustion air.

The cooled flue gas then proceeds to the air pollution control section of the utility boiler system. At the exit of the air preheater, certain dry reagents can be mixed with the flue gas to convert undesirable flue gas components (e.g. sulfur oxides) to dry particulates (preferred embodiment: option 2). The reagents 130 pass through a reagent preparation system 132 and are introduced into the flue gas via a reagent injection system 134. The existing particulate control device 136 (ESP, baghouse, etc.) has been retrofitted with the addition of a reaction chamber 138 (the preferred embodiment: option 1). Certain reagents (e.g. lime slurry) can be prepared in a reagent preparation system 140. The reagent is dispersed into the flue gas through a special injection system 142. Sufficient mixing and residence time are provided in the reaction chamber to convert most of the undesirable flue gas components (e.g. sulfur oxides) to collectible particulates. These particulates are then collected in the existing particulate control device 136. A bypass damper 144 is installed in the original flue gas duct to bypass (100% open) the retrofit, flue gas conversion system, when necessary. The clean flue gas then exits the stack 148.

B. Combustion Process of the Prior Art

The conventional, PC-fired utility boiler system, described above, can successfully burn a wide variety of solid fuels. Various types of coal are burned in such systems throughout the United States and internationally. Bituminous, sub-bituminous, and lignite coals are commonly used in this type of combustion system. Low volatile, solid fuels (such as traditional petroleum coke, anthracite coals, and low-volatile bituminous coals) typically cannot be used as the primary fuel in these types of boilers. These solid fuels often require non-conventional types of combustion systems, including cyclone furnaces, fluidized bed combustors, or down-fired burners into a low heat capacity furnace (e.g. refractory lined). The design of each conventional, PC-fired combustion system, though, varies greatly and depends on (1) each coal's respective fuel properties and combustion characteristics, and (2) the quantity and quality of steam required.

The integrated design of a conventional, PC-fired utility boiler and associated systems is a complex engineering effort. Various design and operational factors must be given proper consideration. These design and operational factors include (but are not limited to) the following:

Fuel Properties: VCM, ash content, moisture content, char quality, particle size distribution (PSD), carbon/hydrogen ratio, oxygen content, adiabatic flame temperature, burning profiles, etc.

Combustion Characteristics: flame stability, flame temperature, flame turbulence, flame residence time, excess air, air preheat (primary & secondary air), carbon burnout, combustion efficiency, etc.

Burner Design: size, number, flame shape, fuel/air mixing, pressure drop, low emissions, etc.

Furnace Design: size, shape, refractory & heat transfer properties, tube layout & metallurgy, etc.

Steam System Design: water & steam quality, tube number & spacings, sootblowing, etc.

Fuel Preparation System: pulverizer capacity & energy/grinding characteristics, in/out PSDs, etc.

Engineers skilled in the art typically use complex computer models to optimize the integrated design, based on substantial combustion experience and various design factors (including those noted above). Therefore, the remaining discussion about the combustion prior art will be limited to fuel property considerations that significantly affect the fuel decisions for new boilers and fuel switching in existing boilers. Though this discussion is primarily focused on various coals to simplify explanation, the principles involved apply to other solid fuels as well.

Numerous references discuss the combustion science related to burning solid fuels. Many provide theories of combustion and the relative impacts of various fuel properties, including ash content, moisture content, char quality, and particle size. These issues are discussed in the present invention, where it is relevant. However, two other fuel properties, that are not universally discussed, are key to accurately describe the present invention. Both fuel properties, grindability indexes and burning profiles, are important factors in the evaluation of potential fuel substitutions in conventional, PC-fired combustion systems.

GRINDABILITY INDEX

A fine particle size distribution of coal from the pulverizer is a critical parameter in achieving good combustion efficiency. That is, for a given coal, smaller coal particles normally require less residence time and/or lower temperatures to provide good char burnout and less unburned carbon. The ability to pulverize the coal to finer particle size distributions is related to the coal's hardness. However, a grindability index provides a more comprehensive comparison of the overall grindability of various coals.

Babcock & Wilcox developed one type of grindability index test, called the Hardgrove Grindability Index (HGI). This laboratory procedure, ASTM Method D 409, is an empirical measure of the relative ease with which coal can be pulverized. The HGI has been used for the past 30 years to evaluate the grindability of coals. The method involves grinding 50 grams of air-dried test coal (16×30 mesh or 1.18 mm×600 um) in a small ball-and-race mill. The mill is operated for 60 revolutions and the quantity of material that passes through a 200 mesh (75 micron) screen is measured. From a calibration curve relating −200 mesh (−75 micron) material to the grindability of standard samples supplied by the U.S. Department of Energy, the Hardgrove Grindability Index (HGI) is determined for the test coal. The higher the HGI, the more easily the coal can be pulverized to fine particle size distributions. Pulverizer manufacturers have developed correlations relating HGI to pulverizer capacity at desired levels of fineness.

BURNING PROFILES

As noted above, many fuel properties need proper consideration in the integrated design of a solid-fuel combustion system. One of the most comprehensive evaluations of the overall combustibility of a solid fuel is the burning profile. One type of burning profile test was developed by Babcock & Wilcox. This laboratory procedure measures the entire course of combustion for a tested fuel, from ignition to completion of burning.

Figure 3:
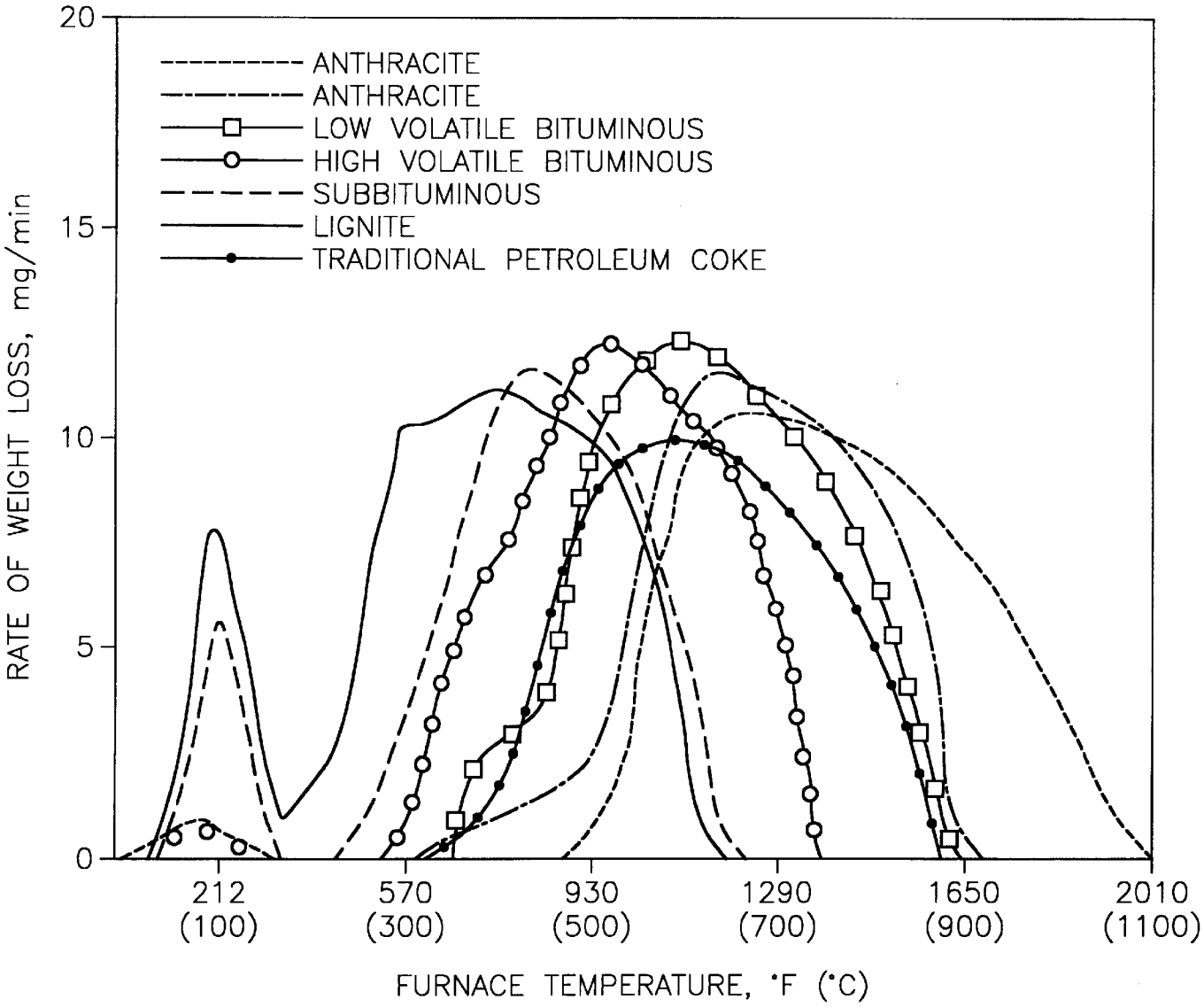
FIG. 3 shows comparisons of burning profiles for existing coals and traditional petroleum coke.

The B&W procedure, described by Wagoner and Duzy, uses derivative thermogravimetry, in which a fuel is oxidized under controlled conditions. A 300 mg sample with a particle size less than 60 mesh (250 microns) is heated at a fixed rate (27° F. per minute:68 to 2012° F.) in a stream of air. Weight change (mg/min) is measured continuously. The graphical presentation of these data (mg/min vs. temperature) provides a more complete picture of the entire combustion process, through examination of the solid fuel's oxidation rates. For example, FIG. 3 shows the burning profiles representing each classification of coal. The height of each oxidation peak is proportional to the intensity of the oxidation reactions and flame. The area under each peak is noted to be approximately proportional to the amount of combustible material in the sample and/or the total heat liberated. In general, bituminous, subbituminous, and lignite coals have greater oxidation rates at lower temperatures than anthracite coals. This indicates easier ignition and burning. Such fuels would be expected to burn more completely in the lower part of the furnace. Profiles that extend into very high temperature ranges, such as anthracite coal, indicate slow burning fuels for which longer residence times in high temperature zones are necessary for efficient combustion. Thus, the maximum temperature on the burning profile helps determine the requirement for furnace residence time at high temperature to obtain a low unburned carbon loss, and thus higher combustion efficiency.

Burning profiles are very repeatable for the same operating conditions and test furnace. However, the same solid fuel will show a different burning profile for changes in heat transfer rates, sample size, particle size distribution, air flow rate, etc. Consequently, the burning profiles provide a good qualitative comparison of relative burning properties for solid fuels, but can be limited to combustion with identical or very similar conditions.

A major shortcoming of the B&W burning profile test procedure is the preparation of the various fuel samples at a specified particle size distribution. The fuel sample is ground to less than No. 60 Sieve (~250 microns) and care is specified to produce a minimum of fines. In contrast, various coals are pulverized to 60–90% through 200 Sieve (~74 microns) for various combustion applications. As discussed previously, the particle size distribution has a substantial impact on a solid fuel's oxidation rate. Consequently, a modified test procedure is desirable to reflect relative differences in HGI and the grindability characteristics for various fuels. For example, the burning profile test procedure can be modified to prepare fuel samples with a constant grinding energy, yet minimize the generation of fines. For testing purposes, the fuel samples would still have a particle size distribution that is much larger than the commercial facility. In this manner, the relative combustion impacts of fuel grindability and resultant particle size distribution can be incorporated into the burning profile.

FUEL SUBSTITUTION

Burning profiles can be effectively used to evaluate the potential substitution of one solid fuel for another. Coals with similar burning profiles have been noted to behave similarly in large furnaces of equivalent design and operation. Thus, comparison of the burning profile of an unknown solid fuel to that of a solid fuel that has proven performance can provide useful information to predict design (e.g. furnace & burners) and operating conditions (e.g. excess air and burner settings). Furthermore, comparison of the burning profiles for an alternative solid fuel and a solid fuel with proven performance in a particular furnace design can provide a preliminary evaluation of the ability to substitute one fuel for another in a particular combustion system.

Similar burning profiles provide a higher degree of confidence in the ability to substitute one solid fuel for another. However, a perfect match of burning profiles is not necessary, and can be undesirable. For example, the first peak in the burning profile of coals with high moisture is the evaporation of the coal's water content. Providing a substitute solid fuel with this burning profile characteristic can be undesirable due to the detrimental combustion effects of moisture. Also, very volatile fuels may be undesirable due to concerns of premature ignition and excessive flame intensity. Furthermore, a low temperature peak from low-quality volatiles (e.g. carbon monoxide) can be less desirable due to its effects that cause lower heating value and higher fuel usage. Consequently, the comparison of burning profiles is a preliminary evaluation, which requires further optimization of basic fuel properties and combustion characteristics.

Optimal ignition and char burnout are key properties in achieving a successful solid fuel switch. Optimal ignition characteristics would provide self-combustion in a conventional PC boiler without auxiliary fuel, while avoiding premature ignition, excessive flame intensity, or lower heating value. Optimal char burnout would provide high combustion efficiencies (i.e. insignificant unburned carbon) at sufficiently low temperatures and residence times to complete combustion in the lower furnace, while avoiding excessive flame intensity.

Finally, derating the boiler's capacity and reducing efficiency are major concerns of fuel switching. As such, switching an existing solid fuel to a higher quality fuel is often preferable to switching to a lower quality fuel. For example, most of the western U.S. low sulfur coals are subbituminous rank that have higher moisture, comparable ash, and lower quality volatiles than bituminous coals being replaced. Consequently, their lower heating values (and capacity derating effect) limit their application to partial substitution or boilers with low load factors. However, in certain situations, the reduction in sulfur oxides emissions is more important than the ability to maintain high load factors.

C. Combustion Process of the Present Invention

The new formulation of petroleum coke of the present invention has an unexpected ability to burn successfully, even with relatively low VCM content. The combustion of this upgraded coke is compared to traditional delayed coke and most coals. Its superior fuel properties and combustion characteristics are discussed, including ash/moisture effects, char quality (particle size, porosity, etc.), ignition/residence time issues, and burning profiles. Finally, superior characteristics of the upgraded petroleum coke are then discussed for each of the following subsystems of the conventional PC utility boiler: fuel processing, combustion, and heat transfer.

COMBUSTION QUALITY OF TRADITIONAL PETROLEUM COKE

A burning profile representing a traditional petroleum coke was added to FIG. 3 for comparison to burning profiles of various types of coal. In general, this traditional petroleum coke has a burner profile similar to low-volatile, bituminous coal. Other traditional petroleum cokes (e.g. shot and Fluid coke) have burner profiles more similar to anthracite coals. In either case, the similar burner profiles show why traditional petroleum cokes require low heat capacity furnaces commonly used for these coals (e.g. cyclone furnaces). As such, traditional petroleum coke can only be considered for direct fuel substitution in special furnaces capable of firing these hard-to-burn coals.

Further analysis of this traditional petroleum coke's burning profile demonstrates even poorer combustion characteristics than these "similar" coals. First, the initial ignition temperature (~600–650° F.) is comparable to low-volatile bituminous and high-volatile anthracite coals, but significantly higher than high volatile bituminous, subbituminous, and lignite coals. This higher initial temperature of weight loss in the burning profile is caused by the low-quality, volatile content of the traditional petroleum coke. Secondly, the maximum rate of weight loss (oxidation peak) for this traditional petroleum coke is ~10–20% lower than most coals. This lower oxidation peak can be attributed to the coke's lower quality/quantity of VCM (11.7 wt. % VCM) and poor char quality (e.g. shot coke). That is, the coke's devolatilization and char burnout are not as rapid, creating lower oxidation intensity. Thirdly, the area under the curve is significantly smaller than the coal's, indicating the total sample did not oxidize. With complete combustion, the traditional petroleum coke would be expected to have a larger area under the curve, representing relatively greater proportion of combustible material due to its much higher heating value and lower ash/moisture contents. This unburned carbon can be caused by several factors, including the coke's lower quality/quantity of VCM and poor char quality. Finally, the completion of combustion occurs at approximately 1550–1600° F. This undesirable, combustion completion temperature is again comparable to low-volatile bituminous and high-volatile anthracite. Profiles that extend into these high temperature ranges indicate slow-burning fuels, which require longer residence times in high temperature zones for efficient combustion.

In conclusion, this burning profile analysis indicates the production of a petroleum coke that sustains self-combustion may require more than simply an increase in coke VCM. Substantial coke combustion experience of the inventor further supports this conclusion. Various coke/oil slurries that simply add VCM external to the coking process have been attempted with limited success. The oil provides a high quantity of high-quality VCM. However, this method does not change the poor char quality. Similarly, a higher quantity of low quality VCM is normally not sufficient to initiate and sustain self-combustion without a substantial change in the coke's char quality.

COMBUSTION OF UPGRADED VERSUS TRADITIONAL PETROLEUM COKE

The new formulation of petroleum coke in the present invention has substantially better fuel properties and combustion characteristics than the traditional "fuel-grade" petroleum coke. The primary difference is the ability to initiate and sustain self-combustion in a conventional, high heat capacity furnace without the use of auxiliary fuels, except for start-up. For example, the upgraded coke, unlike traditional coke, can be effectively burned in a conventional, pulverized-coal boiler. The superior combustion characteristics result from 3 primary changes in the new formulation of the preferred embodiment:

(1) Increased quantity and quality of VCM: improves ignition and char burnout, (2) Improved char quality of the modified sponge coke: higher porosity and reactivity, and (3) Softer coke: ability to pulverize to a smaller particle size with the same or less energy input.

The combined effect is expected to have the following impact on the petroleum coke's burning profile: (1) move the burning profile curve to the left (i.e. lower ignition and combustion completion temperatures), (2) increase maximum rate of weight loss (or peak flame intensity), and (3) increase the area under the curve (increase proportion of combustible material oxidized). These factors improve the ignition, char burnout characteristics, flame quality, and combustion efficiency.

Further embodiments of this invention provide additional means to increase the quality and quantity of the volatile combustible materials in the upgraded petroleum coke. These other embodiments provide options to improve further the combustion characteristics of the upgraded petroleum coke. With these additional embodiments, the upgraded petroleum coke is expected to initiate and complete combustion at lower temperatures and require lower combustion residence times. Consequently, the burning profiles of the upgraded coke are expected to move further to the left.

COMBUSTION OF UPGRADED PETROLEUM COKE VERSUS MOST COALS

The fuel properties and combustion characteristics of petroleum coke are improved sufficiently by the present invention to replace most coal fuels (e.g. in conventional, PC utility boilers). The preferred embodiment of the present invention is expected to improve petroleum coke sufficiently to directly replace many high volatile bituminous, subbituminous, and lignite coals. In cases where direct replacement is not possible, the improved qualities are sufficient to replace these coals with modest to moderate modifications in the design and/or operation of the combustion system (i.e. burners, furnace, etc.).

Superior Fuel Properties

The premium, "fuel-grade" petroleum coke typically has better combustion characteristics than most coals due to more desirable fuel properties. The primary coke fuel properties affecting combustion characteristics include the following: lower ash, lower moisture content, lower grindability hardness, greater fuel consistency, and significantly higher (or comparable) porosity of the residual carbon. Table 2 provides comparison of key differences in fuel properties for traditional petroleum cokes, upgraded petroleum cokes, and many examples of various types of coal. Compared to most coals, the upgraded petroleum coke typically has 95+% lower ash content, 5–90+% lower moisture content, and 10–250+% higher heating values. The fuel rate is typically decreased by 10–50+%. The significantly lower fuel rate can decrease the total quantity of undesirable components (e.g. sulfur), even with higher component contents (wt. % in pet coke vs. coal). Sulfur, nitrogen, and carbon contents of the upgraded coke are normally comparable or higher. The VCM content is typically lower for comparable combustion characteristics (e.g. burning profile) and fuel use applications.

TABLE 2

SOLID FUEL PROPERTIES

| | | | | | | | HEATING VALUE | | FUEL* | Uncontrolled Emissions** | | |
|---|---|---|---|---|---|---|---|---|---|---|---|---|
| Solid Fuel Type | VCM wt. % | Ash wt. % | Moisture wt. % | Sulfur wt. % | Nitrogen wt. % | Carbon wt.% | Received MBtu/Lb | MAF*** MBtu/Lb | Required MLb/Hr. | ASH MLb/Hr. | SO2 MLb/Hr. | CO2 MLb/Hr. |
| Traditional Delayed Coke | 10.42 | 0.33 | 0.26 | 4.55 | 1.67 | 88.80 | 15.21 | 15.25 | 65.7 | 0.22 | 5.98 | 214 |
| Traditional Fluid Coke | 8.64 | 0.27 | 4.04 | 5.62 | 1.75 | 84.12 | 13.89 | 14.45 | 72.0 | 0.19 | 8.10 | 222 |
| Traditional Flexicoke | 6.66 | 4.57 | 2.60 | 2.35 | 0.83 | 87.03 | 12.85 | 13.18 | 77.8 | 3.56 | 3.66 | 248 |
| Modified Delayed High Sulfur | 16.00 | 0.31 | 0.25 | 4.31 | 1.58 | 87.50 | 15.30 | 15.34 | 65.4 | 0.20 | 5.63 | 210 |
| Modified Delayed Med Sulfur | 16.00 | 0.31 | 0.25 | 2.50 | 1.58 | 87.50 | 15.30 | 15.34 | 65.4 | 0.20 | 3.27 | 210 |
| Modified Delayed Desulfurized | 16.00 | 0.31 | 0.25 | 0.65 | 1.58 | 87.50 | 15.30 | 15.34 | 65.4 | 0.20 | 0.85 | 210 |
| Modified Fluid High Sulfur | 20.00 | 0.25 | 3.76 | 5.24 | 1.63 | 82.80 | 14.21 | 14.78 | 70.4 | 0.18 | 7.37 | 214 |
| Modified Fluid Med Sulfur | 20.00 | 0.25 | 3.76 | 2.50 | 1.63 | 82.80 | 14.21 | 14.78 | 70.4 | 0.18 | 3.52 | 214 |
| Modified Fluid Desulfurized | 20.00 | 0.25 | 3.76 | 0.79 | 1.63 | 82.80 | 14.21 | 14.78 | 70.4 | 0.18 | 1.11 | 214 |
| Anthracite | 6.40 | 10.50 | 7.70 | 0.70 | 0.90 | 83.70 | 11.89 | 14.39 | 84.1 | 8.83 | 1.18 | 258 |
| Anthracite: SW Virginia | 10.60 | 20.20 | 2.00 | 0.62 | | 76.70 | 11.93 | 15.34 | 83.9 | 16.94 | 1.04 | 236 |
| Bituminous: SW Pennsyvania | 20.80 | 10.20 | 1.50 | 1.68 | | 86.20 | 13.72 | 15.49 | 72.9 | 7.43 | 2.45 | 230 |
| Bituminous: W. Pennsylvania | 23.40 | 10.20 | 1.50 | 2.20 | | 86.00 | 13.80 | 15.58 | 72.5 | 7.39 | 3.19 | 229 |
| Bituminous: Upper Freeport | 28.10 | 13.40 | 2.20 | 0.76 | 1.27 | 74.90 | 12.97 | 15.32 | 77.1 | 10.33 | 1.17 | 212 |
| Bituminous: West Virginia | 37.60 | 7.00 | 2.50 | 2.30 | 1.50 | 75.00 | 13.00 | | 76.9 | 5.38 | 3.54 | 212 |
| Bituminous: E. Central Illinois | 38.80 | 9.00 | 12.20 | 3.20 | | 74.90 | 11.34 | 12.63 | 88.2 | 7.94 | 5.64 | 242 |
| Bituminous: E. Central Ohio | 40.00 | 9.10 | 3.60 | 4.00 | | 83.30 | 12.85 | 14.38 | 77.8 | 7.08 | 6.23 | 238 |
| Bituminous: Pittsburgh #8 | 40.20 | 9.10 | 5.20 | 2.30 | 1.60 | 74.00 | 12.54 | 14.55 | 79.7 | 7.26 | 3.67 | 216 |
| Bituminous: Illinois #6 | 44.20 | 10.80 | 17.60 | 4.30 | 1.00 | 69.00 | 10.30 | 14.01 | 97.1 | 10.49 | 8.35 | 246 |
| Subbituminous: NE Wyoming | 31.40 | 4.80 | 31.00 | 0.55 | | 61.10 | 8.32 | 8.79 | 120.2 | 5.77 | 1.32 | 269 |
| Subbituminous: E. Montana | 32.20 | 7.00 | 14.10 | 0.43 | | 75.70 | 11.14 | 12.08 | 89.8 | 6.28 | 0.77 | 249 |
| Subbituminous: Montana | 40.80 | 5.20 | 23.40 | 0.44 | 0.95 | 72.00 | 9.54 | 13.13 | 104.8 | 5.45 | 0.92 | 277 |
| Subbituminous: Wyoming | 43.10 | 5.70 | 24.10 | 0.35 | 0.96 | 70.30 | 9.19 | 12.84 | 108.8 | 6.20 | 0.76 | 280 |
| Lignite: North Dakota | 43.60 | 11.10 | 33.30 | 1.10 | 1.00 | 63.30 | 7.09 | 11.96 | 141.0 | 15.66 | 3.10 | 327 |
| Lignite: Texas (Bryan) | 31.50 | 50.40 | 34.10 | 1.00 | 0.40 | 33.80 | 3.93 | 12.02 | 254.5 | 128.24 | 5.09 | 315 |
| Lignite: Texas (San Miguel) | 21.20 | 68.80 | 14.20 | 1.20 | 0.29 | 18.40 | 2.74 | 10.26 | 365.0 | 251.09 | 8.76 | 246 |

*Basis: $10^9$ Btu/Hour Heat Release

**Mlb/Hr = lb/MMBtu; Due to Heat Release Basis

***MAF = Moist, Ash-Free Basis

Improved Combustion Characteristics

The superior fuel properties of the upgraded petroleum coke from the present invention provide improved (or comparable) combustion characteristics relative to most coals. More desirable combustion characteristics are expected to include (but are not limited to) (1) superior ash and moisture combustion effects, (2) increased residence time, (3) better (or comparable) char quality & burnout, and (4) improved combustion stability with lower excess air rates.

(1) Superior Ash and Moisture Combustion Effects: The lower ash and moisture contents of the upgraded petroleum coke affect a variety of combustion characteristics. Ash and moisture absorb heat in the combustion process. This increases the required ignition temperature and reduces the flame temperature (adiabatic and actual). Also, high ash and moisture contents substantially reduce the heat content (Btu/pound) of the fuel and require more pounds of fuel for a given heat release rate in the combustion system. Consequently, lower ash and moisture contents of the upgraded petroleum coke increases flame temperature and heating value and reduces required ignition temperature and fuel rates.

(2) Increased Residence Time: The lower fuel rates and associated reduction in air rates normally increase operating capacities in an existing boiler for the pulverizer, fan, and boiler systems. In addition, the lower fuel and air rates can significantly increase the residence time in the existing boiler system, usually improving combustion efficiency (e.g. carbon-burnout), boiler efficiency (e.g. better heat transfer), and environmental control efficiency (e.g. reduced ESP velocity: Q/A). In most cases, upgraded coke also decreases flue gas flow, system pressure-drop, and associated auxiliary power.

(3) Better Char Quality and Burnout: The high porosity, sponge coke of the present invention provides better char quality that favors superior carbon burnout to most coals. The higher porosity provides more accessible combustion reaction sites, and promotes more complete carbon burnout. As discussed below, the significantly lower hardness (HGI=80–120+) allows more flexibility in grinding the coke to a much finer particle size distribution at lower grinding energies. The finer particle size of the fuel promotes more efficient and complete combustion, particularly for a low VCM fuel.

(4) Improved Combustion Stability with Lower Excess Air: The upgraded petroleum coke is produced by a chemical process that provides less variability in composition and combustion characteristics than coal(s) from different veins in the same mine or even different mines. That is, the upgraded petroleum coke of the present invention has more uniform fuel properties and combustion characteristics. This fuel consistency normally improves flame stability and decreases excess air requirements for similar load variations.

(5) Catalytic Oxidation Effects: The metals content of petroleum coke (upgraded or traditional) often contains higher levels of heavy metals, such as vanadium and nickel. These metals can provide a positive benefit as an oxidation catalyst to improve combustion characteristics and efficiency.

All these factors give the upgraded petroleum coke firing capabilities and combustion characteristics that are superior (or comparable) to coals with significantly higher VCM content. High quality VCM, high porosity sponge coke, and finer particle size distribution of the upgraded coke fuel are primary features of the present invention that reduce the overall VCM requirement relative to various coals. Low ash and moisture content are also contributing factors. In conclusion, the fuel qualities of the upgraded petroleum coke are expected to promote (1) a more uniform and stable flame, (2) acceptable combustion at lower excess air operation, and (3) better char burn-out characteristics than most coals, over a wide range of operating conditions.

As noted above, additional embodiments of this invention provides additional options to increase the quality and quantity of the volatile combustible materials in the upgraded petroleum coke. That is, high quality VCM (e.g. BP Range: 350–750° F. & heating value: 16–20,000+ btu/lb) can be integrated into the petroleum coke crystalline structure. In this manner, the burning profile of the upgraded coke can be adjusted to optimize desirable combustion characteristics for replacing solid fuels in a particular combustion system (See: Optimal Fuel Embodiment). This can be accomplished by matching the burning profile of the existing solid fuel or achieving other desirable burning profile characteristics. For example, production of an upgraded petroleum coke with optimal ignition and char burnout characteristics can also be achieved. Again, in cases where direct replacement is not possible, the improved qualities are sufficient to replace these coals with modest to moderate modifications in the design and/or operation of the combustion system (i.e. burners, furnace, etc.).

COMBUSTION OF UPGRADED PETROLEUM COKE VS. LOW SULFUR COALS

Most low-sulfur coals referred to in this section are actually a subset of the previous section (i.e. most coals). Consequently, the comparison of fuel properties and combustion characteristics are still valid in this section. However, low-sulfur subbituminous coals are a special subset of "Most Coals" that warrants further discussion, due to their current use as fuel alternatives to comply with U.S. environmental laws.

Many PC utility boilers in the United States are being switched from bituminous coal to subbituminous, low-sulfur coal to comply with EPA regulations caused by the CAAA of 1990. The subbituminous, low sulfur coal typically has comparable ash contents, higher moisture contents and lower heating values (vs. bituminous coal). The fuel rate is typically increased by 20–40+%. The substantially higher fuel rate usually increases the ash quantity, even with lower ash content (wt. %). Consequently, a fuel switch to this low-sulfur coal normally requires boiler derating (operating with lower capacity), pulverizer derating, and mitigating problems with particulate emissions. Other problems often include increases in air requirements, flue gas flow, system pressure-drop, and associated auxiliary power. Most of these factors lead to decreased combustion, boiler, and environmental control efficiencies.

In contrast, a fuel switch to the upgraded petroleum coke of the present invention will have the opposite impact on most of these factors. Table 2 shows that the upgraded petroleum coke (vs. bituminous coal) typically has 95+% lower ash content, 5–30+% lower moisture content, and 10–25%% higher heating values. The fuel rate is typically decreased by 10–20+%. The significantly lower fuel rate usually decreases the overall sulfur quantity, even with higher sulfur content (wt. %). Consequently, a fuel switch to the upgraded coke increases operating capacities for the pulverizer, fans, boiler, and environmental control systems. Decreases in air requirements, flue gas flow, system pressure-drop, and associated auxiliary power can often lead to increased combustion, boiler, and environmental control efficiencies, as well. In conclusion, fuel switching from most coals (including low sulfur, subbituminous coals) to the upgraded petroleum coke of the present invention can significantly improve the various subsystems of the conventional, PC utility boiler: fuel processing, combustion and heat transfer.

FUEL PROCESSING IMPROVEMENTS

The higher VCM, lower ash content, and lower hardness of the upgraded petroleum coke greatly reduce the fuels handling challenges and equipment wear. First, the upgraded petroleum coke has the capability of being the only fuel required, allowing the use of one fuel processing and management system, existing or otherwise. In contrast, the prior art for combustion of traditional, fuel-grade petroleum coke in a utility boiler requires a coke/coal blend, which often required separate fuel processing systems for the coal and petroleum coke, respectively. Secondly, the upgraded petroleum coke has dramatically lower ash content (0.1–1.0 wt. %) and moisture content (0.5–4.0 wt. %) than most coals (Ash=5–70 wt. % & Moisture=5 to >50 wt. %). The lower ash and moisture contents give the upgraded petroleum coke a substantially higher heating value: (13.0–15.5 MBtu/lb) than most coals (0.5–13.0 MBtu/lb). Consequently, the conventional utility boiler requires substantially less tons of the upgraded petroleum coke for a given heat release rate. Thirdly, the upgraded coke of this invention also is dramatically softer than most bituminous coals, as indicated by its lower HGI of 80–120+, compared to 20–80+ of typical bituminous coals and <60 for traditional petroleum cokes. Consequently, the existing pulverization equipment can normally grind the upgraded coke to a much finer particle size distribution, at the same level of grinding energy. For example, 60–80% through 200 mesh is typical for various ranks of coals (lignite to anthracite). The upgraded petroleum coke can usually achieve 85–95+% through 200 mesh with less (or comparable) grinding energy. This very fine particle size distribution further improves its combustion characteristics. Alternatively, the upgraded coke could be ground to the same particle size distribution (or any point in between) with a lower grinding energy and cost. Both the reduced fuel rate (e.g. Tons/hour) and the lower hardness (softer material) are expected to substantially reduce erosion, equipment wear, and operating & maintenance costs in the fuel processing and combustion systems.

COMBUSTION IMPROVEMENTS

As discussed previously, the upgraded petroleum coke provides superior fuel properties and improved combustion characteristics relative to traditional petroleum coke and most coals. The fuel properties of the upgraded coke are superior to traditional coke due to (1) increased quantity and quality of VCM (improves ignition and char burnout), (2) improved char quality of the modified sponge coke (higher porosity and reactivity), and (3) softer coke (ability to pulverize to a smaller particle size). The fuel properties of the upgraded coke also provide improved combustion characteristics relative to most coals: (1) superior ash and moisture combustion effects, (2) increased residence time, (3) better char quality and burnout, (4) improved combustion stability with lower excess air, and (5) catalytic oxidation effects.

HEAT EXCHANGE IMPROVEMENTS

In most cases, the premium, fuel-grade petroleum coke is expected to have better heat transfer characteristics and overall thermal efficiency. In operating conditions with more uniform and stable flames, the upgraded petroleum coke is expected to provide better radiant heat transfer characteristics. The much lower ash also dramatically reduces the fouling of heat transfer surfaces and the need for sootblowing of convective heat exchange surfaces. The better heat transfer characteristics, reduced fouling, combustion with lower excess air, and better (or comparable) carbon burnout provide greater thermal efficiency for a combustion system fired with the upgraded petroleum coke. Low ash fusion temperatures are not expected to create heat exchange problems due to the low-level decontamination to remove sodium and vanadium from the petroleum coke to acceptable levels.

D. Environmental Controls of the Prior Art

Various technologies currently exist for particulate control and removal of undesirable pollutants, primarily sulfur oxides SOx. The present invention does not claim these technologies separately, but provides improvements and novel combinations of these technologies in applications of the present invention, particularly in retrofit applications.

PARTICULATE CONTROL DEVICE (PCD) FUNDAMENTALS

Particulate emissions from solid-fuel combustion come from noncombustible, ash forming mineral matter in the fuel. Additional particulates are unburned carbon residues from incomplete combustion of the fuel. Though solid particulates from solid-fuel combustion primarily range in size from 1–100 microns, finer particulates less than 10 microns are the focus of recent environmental concerns. "Bottom ash" refers to larger, heavier particulates that are collected in hoppers beneath the furnace of the combustion facility. "Flyash" refers to finer ash that is entrained in the flue gas and is collected in heat exchange/air preheater hoppers and various types of particulate control equipment. Traditional particulate control devices (PCDs) for conventional, solid-fuel combustion systems include (but are not limited to) electrostatic precipitators (ESPs), various types of filtering systems, mechanical collectors, and wet scrubber systems.

Electrostatic Precipitators (ESP)

A wide variety of ESP technologies has evolved through the years, including dry and wet versions. The electrostatic precipitator electrically charges the particulates in the flue gas to collect and remove them. The ESP is comprised of a series of parallel vertical plates through which the flue gas passes. Centered between the plates are charging electrodes which provide the electric field. The negatively charged particles are attracted toward the grounded (positive) collection plates and migrate across the gas flow. The charging electrodes and collection plates are periodically cleaned by rapping these components and dislodging sheets of agglomerated particles that fall into large hoppers. ESPs have low pressure drops due to their simple design characteristics. ESP collection efficiencies can be expected to be 95–99+% of the inlet dust loading. Overall ESP performance depends on various design and operational factors, including (but not limited to) flyash loading, particle resistivity, particle drift velocity, electric field strength, and the ratio of plate surface area to flue gas flow. Lower sulfur concentrations in the flue gas can lead to lower ESP collection efficiency due to their effects on particle resistivity. ESPs are available in a broad range of sizes for utility and industrial applications.

Fabric Filters

Various types of filtering systems have evolved as well. The more popular types include numerous tubular (or bag)

filters in parallel flow arrangements, and have been commonly referred to as baghouses. Baghouse systems usually have multiple compartments with each compartment containing hundreds to thousands of bag filters. The baghouse, or fabric filter, collects the dry particulates as the cooled flue gas passes through the porous filter material that separates the particulate from the flue gas. Agglomerated layers of particulates (commonly called filtercake) accumulate on the filter material. This filtercake increasingly restricts the gas flow, until the filter media is cleaned. Different baghouse technologies have a variety of designs to continually clean the filtering media in temporarily inactive compartments: pulse jet, reverse air, shaker and deflation. Fabric filters have significantly higher pressure drops than ESPs due to the filter media and filtercake. However, power usage of fabric filters and ESPs tend to be similar because the additional fan power needed to overcome the increased pressure drop in fabric filters is approximately equal to the power consumed in the ESP transformer rectifier sets. Fabric filter collection efficiency can be expected to be 95–99+%. Fabric filters are substantially more effective than ESPs in the removal of particulates less than 2 microns. Overall performance depends on various design and operational factors, including (but not limited to) flyash loading, gas-to-cloth ratio, pressure drop control, and type/porosity of filter material. Fabric filters are considered to be more sensitive to operational upsets or various load swings than ESPs due to maximum temperature and stress limitations of the filter material. Finally, fabric filters have the potential for enhancing SOx capture in installations downstream of SOx dry scrubbing or dry sorbent injection systems (via longer reagent exposure & reaction residence times in the filter cake).

Mechanical Collectors

Mechanical dust collectors, often called cyclones or multiclones, have been used extensively to remove large particles from a flue gas stream. The cyclonic flow of gas within the collector and the centrifugal force on the particles drive the larger particles out of the flue gas. Cyclones are low cost, simple, compact and rugged devices. However, conventional cyclones are limited to collection efficiencies of about 90% and are poor at collecting the smallest particulates (<10 microns). Improvements in small particulate collection require substantially higher pressure drops and associated costs. Consequently, mechanical collectors had been widely used on small combustion facilities when less stringent particulate emission limits applied.

Wet Scrubbers

Finally, various wet scrubber systems have evolved to control particulate and other emissions, including sulfur oxides. Wet scrubbing technologies for combined particulate and SOx control typically employ high pressure drop, turbulent mixing devices (e.g. venturi scrubbers) with downstream separation. However, the high energy consumption of this type of wet scrubber made them impractical for use with larger combustion facilities, particularly modern, utility boilers. Pressure drops of 10–72 inches of water are necessary for >85% removal of particulates down to 0.5–1.0 microns. In contrast, only 0.5–1.5 inches of water are required to achieve >85% collection of particles >10 microns in gravity spray towers. These low pressure-drop, wet scrubbers can achieve some ash particulate control, but are primarily used for the control of sulfur oxides. Particulate sulfur compounds formed in this process are collected in liquid film or droplets.

SULFUR OXIDES (SOx) CONTROL FUNDAMENTALS

A variety of SOx control technologies are in use and others are in various stages of development. Commercialized flue gas desulfurization (FGD) processes for solid-fuel, combustion facilities include (but are not limited to) wet, semi-dry (spray dry adsorption), and completely dry (dry sorbent injection) systems. In all three of these system types, alkaline reagent(s) (i.e. compounds of alkali or alkaline earth metals) reacts with the sulfur oxides to form collectible sulfur compounds. Wet scrubber systems normally have upstream particulate control devices (PCDs) to remove any flyash prior to SOx removal, and collects its sulfur products in a liquid film. In contrast, sulfur products from the spray dry adsorption and dry sorbent injection systems are usually collected together with the flyash in downstream PCDs.

Wet scrubbers

Wet FGD systems have been the dominant worldwide technology for the control of SOx from utility power plants. In the wet scrubbing process, alkaline sorbent slurry is contacted with the flue gas in a reactor vessel. The most popular wet scrubber reactor is the spray tower design where the average superficial gas velocity is less than the design gas velocity at maximum load. Flue gas enters the scrubber module at a temperature of 250–350° F., and is evaporatively cooled to its adiabatic saturation temperature by the slurry spray. The slurry consists of water mixed with an alkaline sorbent: usually limestone, lime, magnesium promoted lime, or sodium carbonate. Spray nozzles are used to control the mining of slurry with the flue gas. Sulfur dioxide is absorbed by the liquid droplets and chemically converted to calcium sulfite and calcium sulfate. These wet scrubber reactions usually take place in the pH range of 5.5–7.0. The sulfur compounds formed in this process are collected in the liquid film and deposited in the reaction tank at the base of the scrubber. Forced oxidation is often used in the reaction tank to oxidize the collected calcium sulfite to calcium sulfate, which precipitates from the ionic solution. If the calcium sulfate has sufficient purity, it can be used as commercial gypsum (e.g. wallboard manufacture). Unreacted reagents (dissolved in the ionic solution) are recirculated in the sorbent slurry, increasing sorbent utilization.

Many factors determine the number of gas phase transfer units (Ng) and SOx removal efficiencies. These factors include slurry spray rate, slurry droplet size, spacial distributions, gas phase residence time, liquid residence time, wall effects, and gas flow distribution. In general, wet scrubbing is a highly efficient $SO_2$ control technology with removal levels >90% at stoichiometric calcium/sulfur (Ca/S) ratios close to 1.0. Primary advantages of this reliable, established technology include (1) high utilization of sorbents and (2) the ability to produce usable products: gypsum or sulfuric acid. The major disadvantages of wet scrubbing are (1) complexity of operation, (2) limited control of sulfur trioxide ($SO_3$), (3) potential scaling and corrosion problems, and (4) wet disposal products that typically require dewatering, stabilization, and/or fixation.

Dry Scrubbers

Dry scrubbing (sometimes referred to as spray absorption, spray drying, or semi-wet scrubbing) is the principal alternative to wet scrubbing for SOx control on solid-fuel combustion systems. Dry scrubbing involves spraying a highly atomized slurry or aqueous solution of alkaline reagent into the hot flue gas to absorb $SO_2$. Various alkaline reagents have been used in dry scrubbers, but the predominant reagent used is slaked lime, which behaves like highly reactive limestone. The quantity of water in the atomized spray is limited so that it completely evaporates in suspension. $SO_2$ absorption takes place primarily while the spray is evaporating. The dry scrubber reactions usually take place in the pH range of 10–12.5. Apparently, this high alkalinity contributes to the dry scrubber's effective removal of sulfur trioxide ($SO_3$) from the flue gas. The dry scrubber is noted to quench the inlet flue gas to a temperature below the dew point for $SO_3$. Tests have indicated that virtually all $SO_3$ is absorbed and neutralized in the spray dry absorber. That is, condensed sulfuric acid allegedly reacts with the alkaline sorbent to form a collectible salt.

SOx dry scrubbers are designed to achieve the appropriate reaction conditions for the specific alkaline reagent used: temperature zone, mixing, residence time, and moisture. Dry scrubbers are normally sized for a certain gas-phase residence time (typically 8–12 seconds), which depends on the degree of atomization and the design approach temperature. The approach temperature is the difference between the adiabatic saturation temperature and the temperature of flue gas leaving the dry scrubber. Dry scrubbers are typically located immediately downstream of the air preheater (flue gas temperatures 250–350° F.), and upstream of the particulate control device. The slurry spray adiabatically cools the flue gas. Consequently, the flue gas temperature leaving the dry scrubber may be too low for proper operation of the particulate control device. In these instances, the gases may require heating before entering the PCD (fabric filter or ESP). An electrostatic precipitator (ESP) is more forgiving of temperature variation but the baghouse has the advantage of being a better SOx-lime reactor.

Dry scrubber performance is primarily dependent upon reagent stoichiometry and approach temperature. SOx removal efficiencies of 85–95% can be achieved with stoichiometric Ca/S ratios of 1.2–1.6 with solids recycle. The primary advantages of dry scrubbing over wet scrubbing include (1) dry waste products, (2) greater $SO_3$ control, and (3) less costly construction materials. Major disadvantages include (1) high sorbent utilization rates, and (2) potential reheating requirements. The high sorbent utilization rates have limited dry scrubber applications to units burning low-sulfur fuel. Dry scrubbers can increase particulate loading to PCDs and waste disposal by 2–4 times.

Dry Sorbent Injection

Furnace sorbent injection has been developed over the past 20–25 years. Dry sorbent technologies do not use reaction chambers, but pneumatically inject alkaline reagents directly into the flue gas at the location of appropriate temperatures for the desired reactions. These dry sorbent technologies rely on the combustion system to provide the mixing and residence time necessary to achieve high conversion levels. These systems cost less, but provide less SOx reduction capabilities. They can also increase particulate loading to PCDs and waste disposal by 3–5 times due to low sorbent utilization efficiency. Three major types of dry sorbent injection appear promising:

(1) Furnace Injection of Calcium-Based Sorbents: Limestone, dolomite, or hydrated lime readily reacts with SOx in the temperature range of 2000–2300° F. Normally, the injection point for these sorbents is near the nose of the boiler. Using these sorbents, 30–65% SOx removal is achievable with stoichiometric calcium/sulfur (Ca/S) ratios of 2.

(2) Economizer Inlet and/or Post-Furnace Injection of Calcium Hydroxide: hydrated calcium hydroxide ($Ca(OH)_2$) favorably reacts with SOx in the temperature range of 840–1020° F. Injection of this sorbent at the economizer inlet of many boilers can achieve 40–80% SOx capture with Ca/S=2. Alternatively, this sorbent can be injected immediately downstream of the air heater with an associated humidification system that increases relative humidity, approaching the saturation temperature. With an approach temperature of <50° F., SOx capture of 50–55% can be achieved with Ca/S=2. Since the sulfite formation is very fast (<250 milliseconds) and the reaction window is approximately 212° F. wide, the process is compatible with high quench rates (typically 932–1112° F./sec) through economizers.

(3) Post-Furnace Injection of Sodium-Based Sorbents: Trona and nacholite (naturally occurring forms of sodium carbonate and bicarbonates) react with SOx at air heater exit temperatures (250–350° F). A relatively simple injection system is placed between the air heater and baghouse. SOx reactions take place in the flue ahead of the baghouse and on the surface of the fabric filter. However, sodium carbonates have been observed to catalyze the oxidation of nitric oxide (NO) to nitrogen dioxide ($NO_2$), which creates a visible, brown stack plume. SOx removal efficiencies for nacholite are 70–80+% with sodium/sulfur ratio=1 (i.e. NSR= normalized stoichiometric ratio); Trona has demonstrated 45–70% removal with NSR Na/S=1. In both sorbents, lower overall removal efficiencies are achieved with ESPs vs. fabric filters.

Other SOx Control Technologies

Many other technologies are being evaluated for their potential commercial application to address SOx control and acid rain legislation/regulations. Considerable activity is being devoted the development of a technology that effectively controls both sulfur oxides and nitrogen oxides, with high removal efficiencies and operational reliability. One such technology is particularly relevant to the present invention: activated coke beds for SOx and NOx control. The activated coke can adsorb $SO_2$, and catalyze the reduction of NOx by ammonia. Regeneration of the spent coke at high temperature produces a concentrated $SO_2$ stream that can be further processed to yield a salable by-product, such as sulfuric acid. Such systems have been commercially applied in Japan and Germany, where $SO_2$ removals of 90–99+% and NOx removals of 50–80+% have been reported. However, most experience has been with low- to medium-sulfur systems. There is some question regarding process suitability for high-sulfur applications because of high coke consumption.

Retrofit Applications

Various types of dry scrubbing and dry sorbent injection systems have been demonstrated on retrofit utility boiler applications with baghouses or electrostatic precipitators. These retrofit applications have usually added reaction chamber(s) and/or injection system(s) upstream of existing particulate control devices (PCDs) without significant increases in the PCD capacity. That is, the PCD is not only required to control ash particulates, but also handle the increased load of dry particulates resulting from the conversion of sulfur oxides. These dry particulates normally consist of ionic salts; spent sorbent and unreacted sorbent. Typically, these salts are relatively large and easier to collect than ash particulates. However, the combined load (Mlb/Hr.) can be more than 200% of the original design. Consequently, this type of dry scrubber retrofit can be limited by (1) ash particulate inhibition of reagent reactivity and (2) capacity limiting effect on PCD collection efficiency. Even so, numerous dry scrubber retrofits have demonstrated SOx removal efficiencies between 85 and 90% with some sacrifice in particulate emissions. Similarly, dry sorbent injection technologies have been demonstrated on retrofit systems to achieve 40–70% with sacrifices in particulate emissions. In general, these relatively low capital-cost alternatives can effectively reduce sulfur oxide emissions. However, environmental regulations for particulate emissions can be prohibitive for their use as long-term solutions.

NITROGEN OXIDES (NOx) CONTROL FUNDAMENTALS

Nitrogen oxides emissions are formed in the combustion process by two mechanisms: (1) Fuel NOx: oxidation of fuel-bound nitrogen during fuel devolatilization and char burnout, and (2) Thermal NOx: high-temperature oxidation of the nitrogen in the air. Typically, more than 75% of the NOx formed during conventional PC firing (i.e. w/o Low NOx Burners) is fuel NOx. Even though fuel NOx is a major factor, only 20–30% of the fuel-bound nitrogen is actually converted to NOx in uncontrolled conditions. Both NOx formation mechanisms are promoted by rapid fuel-air mixing, which produces high volumetric heat release rates, high peak flame temperatures, and excess available oxygen. However, thermal NOx is far more sensitive to high flame temperatures, particularly >2200° F. The potential reduction of nitrogen oxides (NOx) emissions is site specific and depends on various combustion design and operational factors.

Combustion Modifications

Low NOx burners, staged combustion, flue gas recirculation, and reburning are various types of combustion modifications used to control the rate of fuel-air mixing, reduce oxygen availability in the initial combustion zone, and decrease peak flame temperatures. These combustion techniques can be used separately or in combination to reduce thermal and fuel NOx. NOx reductions from these methods typically range from 20 to over 60%. Low NOx burners slow and control the rate of fuel-air mixing, thereby reducing oxygen availability and peak flame temperatures in the ignition and primary combustion zones. Staged combustion uses low excess air levels in the primary combustion zone with the remaining (overfire) air added higher in the furnace to complete combustion. Flue gas recirculation reduces oxygen concentrations and combustion temperatures by recirculating some of the flue gas to the furnace without increasing total net gas mass flow. In reburning, 75–80% of the furnace fuel input is burned in Cyclone furnaces with minimum excess air. The remaining fuel (gas, oil, or coal) is added to the furnace above the primary combustion zone. This secondary combustion zone is operated substoichiometrically to generate hydrocarbon radicals which reduce NOx formed in the Cyclone to molecular nitrogen ($N_2$). The combustion process is then completed by adding the balance of the combustion air through overfire air ports in a final burnout zone in the top of the furnace.

Selective Non-Catalytic Reduction (SNCR)

In SNCR, ammonia or other compounds (e.g. urea) that thermally decompose to ammonia are injected downstream of the combustion zone in a temperature region of 1400 to 2000° F. If injected at the optimum temperature, the NOx in the flue gas reacts with the ammonia to produce molecular nitrogen ($N_2$) and water. Without base-load operation, locating ammonia injection system(s) at the optimal temperature is somewhat difficult due to temperature variations with load swings and operational upsets. The injection of hydrogen, cyanuric acid, or ammonium sulfate is sometimes used to broaden the effective temperature range. NOx reduction levels of 70% (from inlet concentrations) are possible under carefully controlled conditions. However, 30–50% NOx reductions are more typically used in practice to maintain acceptable levels of reagent consumption and unreacted ammonia carryover. Unreacted ammonia (often called ammonia slip) can (1) represent additional pollutant emissions and (2) create ammonium sulfate compounds that deposit on downstream heat exchange surfaces and cause plugging, fouling, and corrosion problems.

Selective Catalytic Reduction (SCR)

SCR systems remove NOx from flue gases by reaction with ammonia in the presence of a catalyst to produce molecular nitrogen ($N_2$) and water. Most SCR units can operate within a range of 450–840° F., but optimum performance occurs between 675 and 840° F. The minimum temperature varies and is based on fuel, flue gas specifications, and catalyst formulation. NOx control efficiencies of 70–90% can be consistently achieved. Like SNCR, these control efficiencies are dependent on inlet NOx concentrations, and are cumulative to NOx reductions from combustion modifications. Also, the same concerns for unreacted ammonia exist in SCR units.

Other NOx Control Technologies

Other technologies are being evaluated for their potential commercial application to address NOx control and acid rain legislation/regulations. Considerable activity is being devoted the development of a technology that effectively controls both nitrogen oxides and sulfur oxides, with high removal efficiencies and operational reliability. Most involve variations of reducing NOx with ammonia, similar to SNCR and SCR. As noted above, activated coke technology for the removal of SOx and NOx is particularly relevant to the present invention.

CARBON DIOXIDE ($CO_2$) CONTROL FUNDAMENTALS

Environmental concerns of global warming have only recently targeted carbon dioxide ($CO_2$) as a flue gas component that needs to be controlled. Consequently, control technologies for carbon dioxide are currently in various stages of development. Wet scrubbing and flue gas conversion to collectible particulates are being evaluated for low-level control methods. High-efficiency technologies include physical adsorption on activated media, chemical solvent stripping, cryogenic fractionation, membrane separation, and direct recovery from flue gas recirculation with $O_2/CO_2$ combustion. Unfortunately, the disposal of products from high-efficiency, non-regenerative control processes becomes prohibitive due to the high levels of $CO_2$ in the flue gas. Consequently, most of the technologies are regenerative producing a highly concentrated $CO_2$ waste stream. Different sequestering methods are being evaluated including deep ocean injection, oil well injection, and biological fixation.

Wet Scrubbing

Various types of reagents are being tried in conventional wet scrubbing systems. Limited information and data have been published to date.

Conversion to a Dry, Collectible Particulate

Another approach being pursued is the, conversion of $CO_2$ to a dry particulate upstream of a particulate control device. The alkaline reagents that convert sulfur oxides to dry particulates are not as effective for carbon dioxide. Carbon dioxide does compete with sulfur oxides for reactions with some SOx dry scrubber reagents to a limited extent, and minor reductions are achieved. However, carbon dioxide is more stable and is expected to require a much stronger reagent, such as ammonia, sodium hydroxide, and calcium hydroxide. At this point, concurrent conversion of both sulfur oxides and carbon dioxide to particulate does not appear likely due to a lack of reagent preference or selectivity for carbon dioxide. Different temperature windows, residence times, and reagents may be necessary. Consequently, conversion of carbon dioxide to dry particulates may require independent systems with different reagents, unless the fuel generates low levels of sulfur oxides.

Adsorption on Activated Media

The physical adsorption of $CO_2$ on activated carbon or zeolite systems is a surface phenomena in which a few layers of the adsorbed gas are held by weak surface forces. The capacity of an adsorbent for a given gas depends on the operating temperature and pressure. The key issue for commercial application of these systems is the surface area required per unit of mass or volume of adsorbed gas. However, these systems are simple; their operation and regeneration (pressure swing or temperature swing) can be energy-efficient.

AIR TOXICS CONTROL FUNDAMENTALS

Prior to the Clean Air Act Amendments (CAAA) of 1990, EPA air toxics standards had been promulgated for only seven hazardous air pollutants. In the CAAA's Title III, EPA was required to promulgate control standards for over 189 air toxic substances. Consequently, control technologies for air toxics are currently in various stages of development. Adsorption on activated carbon, wet scrubbing, and flue gas conversion to collectible particulates are three primary classes of technologies being considered.

SOLID WASTE CONTROL FUNDAMENTALS

Solid wastes from fossil fuel combustion systems was originally excluded from Subtitle C of the Resource Conservation & Recovery Act (RCRA) of 1976, and still requires clarification by U.S. federal regulations. In the meantime, high volume waste streams from power plants, such as scrubber sludge, flyash, and bottom ash are subject to different and highly variable disposal requirements from state and local environmental and health authorities. In addition, many landfills are required to use leachate collection systems with single or double linings and extensive monitoring wells. In some cases, stabilization of the solids is required.

FGD Wet Scrubber Sludge

In order to dispose of waste materials from wet collection systems, treatment methods are applied to ultimately produce a solid. Dewatering, stabilization, and fixation are common treatment methods that are designed to achieve waste volume reduction, stability, better handling, and/or liquid recovery for reuse. Dewatering techniques physically separates water from solids to increase solids content, and include settling ponds, thickeners, hydroclones, and vacuum filters. Stabilization further increases solids content of the waste by adding dry solids, such as flyash. Fixation involves the addition of an agent, such as lime, to produce a chemical reaction to bind free water and produce a dry product.

Dry Solid Wastes

Ultimate disposition of utility plant wastes (bottom ash, flyash, FGD residues, etc.) is by utilization or by disposal in landfills/impoundments. Utilization is environmentally preferred and becomes more attractive as waste management costs increase. In some cases, bottom ash and boiler slag can be substituted for sand, gravel, blasting grit, roofing granules, and controlled fills. Flyash can also be utilized in the manufacture of Portland cement and concrete mixes, if it meets certain minimum quality specifications. In all utilization alternatives, the cost of transportation can be prohibitive. Disposal methods can be either wet or dry, depending on the physical condition of the waste materials. The trend is toward dry disposal because of smaller volumes, more options for site and material reclamation, and the developing interest in dry scrubbing. Dry disposal can use a simple method of landfill construction in which the waste is placed and compacted to form an artificial hill.

E. Environmental Control of the Present Invention

The present invention does not claim the prior art environmental control technologies separately, but provides improvements and novel combinations of these technologies in applications of the present invention. The different combinations of these technologies are somewhat involved and provide synergism and/or unappreciated advantages that are not suggested by the prior art.

In most cases, fuel switching to the premium "fuel-grade" petroleum coke of this invention provides the opportunity for substantial improvements in the control of particulates, sulfur oxides (SOx), nitrogen oxides (NOx), carbon dioxide ($CO_2$), air toxics, and opacity. In Table 2, uncontrolled pollutant emissions of upgraded petroleum cokes are compared to the emissions of various types of coal. The total quantity of undesirable flue gas components (e.g. SOx) is typically lower than coals', even with higher component concentration in the fuel (wt. % in pet coke vs. coal). That is, sulfur, nitrogen, and carbon contents of the upgraded coke are normally comparable or higher. Most of these potential reductions in uncontrolled pollutants are related to the significantly lower fuel rates and ash content of the upgraded petroleum coke. In particular, the dramatic reduction in ash particulates (>90%) creates tremendous excess capacity in the existing particulate control device. This excess capacity can be effectively used to collect other pollutants that have been converted to collectible particulates upstream of the PCD. Finally, none of these environmental improvements would be possible without the fuel properties of the new formulation of petroleum coke that allows utility boilers to burn up to 100% of this premium fuel.

CONVERSION OF EXISTING PARTICULATE CONTROL DEVICES

The predominant environmental control feature in the present invention is the potential use of existing particulate control equipment for the control of sulfur oxides (SOx) and other undesirable flue gas components. Since petroleum coke typically has >90% less ash than most coals (i.e. 0.1–0.3% vs. 5–20%), a tremendous amount (90–95+%) of particulate control capacity in existing particulate control devices is made available by fuel switching (i.e. from coal to the upgraded petroleum coke). As such, existing particulate control devices (baghouses, ESPs, etc.) can be used for extensive removal of undesirable flue gas components by converting them to collectible particulates upstream of these devices.

The present invention can further increase the capacity of the existing particulate control device by substantially reducing fuel rates. That is, the upgraded petroleum coke has 10–200+% greater heating value than most coals, which translates into 10–50+% reduction in fuel rates to achieve the same heat release rate. The lower fuel rates and the associated reductions in air flow rates often provide significant reductions in flue gas flow rates. In an existing combustion system, any significant reduction in flue gas flow rate increases flue gas residence time, PCD capacity, and PCD control efficiency. These performance parameters are strongly related to the flue gas flow rate and velocities through the PCD collection media. For example, the ratio of ESP plate area to volumetric flue gas flow rate is a critical parameter in the Deutsch-Anderson Equation, which determines ESP capacity and control efficiency. Similarly, the air-to-cloth ratio (where air=flue gas flow in combustion sources) is a critical parameter in equations that determine fabric filter capacity and control efficiency. In this manner, the control efficiency in the existing PCD is increased, providing a greater capacity to control higher inlet loadings to the same particulate requirements for PCD outlet.

Each combustion system will have a different set of design conditions for converting the existing particulate control devices. The conversion of each system will depend on various design and operational parameters, but the optimal design and level of control can be established with typical engineering skills associated with the prior art of PCD technologies. Minor modifications may be necessary to maintain particulate collection efficiencies. The particulates coming into the existing PCDs may have substantially different properties than the particulates of the PCD's design basis. Consequently, modest modifications in design and/or operating conditions may be required. For example, flue gas conditioning or operational changes in existing ESPs may be appropriate to achieve more desirable resistivity characteristics, and maintain collection efficiencies.

FLUE GAS CONVERSION TECHNOLOGIES

The present invention includes the integration of various "flue gas conversion technologies" to control undesirable flue gas components, and effectively use the excess particulate control capacity created by the present invention. For the sake of this discussion, "flue gas conversion technologies" refers to all technologies that convert gaseous or liquid compounds in the flue gas into chemical compounds (e.g. dry or wet particulates) that can be effectively collected by particulate control technologies (existing, new, or otherwise). Most of these technologies inject a chemical reagent (wet or dry) that reacts with the targeted flue gas component(s) and chemically converts them to compound(s) that are particulates at the PCD operating conditions. Consequently, this classification of environmental controls would include commercially available SOx controls: wet scrubbing, spray dry adsorption, and dry sorbent injection. The present invention provides novel use and improvements in these and other flue gas conversion technologies because of its unique ability to (1) improve the reagent activity and utilization efficiency, (2) provide the opportunity for reagent regeneration (and associated improvements), (3) increase the probability of salable by-products, and (4) promote the development of improved and new flue gas conversion technologies (FGCT).

Reagent Activity & Utilization Efficiency

The present invention provides less ash interference and better recycle options to increase the reagent activity and utilization efficiency in FGC processes. In many situations, the flyash from the combustion process interferes with the reactions of reagent and targeted flue gas component. The upgraded petroleum coke of the present invention has very low ash content, which substantially reduces interference and increases reagent activity. This much lower flyash also allows extensive recycling of conversion products, including unreacted reagents. For example, the prior art in SOx dry scrubber technology processes and recycles collected flyash into the reagent injection to increase reagent usage. However, high ash particulates of existing fuels limit the degree of recycling. The upgraded petroleum coke of the present invention has such low ash particulates that greater quantities of collected flyash (mostly FGCT products and unreacted reagents) can be effectively recycled. The degree of recycle can be limited by the capacity of the PCD, but recycle rates of 5–30+% are possible. The optimal recycle rate can be developed for each application. Both the reduced ash interference and the improved recycle capabilities are expected to significantly increase reagent utilization efficiencies and improve FGCT overall control efficiencies and costs.

Opportunity for Reagent Regeneration

The present invention provides the opportunity for regeneration of FGCT reagents, due to very low ash and other impurities in the collected flyash. That is, the collected flyash consists mostly of FGCT products (or spent reagent) and unreacted reagent. The collected flyash can be processed, and the spent reagent can be regenerated to substantially reduce the make-up FGC reagent rate and waste disposal required. The regeneration process can include, but should not be limited to, hydration of the collected flyash and subsequent precipitation of the undesired ions (i.e. sulfates, carbonates, etc.) for commercial use or disposal. Furthermore, the regeneration process would likely include a purge stream of <30% (in some cases <5%) to remove unacceptable levels of impurities from the system. This purge stream would be analogous to blow down streams in many boiler water and cooling water systems. In many cases, this purge stream will contain a high concentration of heavy metals, including vanadium. Various physical and/or chemical techniques can be used to extract and purify these metals for commercial use. In cases where slaked lime is used as the conversion reagent, the regeneration process can also greatly reduce the carbon dioxide generated in the reagent preparation process: limestone (calcium carbonate—$CaCO_4$) to lime (calcium oxide—CaO)+carbon dioxide ($CO_2$). Finally, the ability to continually regenerate reagents provides the opportunity for new or improved flue gas conversion processes through the use of exotic reagents; not considered previously due to costs. In this manner, the regeneration of conversion reagents can (1) substantially reduce reagent make-up and preparation costs (2) dramatically reduce flyash disposal costs, (3) create a resource for valuable metals, (4) reduce $CO_2$ emissions, and (5) provide the means to economically improve the flue gas conversion process via the use of more exotic reagents.

Salable By-Products

Whether or not the FGCT reagent is regenerated, the present invention increases the probability of producing salable by-products. The extremely low ash particulate levels create a collected flyash that is mostly FGCT reaction products with low impurities. As such, collected flyash from certain FGCTs can be used as raw materials for various products, instead of solid wastes requiring disposal. These products include, but are not limited to, gypsum wallboard and sulfuric acid.

Development of Improved and New Conversion Technologies

The present invention can promote novel improvements and development of many flue gas conversion technologies. Regeneration with existing reagents can be developed for improvements of the current sulfur oxides conversion technologies. Furthermore, all these unique abilities of the present invention (i.e. efficient reagent utilization, reagent regeneration, and salable by-products) contribute to the development of new flue gas conversion technologies for an undesirable flue gas components, including sulfur oxides, carbon dioxide, nitrogen oxides, and air toxics. The unique ability to regenerate conversion reagents, in particular, opens the door to more exotic reagents that are more reactive, selective, and/or costly to prepare. In the past, reagent selection has been limited to very inexpensive materials due to disposable nature (i.e. use once & throw away). With dramatically lower impurities in the system, regeneration using novel conversion reagents can be economically considered. That is, other alkaline metal compounds with more desirable reaction characteristics or by-products can be used without major economic consequences. For example, ammonia and very reactive hydroxide forms of magnesium, sodium, and/or calcium can be economically used as reagents in FGCTs to control carbon dioxide, nitrogen oxides, and/or air toxics. In addition, transportation costs for make-up reagent and waste disposal can be dramatically reduced and help offset other additional costs (e.g. regeneration system costs).

The integration of these flue gas conversion technologies is anticipated by the present invention. That is, part of the benefits of the present invention is to create excess particulate control capacity in existing combustion systems that can be used in conjunction with these technologies to achieve their objectives. In this manner, The present invention provides a novel combination of particulate control and flue gas conversion technologies, particularly in retrofit applications on existing combustion systems. These novel combined applications of existing environmental technology provide substantial incentives to replace existing solid fuels with the upgraded petroleum coke. However, each combination of particulate control and flue gas conversion technologies at existing combustion systems is a unique application. One skilled in the art of these technologies is capable of providing the appropriate design and operating modifications required to achieve the successful implementation of the desirable application of these combined air pollution control technologies.

F. Environmental Impacts of the Preferred Embodiment

In the preferred embodiment of the present invention, an existing utility boiler with a particulate control device is modified by fuel switching: existing coal to premium "fuel-grade" petroleum coke. The upgraded petroleum coke of the present invention can be fired as the primary fuel (up to 100%). Consequently, the very low ash particulate level generated from such a fuel switch unleashes >90% of the existing PCD's capacity to be used for flue gas conversion technologies (FGCT).

In this embodiment, two options are provided for the novel integration of existing FGCT for the control of sulfur oxides. Sulfur oxides control was chosen in this embodiment due to recent emphasis related to acid rain legislation. However, FGCT for other undesirable flue gas components can be implemented in a similar manner. Option 1 consists of the addition of retrofit reaction chamber(s) and reagent injection system(s) to convert sulfur oxides to dry particulates upstream of the existing particulate control device(s). Alternatively, Option 2 consists of the addition of dry sorbent injection systems into and/or downstream of the furnace section to convert sulfur oxides (or carbon dioxide) to dry particulates upstream of the existing particulate control device(s). An optimized combination of Options 1 and 2 can provide the preferred SOx control system in many cases (See Optimal Environmental Control Embodiment).

As noted previously, all of these applications of flue gas conversion technology (including SOx controls) are novel and unlike any other commercial, retrofit applications. First, most flue gas conversion applications have substantially higher ash particulates in the flue gas. The ash particulates can interfere with the reactivity of the injected reagents, potentially decreasing SOx removal efficiencies. Secondly, previous utility retrofit applications have used existing PCDs that are still operating at >80% of capacity for ash collection and sacrifice particulate emission levels. In contrast, the existing PCDs in this application are operating at <10% of capacity for ash collection. This design basis provides the opportunity to achieve much higher SOx removal, while increasing (or maintaining) collection efficiency in the PCD. Consequently, particulate emissions from the stack are significantly less (or comparable). Finally, the very low ash particulates cause the particulates collected by the PCD to be predominantly spent reagent and unreacted reagent. The very low ash and chloride content in the collected particulates provides a greater ability to regenerate spent reagent (e.g. via hydration) and/or recycle unreacted reagent from the collected particulates. Consequently, substantially lower quantities of solids disposal (e.g. purge stream) and fresh reagents for make-up requirements are expected. Alternatively, the collected ash can have sufficient purity to be used in the production of sulfuric acid, gypsum wallboard, or other sulfate-based products. This alternative system design can also substantially reduce the solids disposal quantities. In conclusion, the combination of these factors makes this application unique, and produces greater operating efficiencies and more favorable economics.

The ultimate level of additional control for SOx and particulates will depend on (1) the efficiency of conversion of the sulfur oxides to particulates and (2) the efficiency of particulate collection. In most utility boilers, reductions of over 70% in both sulfur oxides and ash particulate emissions are expected.

PARTICULATE IMPACT

The upgraded petroleum coke of the present invention normally has over 90% less ash particulate emissions than most coals for the same firing rate (See Table 2). This dramatic reduction in ash particulates is primarily due to a much lower ash content (0.1–1.0 wt. %). However, lower fuel rates (due to significantly higher heating values) can also contribute greatly to this reduction. The dramatic reduction in ash particulates unleashes >90% of the capacity in the existing particulate control device. This excess capacity can be used to collect other pollutants that have been converted to collectible particulates upstream of the PCD. In this manner, the fuel properties of the new formulation of petroleum coke provide the opportunity to burn 100% petroleum coke and use existing particulate control devices to reduce the emissions of other pollutants, such as sulfur oxides, nitrogen oxides, carbon dioxide, air toxics, etc.

In the preferred embodiment, the overall particulate emissions from the stack will depend on the ability to maintain high collection efficiencies in the PCD. As noted above, the type and quantity of particulates will be different due to fuel switching and flue gas conversion technologies. For example, the converted salts from the SOx dry scrubbing are normally larger and easier to collect than ash particulates. Even though the ash particulates are decreased dramatically, some breakthrough of converted salts from flue gas conversion is expected. The quantity of breakthrough will depend on the degree of flue gas conversion, unreacted reagents, and the new collection efficiency. Besides the increase in collection efficiency due to lower flue gas flow rates, the products from SOx FGCT typically have characteristics that increase particulate collection efficiency. For example, the resistivity and drift velocity of calcium sulfate favor increased ESP collection efficiencies. Though the application of FGCTs and utilization of PCDs will vary substantially, the reduction in overall particulate emissions from the stack is still expected to be over 10%, in most cases. A significant reduction in PM-10 particulate (i.e. <10 microns) emissions is also expected.

SULFUR OXIDES IMPACT

The predominant feature in this preferred embodiment is the potential use of existing particulate control equipment for the control of sulfur oxides (SOx). Since petroleum coke typically has >90% less ash than most coals (0.1–0.3% vs. –20%), a tremendous amount (90–95+%) of particulate control capacity in existing particulate control devices is made available by fuel switching ( from coal to the upgraded petroleum coke). As such, the existing particulate control devices (baghouses, electrostatic precipitators, etc.) can be used for extensive SOx removal by converting the sulfur oxides to dry particulates upstream of these devices.

In Option 1 of the preferred embodiment of this invention, retrofit reaction chamber(s) and reagent injection system(s) are added to convert sulfur oxides to dry particulates upstream of the existing particulate control device(s). As noted previously, 85–95% SOx removal has been demonstrated by past utility retrofits of SOx dry scrubber systems with substantially higher ash particulates in the flue gas. For reasons noted above, the SOx dry scrubber retrofit in the preferred embodiment is expected to perform much better. Consequently, 90% SOx removal efficiency is expected to be a very conservative estimate for the potential reduction of SOx emissions from the upgraded petroleum coke and Option 1 SOx control of the preferred embodiment.

In Option 2 of the Preferred embodiment, dry sorbent injection systems are added to convert sulfur oxides to dry particulates upstream of the existing particulate control device(s). As noted previously, 40–70% SOx removal has been demonstrated by past utility retrofits of SOx dry sorbent injection systems with substantially higher ash particulates in the flue gas. For reasons noted above, the dry sorbent injection retrofit in the preferred embodiment (Option 2) is expected to perform much better. Consequently, 70% SOx removal efficiency is expected to be a very conservative estimate for the potential reduction of SOx emissions from the upgraded petroleum coke and Option 2 SOx control of the preferred embodiment.

In the past, the presence of vanadium has caused concern of elevated dew points in the flue gas, due to its tendency to catalyze the conversion of sulfur dioxide to sulfur trioxide. In many situations, these elevated dew points can lead to increased cold-end corrosion. However, the elevated dew points can have positive impacts in the application of SOx flue gas conversion processes. That is, the elevated dew points can provide more favorable approach temperatures; improving collection efficiencies while reducing water injection requirements. This is particularly helpful in applications where the operating temperature of the existing PCD is above the flue gas dew point; reducing the need for flue gas reheat. In addition, tests have shown that SOx dry scrubbing techniques perform better on sulfur trioxide (vs. sulfur dioxide). Thus, the dry sorbent injection (Option 2), to some extent, can be particularly beneficial to convert sulfur trioxide to particulates in the convection section. In this manner, the presence of vanadium can be advantageous upstream of low-temperature heat exchange equipment. At the same time, the catalytic conversion of $SO_2$ to $SO_3$ is also expected to inhibit the formation of the highest oxidation level of vanadium; vanadium pentoxide ($V_2O_5$). This reduction of vanadium pentoxide further reduces associated ash problems. Finally, in facilities with electrostatic precipitators, the sulfur trioxide can also condition the flue gas and alter the resistivity characteristics to improve the ESP's collection efficiency. Consequently, certain levels of vanadium can improve the SOx control systems.

The overall reduction of sulfur oxides due to fuel switching and the retrofit flue gas conversion system is site specific and depends on several factors. First, the lower fuel rates of the upgraded petroleum coke can be sufficient to reduce SOx emission rates (Mlb/Hr. or Mlb/MMBtu). This can occur even in cases where the sulfur content (wt. %) of the upgraded petroleum coke exceeds the sulfur content of the coal being replaced. Secondly, the sulfur content of the upgraded petroleum coke can be lower than the sulfur content of the replaced fuel. For example, low-sulfur petroleum coke or desulfurized petroleum coke from hydrotreated coker feedstocks can have significantly less sulfur (wt. %). In these cases, the lower sulfur content, combined with lower fuel rates, contributes to even greater reductions in sulfur oxides. Finally, the retrofit of SOx dry scrubbing technology, in this preferred embodiment, is expected to reduce the inlet SOx emission rates by 90% or more. If the alternative dry sorbent injection systems are used, the inlet SOx emission rates are expected to be reduced by up to 70%. In some cases, the lower fuel rate and the sulfur content of the upgraded petroleum coke are not sufficient to reduce the SOx emission rate of the replaced fuel. However, the combination of the lower fuel rate and the retrofit dry scrubbing can still produce substantially lower SOx emissions (relative to various coals), even when the coke sulfur content is much higher.

NITROGEN OXIDES IMPACT

The upgraded petroleum coke of the present invention usually has significantly less fuel-bound nitrogen due to the combination of lower fuel rates and comparable nitrogen content, typically 0.5–1.5%. Thus, the fuel NOx is expected to be significantly less or at least similar. Also, the flame intensity (and temperature profile) of the upgraded coke is expected to be more uniform due to lower VCM content and levelized burning profile. This uniform temperature profile is expected to produce lower Thermal NOx than most coals. The more uniform fuel characteristics of the upgraded petroleum coke is also expected to reduce excess air requirements, which lowers oxygen availability and typically lowers both fuel NOx and thermal NOx. These and other combustion characteristics are also conducive for the development of lower generation of nitrogen oxides (NOx) emissions through Low NOx burner designs and other combustion modifications. Consequently, the upgraded petroleum coke of the present invention is expected to significantly decrease the nitrogen oxide emissions of most coals, via fuel switching and appropriate adjustments in Low NOx burner design and operation.

The application of SNCR, SCR, and/or FGCT for NOx is not anticipated in this preferred embodiment. However, if regulations require additional NOx control, these technologies can be integrated into the control alternatives of the preferred embodiment. The major concerns in the integration process are the control priorities among pollutants and the potential conflicts with other control technologies. That is, competitive or other undesirable reactions (e.g. formation of ammonium bisulfate) can be counterproductive in the combination of control technologies.

CARBON DIOXIDE IMPACT

Significant reductions in carbon dioxide emissions can be achieved by methods similar to those for sulfur oxides emissions. First, the carbon content of the upgraded petroleum coke can be lower than the carbon content of the replaced fuel, but not normally. Secondly, the lower fuel rates in most applications can cause lower carbon dioxide emission rates. This can occur even in cases where the carbon content (wt. %) exceeds the carbon content of the coal being replaced. As shown in Table 2, this occurs in almost every case. Finally, a retrofit, flue gas conversion system can be used for modest to moderate carbon dioxide control, as well. The combination of these factors will determine the overall reduction in carbon dioxide resulting from fuel switching and the retrofit, flue gas conversion system of the preferred embodiment. The potential for reduction from the retrofit $CO_2$ flue gas conversion is the most uncertain at this time.

The preferred embodiment can effectively be used for flue gas conversion of carbon dioxide, if and when the appropriate temperature, residence time, and reagents become better understood and available. As noted previously, flue gas conversion of carbon dioxide is more likely without concurrent scrubbing of sulfur oxides. Low-sulfur, petroleum coke, such as desulfurized coke, can effectively improve the opportunity for carbon dioxide conversion and collection. Table 2 shows the desirable fuel properties of desulfurized coke relative to various types of coals. Alternatively, Option 2 dry sorbent injection system(s) can be used for sulfur oxides control and the Option 1 retrofit reaction chamber(s) and reagent injection system(s) can be used for the control of carbon dioxide. In this case, the excess capacity of the existing particulate control device can be the limiting factor. Additional PCD capacity can be added as part of the retrofit project to increase the carbon dioxide removal via flue gas conversion processes.

AIR TOXICS IMPACT

The regulations regarding the levels of control required for specific air toxics are still fairly unclear for utility boilers. In general, though, the upgraded petroleum coke of the present invention is expected to create less air toxic compounds, due to its much lower ash content. This assumes that the combustion process can achieve a high level of combustion efficiency and destroy any hydrocarbon, classified as an air toxic compound. Flue gas conversion technologies for air toxic compounds can also be integrated, as necessary. Similar to other FGCTs, the major concerns of integrating these processes are the control priorities among pollutants and the potential conflicts with other control technologies.

OPACITY IMPACT

Opacity is an indication of the level of transparency in the flue gases exiting the smokestack or the plume after moisture dissipation. The level of opacity is primarily dependent on (1) particulate concentration, (2) particle size distribution, (3) sulfur trioxide concentration, and (4) moisture level. The use of upgraded coke in this embodiment with either Option 1 or 2 for SOx control is expected to significantly reduce the opacity level in most utility boilers, due to the reductions in particulate and sulfur trioxide concentrations in the flue gases, described above. The reduced moisture and hydrogen content of the upgraded petroleum coke (vs. most coals) can also contribute to lower opacity and steam plumes. Finally, significant reductions in particulates less than 10 microns can substantially improve the opacity

SOLID WASTE IMPACT

As discussed previously, the upgraded petroleum coke of the present invention can dramatically reduce the quantity and quality of the solid wastes for disposal. The upgraded petroleum coke has such low ash particulates that greater quantities of collected flyash can be effectively recycled to increase reagent utilization efficiencies. The improved reagent utilization often creates greater proportions of the flyash as more stable compounds. For example, the fully oxidized, spent reagent in SOX FGCT (calcium sulfate) is preferred for waste disposal (versus unreacted reagent or less oxidized forms). Furthermore, the extremely low ash particulate levels (i.e. low impurities) provide greater opportunity to use the collected flyash as raw materials for various products, instead of solid wastes, requiring disposal. These products include, but are not limited to, gypsum wallboard and sulfuric acid. In addition, the spent reagent can be regenerated to dramatically reduce the wastes requiring disposal. In this manner, flyash disposal and associated costs are significantly reduced.

GENERAL ISSUES

Finally, none of these environmental improvements would be possible without the fuel properties of the new formulation of petroleum coke that allows the utility boilers to burn up to 100% of this premium fuel. That is, the fuel properties of the upgraded petroleum coke provide self-sustained combustion. Without it, these environmental improvements would not be possible. The following case study provides just one example of the benefits that can be achieved with the preferred embodiment of this invention.

G. EXAMPLE 1

Utility Boiler with Conventional Particulate Control Device (PCD)

A power utility has a conventional, pulverized-coal fired, utility boiler that currently burns medium-sulfur, bituminous coal from central Ohio. The existing utility currently has a typical particulate control device with no sulfur oxide emissions control. Full replacement of this coal with a high-sulfur petroleum coke produced by the present invention would have the following results:

Basis = $1.0 \times 10^9$ Btu/Hr Heat Release Rate as Input

| | Current Coal | Upgraded coke | Results |
|---|---|---|---|
| Fuel Characteristics | | | |
| VCM (% wt) | 40.0 | 16.0 | 60% Lower |
| Ash (% wt.) | 9.1 | 0.3 | 97% Lower |
| Moisture (% wt.) | 3.6 | 0.3 | 92% Lower |
| Sulfur (% wt) | 4.0 | 4.3 | 8% Higher |

-continued

| Basis = 1.0 × $10^9$ Btu/Hr Heat Release Rate as Input | | | |
|---|---|---|---|
| | Current Coal | Upgraded coke | Results |
| Heating Value (MBtu/lb) | 12.9 | 15.3 | 19% Higher |
| Fuel Rate (Mlb/Hr) | 77.8 | 65.4 | 16% Lower |
| Pollutant Emissions: Uncontrolled/Controlled | | | |
| Ash Particulates (lb/MMBtu or Mlb/Hr) | 7.1/0.4 | .2/.01 | 97% Lower |
| Sulfur Oxides (lb/MMBtu or Mlb/Hr) | 6.2/6.2 | 5.6/.6 | 90% Lower |
| Carbon Dioxide (lb/MMBtu or Mlb/Hr) | 238 | 210 | 12% Lower |

This example demonstrates major benefits from the application of the present invention. The upgraded petroleum coke has substantially lower ash and moisture contents, compared to the existing coal. These factors contribute greatly to (1) the ability to burn successfully with lower VCM and (2) a fuel heating value that is 19% higher. In turn, the higher heating value requires a 16% lower fuel rate to achieve the heat release rate basis of one billion Btu per hour in the boiler. As noted previously, this lower fuel rate and the softer sponge coke significantly reduce the load and wear on the fuel processing system, while increasing the pulverizer efficiency and improving combustion characteristics.

The ash particulate emissions (ash from the fuel) are 97% lower than the existing coal, due to the lower ash content and higher fuel heating value. In this manner, fuel switching to the upgraded coke unleashes 97% of the capacity in the existing particulate control device. This excess capacity can now be used for the control of sulfur oxides via retrofit flue gas conversion technology.

A SOx dry scrubber injection/reaction vessel (option 1) is added upstream of the existing particulate control device, along with any associated reagent preparation and control systems. This conversion of the existing particulate control device is assumed to achieve 90% reduction in sulfur oxides in this case. Consequently, the uncontrolled sulfur oxide emissions are reduced from 5.6 to 0.56 thousand pounds per hour. In this manner, the utility of switching fuels and converting the existing particulate control device to dry scrubbing represents 90% reduction in the coal's sulfur oxides emissions (i.e. <0.6 vs. 6.2 lb/MMBtu). This unexpected result is achieved even though the sulfur content (4.3%) of the upgraded petroleum coke is 8% higher than the sulfur level (4.0%) of the Ohio bituminous coal.

Alternatively, the dry sorbent injection systems (option 2) could be used for sulfur oxides control. In this case, the inlet SOx would be reduced by 70% (i.e. 5.6 to 1.7 Lb/MMBtu.). This outlet SOx represents a 73% reduction in sulfur oxides emissions from the bituminous coal. If this level of sulfur emissions is sufficient to meet environmental regulations, the retrofit addition of reaction chamber(s) and reagent injection system(s) is not necessary. In this case, the use of retrofit flue gas conversion technology for additional reductions of carbon dioxide is possible, but not likely, due to lack of sufficient capacity in the existing particulate control device. That is, the original ash particulate capacity less the required capacity for converted SOx (large ionic salts) may not leave sufficient capacity to make CO2 control cost effective.

This example also illustrates significant reductions in pollutant emissions, based solely on fuel switching. The 16% lower fuel rate of the upgraded petroleum coke greatly contributes to lower environmental emissions of ash particulates, sulfur oxides, and carbon dioxide. The 97% reduction in ash particulates, noted above, was primarily due to lower fuel ash concentration. However, uncontrolled emissions of sulfur oxides and carbon dioxide are significantly reduced primarily due to the 16% lower fuel rate. That is, the sulfur content of the upgraded petroleum coke is 8% higher than the existing coal. Yet the upgraded petroleum coke has 10% lower uncontrolled SOx. Similarly, the upgraded petroleum coke has 5% higher carbon content (i.e. 87.5% vs. 83.3%). Yet the uncontrolled emissions of carbon dioxide is reduced by 12% due to fuel switching.

OTHER EMBODIMENTS & RAMIFICATIONS

Other embodiments of the present invention present alternative means to achieve the major objectives of the present invention. Examples 2–5 are provided at the end of this discussion to illustrate some of these embodiments of the present invention.

1. Production of Premium "Fuel-Grade" Petroleum Coke: Modified Fluid Coking® Process Various operational changes in the Fluid Coking® process can produce a premium fuel-grade coke, in a manner similar to the delayed coking discussion, above. Traditional Fluid Coking® normally produces a fuel-grade petroleum coke with higher metals and sulfur content than delayed coke from the same feedstocks. Fluid coke, like shot coke, is spherical in shape (170 to 220 um), which makes it more difficult to grind. Its onion-like, laminated layers of coke cause a much higher density and hardness (HGI 30–40). As such, Fluid coke is even less desirable as a fuel, when compared to fuel-grade petroleum coke from the traditional delayed coking process. Substantially less volatile combustible material (4–8% VCM), much greater hardness, and much lower porosity are three primary reasons. However, U.S. Pat. No. 4,358,290 discusses the need to improve the combustion characteristics of fluid coke. It discloses technology to increase the level of volatile combustible material external to the coking process by blending the fluid coke with heavy petroleum liquid. For reasons discussed previously, leaving more VCM in the coke during the coking process can be more desirable.

A. Traditional Fluid Coking®, Process Description

Figure 4:
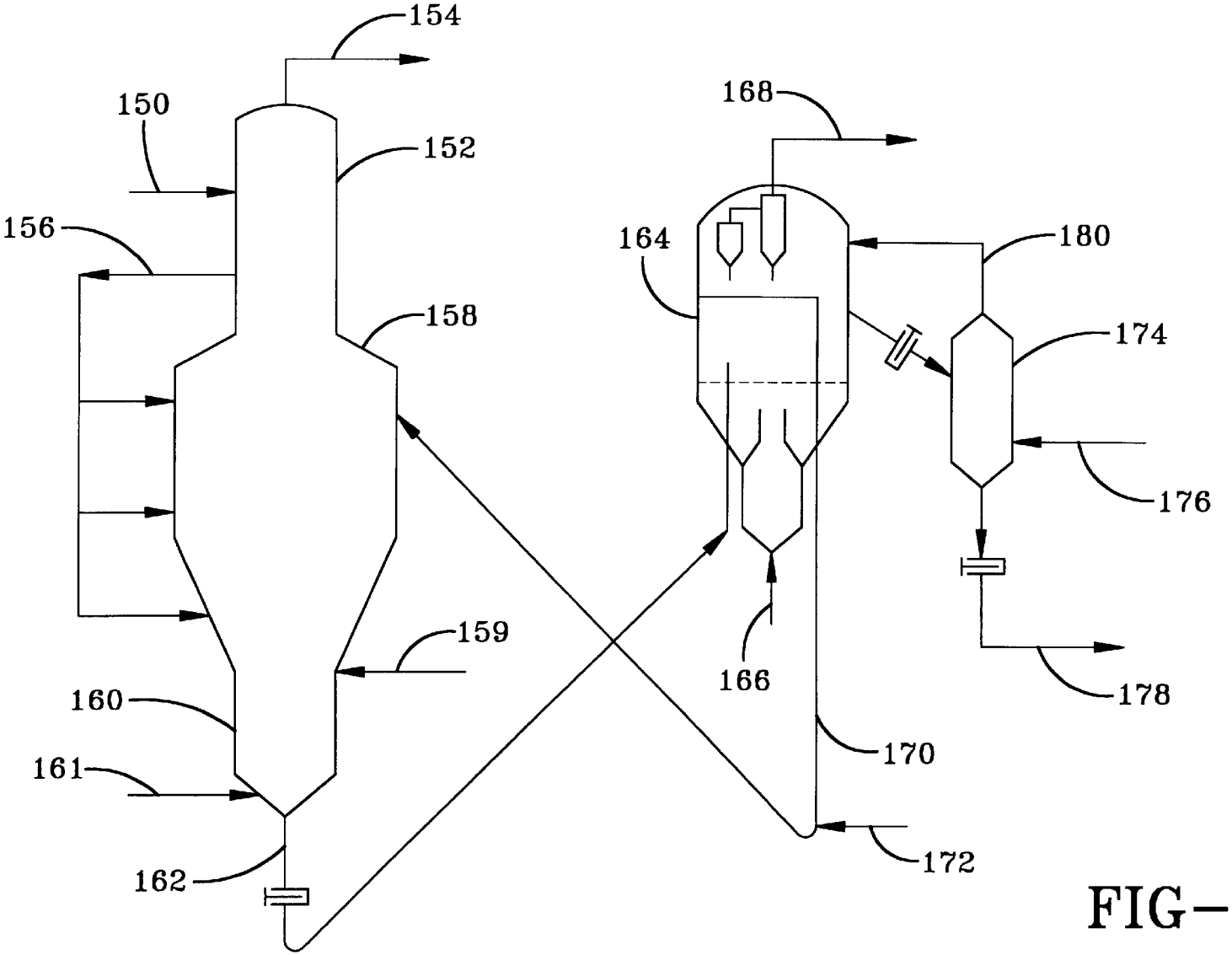
FIG. 4 shows a basic process flow diagram for key elements of a traditional Fluid Coking® process.

FIG. 4 provides a basic process flow diagram for a typical Fluid Coking® process. The Fluid Coking® process equipment is essentially the same, but the operation, as discussed below, is substantially different. Fluid Coking® is a continuous coking process that uses fluidized solids to further increase the conversion of coking feedstocks to cracked liquids, and reduce the volatile content of the product coke. Fluid Coking® uses two major vessels, a reactor 158 and a burner 164.

In the reactor vessel 158, the coking feedstock blend 150 is typically introduced into the scrubber section 152, where it exchanges heat with the reactor overhead effluent vapors. Hydrocarbons that boil above 975° F. are condensed and recycled to the reactor with the coking feedstock blend. Lighter overhead compounds 154 are sent to conventional fractionation and light ends recovery (similar to the fractionation section of the delayed coker). The feed and recycle mixture 156 is sprayed into the reactor 158 onto a fluidized bed of hot, fine coke particles. The mixture vaporizes and cracks, forming a coke film (~5 um) on the particle surfaces. Since the heat for the endothermic cracking reactions is supplied locally by these hot particles, this permits the cracking and coking reactions to be conducted at higher temperatures of about 510° C.–565° C. or (950° F.–1050° F.) and shorter contact times (15–30 seconds) versus delayed coking. As the coke film thickens, the particles gain weight and sink to the bottom of the fluidized bed. High-pressure steam 159 is injected via attriters and break up the larger coke particles to maintain an average coke particle size (100–600 um), suitable for fluidization. The heavier coke continues through the stripping section 160, where it is stripped by additional fluidizing media 161 (typically steam). The stripped coke (or cold coke) 162 is then circulated from the reactor 158 to the burner 164.

In the burner, roughly 15–25% of the coke is burned with air 166 in order to provide the hot coke nuclei to contact the feed in the reactor vessel. This coke burn also satisfies the process heat requirements without the need for an external fuel supply. The burned coke produces a low heating value (20–40 Btu/scf) flue gas 168, which is normally burned in a CO Boiler or furnace. Part of the unburned coke (or hot coke) 170 is recirculated back to the reactor to begin the process all over again. A carrier media 172, such as steam, is injected to transport the hot coke to the reactor vessel. In some systems, seed particles (e.g. ground product coke) must be added to these hot coke particles to maintain a particle size distribution that is suitable for fluidization. The remaining product coke 178 must be removed from the system to keep the solids inventory constant. It contains most of the feedstock metals, and part of the sulfur and nitrogen. Coke is withdrawn from the burner and fed into the quench elutriator 174 where product coke (larger coke particles) 178 are removed and cooled with water 176. A mixture 180 of steam, residual combustion gases, and entrained coke fines are recycled back to the burner.

B. Process Control of the Prior Art

In traditional Fluid Coking®, the optimal operating conditions have evolved through the years, based on much experience and a better understanding of the process. Operating conditions have normally been set to maximize (or increase) the efficiency of feedstock conversion to cracked liquid products, including light and heavy coker gas oils. The quality of the byproduct petroleum coke is a relatively minor concern. In "fuel-grade" coke operations, this optimal operation detrimentally affects the fuel characteristics of the coke, particularly VCM content, crystalline structure, and additional contaminants.

As with delayed coking, the target operating conditions in a traditional fluid coker depend on the composition of the coker feedstocks, other refinery operations, and the particular coker's design. The desired coker products also depend greatly on the product specifications required by other process operations in the particular refinery. That is, downstream processing of the coker liquid products typically upgrades them to transportation fuel components. The target operating conditions are normally established by linear programming (LP) models that optimize the particular refinery's operations. These LP models typically use empirical data generated by a series of coker pilot plant studies. In turn, each pilot plant study is designed to simulate the particular coker design, and determine appropriate operating conditions for a particular coker feedstock blend and particular product specifications for the downstream processing requirements. The series of pilot plant studies are typically designed to produce empirical data for operating conditions with variations in feedstock blends and liquid product specification requirements. Consequently, the fluid coker designs and target operating conditions vary significantly among refineries.

In normal fluid coker operations, various operational variables are monitored and controlled to achieve the desired fluid coker operation. The primary operational variables that affect coke product quality in the fluid coker are the reactor temperature, reactor residence time, and reactor pressure. The reactor temperature is controlled by regulating (1) the temperature and quantity of coke recirculated from the burner to the reactor and (2) the feed temperature, to a limited extent. The temperature of the recirculated coke fines is controlled by the burner temperature. In turn, the burner temperature is controlled by the air rate to the burner. The reactor residence time (i.e. for cracking and coking reactions) is essentially the holdup time of fluidized coke particles in the reactor. Thus, the reactor residence time is controlled by regulating the flow and levels of fluidized coke particles in the reactor and burner. The reactor pressure normally floats on the gas compressor suction with commensurate pressure drop of the intermediate components. The burner pressure is set by the unit pressure balance required for proper coke circulation. It is normally controlled at a fixed differential pressure relative to the reactor. The following target control ranges are normally maintained in the fluid coker for these primary operating variables:

1. Reactor temperatures in the range of about 950° F. to about 1050° F.,
2. Reactor residence time in the range of 15–30 seconds,
3. Reactor pressure in the range of about 0 psig to 100 psig: typically 0–5 psig,
4. Burner Temperature: typically 100–200° F. above the reactor temperature, These traditional operating variables have primarily been used to control the quality of the cracked liquids and various yields of products, but not the respective quality of the byproduct petroleum coke.

C. Process Control of the Present Invention

The primary improvements of the present invention are modifications to the operating conditions of the Fluid Coking® process, in a manner that is not suggested by prior art. In fact, these changes in operating conditions are contradictory to the teachings and current trends in the prior art. As noted previously, the operating conditions of the prior art give first priority to maximizing cracked liquid products. The operating conditions of the present invention give first priority to consistently increasing the volatile combustible material in the resulting petroleum coke to 13–50 wt. % VCM (preferably 15–30% VCM). Second priority is given to consistently provide a minimum-acceptable level of coke crystalline structure in the product coke. The third priority is THEN given to maximize coker throughput and/or the conversion of coker feedstock blend to cracked liquid products. However, changing the VCM content and crystalline structure in fluid coke is much more challenging, relative to delayed coke. The operating conditions required to achieve the objectives of the present invention were moderate, yet specific changes relative to the prior art.

As discussed previously, fluid coker operating conditions vary greatly among refineries, due to various coker feedstocks, coker designs, and other refinery operations. Therefore, specific operating conditions (i.e. absolute values) for various refinery applications are not possible for the present invention. However, specific changes relative to existing operating conditions provide specific methods of operational change to achieve the desired objectives.

INCREASED VOLATILE COMBUSTIBLE MATERIAL (VCM) IN FLUID® COKE

In a manner similar to the delayed coking process, reduction in the process operating temperature will cause an increase of volatile combustible material in the resulting petroleum coke. That is, the reduction in process (or reactor) temperature will reduce the cracking and coking reactions, and thereby, leaving more unreacted coker feedstock and cracked liquids in the coke as volatile combustible material. However, the different mechanism of coking in the Fluid Coking® process may require a more significant reduction in temperature to achieve the same level of VCM in the petroleum coke. In the Fluid Coking® process, the temperature of the fluidized coke particles leaving the coke burner would be the primary temperature to reduce. Decreasing this temperature by 10–200° F. (preferably 10–80° F.) can increase the fluid coke VCM to the preferable range of 15–30%. Reduction of feed temperature and the operating temperature of the reactor would also play secondary roles in increasing the VCM on the petroleum coke. However, if the reactor temperature is too low, the fluid coker will bog down and lose fluidization. If the reactor temperature (in a particular fluid coker) approaches this bogging condition prior to achieving the desired VCM increase, other operational parameters can be modified to achieved the desired VCM. The reduction of coke stripping and the addition of oily sludges/substances or hazardous wastes in the final quench of the product coke can provide the additional VCM required.

The reduction of coke stripping at the base of the fluid coker reactor can also increase the product coke VCM. The reduced efficiency of the stripping section will leave more VCM on the cold coke circulated to the burner. In the burner, less coke (i.e. higher VCM coke) would be burned to provide the same heat requirements. Consequently, a greater yield of higher VCM product coke would be produced.

The addition of oily sludges (or other oily substances) or hazardous wastes in the final quench of the product coke can also provide the additional VCM required. Similar to the delayed-coke drum quenching process, the quenching of product (fluid) coke in the quench elutriator can be used to achieve the desirable VCM content. That is, oily sludges or other oily substances, such as used lubricating oils, can be added to the quench water to leave more VCM on the fluid coke product. Various types of hazardous wastes can be used as a raw material (vs. waste) in this modified process, instead of underground injection or less desirable disposal methods. However, environmental regulations may require a delisting process or other means of dealing with the hazardous waste requirements. This method can be effective in evenly distributing quench material throughout the coke, and provide various options regarding the quality of VCM content. This option is discussed further in other embodiments.

ACCEPTABLE FLUID COKE CRYSTALLINE STRUCTURE

Unfortunately, operational changes in the fluid coker will not significantly impact the crystalline structure of the product fluid coke. The fluid coke has onion-like, laminated layers of coke due to the nature of the Fluid Coking® process. As such, the product fluid coke has the consistency of coarse sand (vs. sponge) with a much higher density and much lower porosity. Consequently, the high VCM coke can have limited utility and can be limited to applications where the current crystalline structure is acceptable. Also, this denser crystalline structure may require higher VCM quality and quantity versus sponge coke.

D. Low-Level Decontamination of Coker Feedstocks; 3 Stage Desalting Operation

As in the preferred embodiment, the three-stage desalting operation will provide the simplest and best known approach to provide the low-level decontamination of the product fluid coke required for combustion applications. The low-level decontamination of the feedstocks will have similar effects in the fluid coker. The three-stage desalting operation will minimize (or substantially reduce) the sodium content of the fluid coke. This sodium reduction is expected to be sufficient to prevent the formation of undesirable sodium compounds in the combustion process. However, the reduction of vanadium and other metals may not be as effective. The Fluid Coking® process tends to concentrate more of these materials in the product fluid coke.

2. Production of Premium "Fuel-Grade" Petroleum Coke: Additional Embodiments

Additional embodiments of the various means to produce a premium "fuel-grade" petroleum coke are described below. Any, all, or any combination of the embodiments, described above or below, can be used to achieve the objects of this invention. In any combination of the embodiments, the degree required may be less than specified here due to the combined effects.

A. Control of VCM in the Petroleum Coke: Additional Embodiments

DELAYED COKING; OTHER PROCESS VARIABLES

In the delayed coking process, other process parameters could also be modified to achieve the desired level of VCM on the petroleum coke. That is, operational control variables other than feed heater outlet temperatures may be modified to achieve the major objectives of the present invention and/or more optimal operation for a particular refinery. These other operational control variables may include, but should not be limited to, the coker feedstock blend, drum pressure, hat temperature, cycle time, recycle rate, and feed rate. Modifications to these operational variables may or may not accompany a decrease in the feed heater outlet temperature. Process variables that increase the thermal coking mechanism (such as feedstock modifications) would be preferable; increasing sponge coke as well as VCM. Coker feedstock pretreatment (e.g. hydrotreating) has also been noted to increase coke VCM, in certain situations. In addition, this embodiment anticipates (1) various combinations of process variable modifications and (2) different control priorities (for meeting various product specifications) that also achieve the major objectives and basic intent of the current invention.

FLUID COKING®; OTHER PROCESS VARIABLES

In a similar manner, other process parameters of the Fluid Coking® process could also be modified to achieve the desired level of VCM on the petroleum coke. Operational control variables, other than Fluid Coking® reactor temperature, may be modified to achieve the same object for more optimal operation for a particular refinery. These other operational control variables may include, but should not be limited to, the coker feedstock blend, feed rate, reactor pressure, reactor residence time, and recirculated coke particle size. Coker feedstock pretreatment (e.g. hydrotreating) can increase coke VCM, in certain situations. Modifications to these operational variables may or may not accompany a decrease in reactor temperature, recirculated coke fines temperature and/or feed temperature. In addition, this embodiment anticipates (1) various combinations of process variable modifications and (2) different control priorities (for meeting various product specifications) that also achieve the major objectives and basic intent of the current invention.

FLEXICOKING®; CHANGES IN PROCESS VARIABLES

A case could be made for increasing the VCM and/or improving crystalline structure of the purge coke in Flexicoking®. Process changes would be similar to the process changes made in Fluid Coking®, due to their similar design basis. However, the additional coke devolatilizing in the Flexicoking® process make the increased VCM more difficult. Furthermore, higher VCM coke would not likely have substantial utility, since Flexicoking® consumes most of its coke internally in its gasifier.

REDUCED STRIPPING OF PRODUCT COKE

In another embodiment, less stripping of the product coke may provide part (or all) of the desired increase in the volatile combustible material in the petroleum coke. Reducing the steaming of the product coke will significantly decrease the liquid hydrocarbons removed from the coke, via vaporization and/or entrainment. Thus, the VCM content of the product coke is increased. Most of the VCM increase is expected to be cracked liquids with boiling temperatures <1000° F. This can effectively improve the quality as well as the quantity of VCM on the petroleum coke. This embodiment can be applicable to the coke stripping in delayed coking, Fluid Coking®, Flexicoking®, and other types of coking processes, available now or in the future. In delayed coking, an added benefit is the potential for a significant reduction in the decoking cycle. The elimination of the initial steam-cooling step in the decoking procedure could decrease decoking cycle time by up to 3 hours.

INJECTION OF OILY SLUDGES/FLUIDS IN COKE QUENCH

In another embodiment, various oily sludges or other fluids containing hydrocarbon substances (e.g. used lubricating oils) can be used in the quench for the product coke to increase its VCM. The method of introducing the oily sludges/fluids is similar to that described in U.S. Pat. No. 3,917,564 (Meyers; Nov. 4, 1975). However, the injection of hydrocarbons in the quench would continue until the coke temperature reached 250–300° F. (vs. 450° F.). This modified method would allow high quality VCMs (boiling ranges of 250–850° F. and heating values of 16–20,000 Btu/lb) to be evenly dispersed on the upgraded petroleum coke. Another improvement of this expired patent would also include the introduction of the oily sludges/fluids without the two initial steam cooling steps, to reduce decoking cycle time and leave more VCM on the petroleum coke. A further improvement would result from segregating the hydrocarbon substances by boiling ranges and inject them with the quench at the appropriate cooling stage to vaporize the water carrier, but not the hydrocarbon fluids. That is, the preferred method would inject the water quench (without initial steam cooling) in stages that maintains coke temperatures below the boiling ranges of the segregated hydrocarbon substances it contains. In addition, the injection of the quench in the top of the drum (or other locations) may provide further advantage to condense escaping VCM vapors that are entrained in the steam or vaporized by localized hot spots in the coke drum. The optimization of these methods for particular refineries would maximize (or substantially increase) retention of these oily substances integrated in the upgraded petroleum coke.

Most of the VCM increase is expected to come from unreacted hydrocarbons. The degree of VCM from 1000° F.+ materials will depend on the type of sludges or oily substances. If oily substances are chosen to produce VCM <850° F., this embodiment can improve the quality as well as the quantity of the VCM. In addition, the resulting fuel-grade petroleum coke is expected to be less sensitive to the disposal of various sludges and oily substances, when compared to similar disposal methods for other grades of petroleum coke. However, certain sludges can add significant ash content and undesirable contaminants, such as sodium, to the product coke. This embodiment can be applicable to the coke quenching in delayed coking, Fluid Coking®, Flexicoking® and other coking processes, available now or in the future.

INJECTION OF OILY SLUDGES/FLUIDS IN COKING PROCESS

In another embodiment, various oily sludges or other fluids containing oily substances (e.g. used lubricating oils) can be introduced into other parts of the coking process (e.g. coker feedstocks) to increase the product coke VCM. The method of introducing the oily sludges/fluids is similar to that described in U.S. Pat. No. 4,666,585 (Figgins & Grove; May 19, 1987). However, the oily sludges in this application would be segregated to give first priority to oily sludges that are predominantly hydrocarbons with boiling ranges exceeding 600–700° F. The introduction points in the delayed coking process should include, but not be limited to coker feedstock, fractionator, coke drum, and other streams prior to coking. Similarly, introduction points in the Fluid Coking process should include, but not be limited to, coker feedstock, feed heater, scrubber section, coker reactor, and other streams prior to coking.

Similar to coker feedstocks, the VCM increase is expected to come from unreacted materials and cracked liquids. The degree of VCM from 1000° F.+ materials will again depend on the type of sludges or oily substances. As above, the resulting fuel-grade petroleum coke is expected be less sensitive to the disposal of various sludges and used lubricating oil, when compared to similar disposal methods for other grades of petroleum coke. Similarly, certain sludges can add significant ash content and undesirable contaminants, such as sodium, to the product coke. This embodiment can be applicable to delayed coking, Fluid Coking®, Flexicoking® and other coking processes, available now or in the future.

INJECTION OF HAZARDOUS WASTES IN COKING PROCESS OR COKE QUENCH

Various types of hazardous wastes can be injected as a raw material or chemical feedstock (vs. waste) in this modified process. Selective use of hazardous wastes with desirable volatilization and combustion properties (e.g. predominantly hydrocarbons) can greatly improve the quality of the upgraded petroleum coke's VCM. At the same time, the hazardous wastes could be effectively used in this product, instead of underground injection or less desirable disposal methods. In some cases, the EPA delisting or other process may be required to address environmental regulations regarding hazardous wastes. In many cases, the concentration of the hazardous waste in the resulting coke would be sufficiently low to minimize (or greatly reduce) hazardous waste characteristics.

The addition of hazardous wastes in the coking reaction (via blending with coker feedstock or other injection points) can provide a cost-effective source of VCM for the resultant coke with limited reductions in cracked liquid production. The method of introducing the hazardous wastes in the delayed coking cycle is similar to that described in U.S. Pat. No. 4,666,585 (Figgins & Grove; May 19, 1987). However, the hazardous wastes in this application would be segregated to give first priority to oily sludges that are predominantly hydrocarbons with boiling ranges exceeding 600–700° F. The introduction points in the delayed coking process should include, but not be limited to coker feedstock, fractionator, coke drum, and other streams prior to coking. Similarly, introduction points in the Fluid Coking process should include, but not be limited to, coker feedstock, feed heater, scrubber section, coker reactor, and other streams prior to coking.

Injection in the coke quench, however, may be preferable to increase the quantity of VCM with low boiling points (i.e. 250–850° F.), remaining with the coke (vs. overhead product as cracked liquid). Consequently, this higher quality VCM would enhance the ignition and combustion characteristics of the upgraded coke. Injection via coke quench can be effective in evenly distributing quench material throughout the coke. The method of introducing the hazardous wastes in the coke quench is similar to that described in U.S. Pat. No. 3,917,564 (Meyers; Nov. 4, 1975). However, the injection of hazardous wastes in the quench would continue until the coke temperature reached 250–300° F. (vs. 450° F.). This modified method would allow high quality VCMs (boiling ranges of 250–850° F. and heating values of 16–20,000 Btu/lb) to be evenly dispersed on the upgraded petroleum coke. Another improvement of this expired patent would also include the introduction of the hazardous wastes without the two initial steam cooling steps, to reduce decoking cycle time and leave more VCM on the petroleum coke. A further improvement would result from segregating the hydrocarbon substances by boiling ranges and inject them with the quench at the appropriate cooling stage to vaporize the water carrier, but not the hydrocarbon fluids. That is, the preferred method would inject the water quench (without initial steam cooling) in stages that maintains coke temperatures below the boiling ranges of the segregated hydrocarbon substances it contains. In addition, the injection of the quench in the top of the drum (or other locations) may provide further advantage to condense escaping VCM vapors that are entrained in the steam or vaporized by localized hot spots in the coke drum. The optimization of these methods for particular refineries would maximize (or substantially increase) retention of these oily substances integrated in the upgraded petroleum coke. Though hazardous wastes were not addressed directly in this expired patent, similar results are expected for many types of hazardous wastes.

COMBINATION OF EMBODIMENTS TO ACHIEVE DESIRABLE BURNING PROFILE

As noted previously, the end-users' VCM specification can be lowered by providing the optimal burning profile for his combustion system design. That is, the VCM increase can preferably be a combination of hydrocarbons with various boiling ranges. To a certain extent, the burning profile of the petroleum coke can be adjusted by a combination of the above embodiments. For example, most of the VCM increase can come from a decrease in heater outlet temperature and the addition of used lubricating oils to the coker feed, with most VCM >1000° F. materials. The remainder of the VCM could come from reduced steaming and using oily sludges in the quench, producing VCM with lower boiling ranges (e.g. 350–1000° F.). These lower boiling range VCM would improve flame initiation, stability, and intensity. Consequently, the types of volatile combustible materials could be varied to a reasonable degree, based on pilot studies for production and burning of petroleum coke. In this and similar approaches, the formulation of petroleum coke can be custom-made to match (to the extent possible and reasonable) the burning profile of the end-user's combustion system. In this manner, the end-user can optimize the operation of his combustion system without expensive design modifications to accommodate the fuel switch to petroleum coke. Consequently, this approach is conducive to achieving the lowest VCM required by the end-user's current combustion system.

GENERAL ISSUES FOR VARIOUS EMBODIMENTS OF VCM CONTROL

As noted above, the use of less stripping and/or quench containing hydrocarbons can eliminate or reduce the need for additional VCM from the coker feedstock. However, the petroleum coke VCM must be able to endure the weathering (rain, snow, etc.) in transport and storage, and provide the VCM required by the end-user at its facility. That is, VCM from lighter hydrocarbons may be lost from the product coke, due to higher solubility and continual washing.

After the specific level and types of VCM required are determined for any given product coke, engineering factors will determine the optimal use for any of the above embodiments, separately or in combination, for a particular refinery. In any combination of the embodiments, the degree required may be less than specified here due to the combined effects. Finally, these concepts and embodiments may be applied to other types of coking processes, available now or in the future.

As noted previously, the main objective of the present invention is to achieve a petroleum coke with acceptable VCM, crystalline structure, and decontamination levels, preferably specified by the end-user. THEN, the conversion of coker feedstock blend to lighter liquid products is maximized. Optimization of all operating conditions and economic constraints via refinery LP computer models is anticipated. However, this model would likely include a petroleum coke product having the end-user specified VCM, crystalline structure, and decontamination levels as operational constraints.

B. Control of Petroleum Coke Crystalline Structure; Additional Embodiments

OTHER COKER OPERATING VARIABLES

In coking processes, other process parameters could also be modified to achieve the desired level of crystalline structure within the petroleum coke. Operational control variables other than drum and coke recirculation temperatures may be modified to achieve the same object or more optimal operation for a particular refinery. These other operational control variables would preferably increase the thermal coking mechanism and/or decrease the asphaltic coking mechanism to bring R-values down to an acceptable level. For delayed cokers, these other operational control variables may include, but not be limited to, the coker feedstock blend, fractionator pressure, hat temperature, cycle time, and feed rate. For Fluid Coking®, these other operational control variables may include, but not be limited to, the coker feedstock blend, solids circulation rate, fractionator pressure, and feed rate. Modifications to these operational variables may or may not accompany a decrease in the outlet temperatures of the respective feed heaters or other operating temperatures. Process variables that increase VCM while decreasing shot coke would be preferable.

COKER FEEDSTOCK MODIFICATIONS

Coker feedstocks could also be modified to achieve the desired level of crystalline structure within the petroleum coke. That is, feedstock modifications can achieve the same object or more optimal operation for a particular refinery. These would preferably increase the thermal coking mechanism and/or decrease the asphaltic coking mechanism to bring R-values down to an acceptable level. Coker feedstock modifications could include, but not be limited to (1) dilution with fluids/feedstocks with less asphaltene and resins content, (2) the addition of highly aromatic feedstocks, such as FCCU slurry oil, and/or (3) coker feed pretreatment (e.g. hydrotreating or other desulfurization). This embodiment can be applicable to delayed coking, Fluid Coking®, Flexicoking® and other coking processes, available now or in the future.

COKER ADDITIVES

Various chemical and/or biological agents could be added to the coking process to inhibit the formation of shot coke and/or promote the formation of desirable sponge coke. One such additive may inhibit the role certain contaminant particles play in the formation of shot coke. Also, U.S. Pat. No. 4,096,097 (Yan et alia: Jun. 20, 1978) describes a method for inhibiting shot coke and promoting sponge coke formation. This method comprises adding an effective amount of oxygen-containing, carbonaceous material, which tends to decompose at high temperatures (e.g. sawdust, coal, lignite), to the delayed coker and/or recycle/feed. This addition apparently eliminates or substantially reduces shot coke formation and promotes sponge coke crystalline structure.

CURRENT REFINERY OPERATION

In some situations, the end-users combustion system is capable of handling the coke crystalline structure produced by the coker without additional modifications. For example, process modifications to achieve the higher VCM coke produce acceptable levels of shot coke (or coke crystalline structure) without further process modifications. Alternatively, refineries may have coker feedstocks (e.g. lighter crude blends) with sufficiently low asphaltenes and resins, that the production of sponge coke is already prevalent. In these cases, an increase in coke VCM in the coking process normally increases the coke porosity. As such, an increase in coke VCM alone can be sufficient to achieve an upgraded coke capable of self-combustion.

GENERAL ISSUES FOR CONTROL OF COKE CRYSTALLINE STRUCTURE

After the specific levels and types of crystalline structure required is determined for any given product coke, engineering factors will determine the optimal use for any of the above embodiments, separately or in combination. In any combination of the embodiments, the degree required may be less than specified here due to the combined effects. Again, these concepts and embodiments may be applied to delayed coking, Fluid Coking®, Flexicoking® and other types of coking processes, available now or in the future.

C. Decontamination of Petroleum Coke; Additional Embodiments

CURRENT DESALTING PROCESS WITH IMPROVED EFFICIENCY

The conventional refinery desalting processes, currently in the refinery, can be modified to achieve the low-level decontamination required. One or two stage desalter systems can be improved to >95+% efficiency with sodium levels <5 ppm in the crude or vacuum distillation feedstock. In some cases, this level of decontamination can be sufficient.

OTHER HIGH-EFFICIENCY DESALTING OPERATIONS

Filtration, catalytic, and other types of hydrocarbon desalting operations are in various stages of development. The present invention anticipates the integration of these new types of desalting operations. These other desalting technologies can provide sufficient decontamination, if a sodium specification of <15 ppm (preferably <5 ppm) in the coker feedstock is achieved.

COKE TREATMENT WITHIN THE COKING PROCESS

An additional embodiment for low-level decontamination of the petroleum coke can include coke treatment in the coking process. In the decoking cycle of the delayed coking process, the petroleum coke goes through steam stripping and quenching phases. During these phases, trace amounts of acid, caustic or other chemical additives could be added to the water to promote further reduction of contaminants. In a manner similar to the desalting process, the "water-washing" of the petroleum coke with steam and water would remove water-soluble compounds. The decrease in decoking cycle (created by the reduced drilling time of the softer coke) could be used for additional residence or treating time, if appropriate. A closed-loop water system with independent water treatment may also be desirable for this embodiment. In addition, the introduction of biological treatment of the petroleum coke can be included in this embodiment. Overall, this embodiment may be more desirable than enhanced crude oil desalting systems, due to the thermal decomposition of the coking process. That is, many of the complex organic structures containing the contaminants have been cracked, potentially exposing the contaminants for further treatment (e.g. reaction and entrainment). The combination of both embodiments may be very cost-effective. Similarly, the quench phase (and possibly the stripping phase) of the Fluid Coking® process can also provide an opportunity for this embodiment of low-level decontamination.

COKE TREATMENT AFTER COKING PROCESS

Another embodiment of the present invention can provide decontamination of the petroleum coke after the coking process is complete. As noted above, many of the complex organic structures containing the contaminants have been cracked, in the coking process, potentially exposing the contaminants for further treatment. After the degree of required decontamination and the properties of the upgraded coke are known, normal engineering skills would be sufficient to develop various engineered solutions to treat the coke after the coking process. Options for this embodiment might include various physical, chemical, and/or biological treatments. Another option may also use the transportation and storage of the coke to increase treatment time. This option may require final treatment steps, rinsing, and water treatment systems at the coke user's facility.

COKER FEEDSTOCK DILUTION

Another embodiment of the present invention would modify the coker feedstocks to reduce the concentration of contaminants in the final coke product. Coke-producing feedstocks with lower concentrations of the contaminants of concern would be added to the coker feed to dilute the concentration of contaminants in the petroleum coke product.

COKER FEEDSTOCK PRETREATMENT

Yet another embodiment of the present invention may include other types of coker feedstock pretreatment. From a technical perspective, the addition of a coker feed pretreatment system would likely be the most effective means of addressing the detrimental impacts of petroleum coke contaminants. However, this embodiment often is not economically optimal. The optimal coker feed treatment system would depend on the composition of the coker feedstocks and the needs of the petroleum coke user. After the degree of required decontamination and the impacts of feed treatment decontamination are known, various engineered solutions would be available to treat the coker feedstocks. This coker feed treatment system may or may not include more sophisticated demetallization and/or desulfurization technologies, described in the prior art. For example, hydrotreating or hydrodesulfurization of the coker feedstocks can decrease the sulfur content by 80–95%. If most of the sulfur is removed from the product coke in this manner, the excess capacity of in a utility boiler's existing particulate control device can be used for the collection of other gases (e.g. carbon dioxide) that are converted to collectible particulates. Also, desulfurization of the coker feedstock may provide further advantage by increasing coke VCM and promoting sponge coke.

CURRENT REFINERY OPERATION WITH NO FURTHER DECONTAMINATION

Another embodiment of the present invention may include no treatment of any kind for decontamination of the coke. As noted previously, the effects of petroleum coke's high metals content in combustion and heat transfer equipment is not well understood or defined. The design and operation of the user's combustion system plays a major role in determining whether the current level of contaminants in the coke is acceptable or not. Therefore, some oil refineries, depending on the coker feedstock blend and coker operation, may be able to provide the upgraded petroleum coke without further coke decontamination.

GENERAL ISSUES FOR EMBODIMENTS OF LOW-LEVEL DECONTAMINATION

After the specific level of required coke decontamination is determined for any given product coke, engineering will determine the optimal use for any of the above embodiments, separately or in combination. The combination of any of these embodiments may reduce the level of decontamination required by each embodiment, individually. Finally, these concepts and embodiments may be applied to other types of coking and desalting processes, available now or in the future.

3. Production of Premium "Fuel-Grade" Petroleum Coke: Optimized Fuel Embodiment

The various methods and embodiments of the present invention can also be used to optimize combustion characteristics for specific combustion applications. The following embodiment provides a means to produce an upgraded petroleum coke that not only achieves the basic objectives of this invention, but also optimizes fuel characteristics to replace existing solid fuels with the least (or lower) amount of equipment and operational modifications. As noted earlier, one fuel can be directly substituted for an existing fuel in a full-scale operation, if the burning characteristics are sufficiently similar. As such, the various techniques, used in this invention to create a premium petroleum coke, can be optimized in many cases to produce a direct replacement fuel for existing facilities. In this manner, a specific coker with certain design, feedstocks, and refinery operational constraints can be modified to produce a solid fuel with sufficiently similar combustion characteristics as the existing solid fuel at a specific combustion facility.

As discussed previously, various pilot-scale and laboratory tests can effectively evaluate the burning characteristics for various fuels. Smaller scale tests to optimize parameters are preferable to full scale operations for various reasons, including economics and safety. In the example for this embodiment, refinery pilot plant studies and modified B&W burning profile tests are used to optimize the burning characteristics of the upgraded petroleum coke. The B&W burning profile tests have been modified to incorporate differences in particle size distribution attributed to differences in the solid fuels' grinding characteristics. That is, a solid fuel with a higher Hardgrove Grindability Index (HGI) is softer. An equivalent pulverizer can grind these fuels to much finer particle size distributions with an equivalent grinding energy. For example, coals with HGIs of 50–70 are typically ground to 65–80% through 200-mesh (~74 microns). In contrast, the upgraded petroleum coke is expected to have HGIs of 90–120 and particle size distribution of 80–95% through 200-mesh at the same (or less) grinding energy.

Pilot plant studies can be designed to find the optimal combination of various techniques described in this invention to improve the fuel qualities of petroleum coke. The following procedure can provide an adequate means to optimize the petroleum coke fuel characteristics:

1. Optimize design and operational parameters for the refinery's desalting system (or system parameters in other embodiments) to produce acceptable levels of sodium in coker feeds & coke.
2. Optimize coker operating temperatures (or operating parameters of other embodiments, such as feedstock composition) to achieve desirable levels of sponge coke crystalline structure.
3. Compare modified B&W burning profiles of the two fuels to evaluate adjustments in the quantity and quality of coke VCMs needed to nearly match the burning profile of the existing fuel.
4. Optimize other coker operational parameters (e.g. oily substances in water quench) to adjust the quantity and quality of VCMs in the petroleum coke to obtain desirable combustion characteristics.
5. Repeat steps 3 and 4 until the critical burning characteristics of the upgraded petroleum coke are sufficiently similar to the burning characteristics of the existing fuel.
6. Reproduce optimal operating conditions in the refinery units to produce sufficient petroleum coke for a test burn in a pilot-scale combustion system.
7. Conduct test burn with upgraded coke and optimize combustion design and operational parameters. Modify burners or other equipment, as necessary, to achieve acceptable combustion characteristics.
8. Repeat steps 6 and 7 until evaluation of necessary equipment and operational modifications is satisfactory. Implement equipment and operational changes in the existing combustion facility.

FIG. 3 shows comparisons of burning profiles for existing coals and petroleum coke. As noted earlier, some characteristics in the burning profile are not necessarily desirable, such as the blips for excessive moisture and premature ignition. Other unobvious combustion characteristics (reflected in this burning profile's rate of release) are undesirable, including high ash content and low porosity char. Both of these hinder oxidation and the rate of release. Consequently, the critical combustion characteristics in the burning profile are (1) ignition temperatures, (2) combustion intensity (height of maximum release-rate), (3) total heat liberated (area under the profile), and (4) temperature of oxidation termination. If these parameters are sufficiently similar, the upgraded petroleum coke can readily replace the existing fuel. The high char porosity, low ash content, low moisture and high HGI of the upgraded petroleum coke tend to shift the entire modified burning profile to the left with only modest to moderate additions of VCM. These properties of the upgraded petroleum coke are the primary reason that this fuel can have better combustion characteristics than most coals, even with significantly lower (or comparable) VCM content and/or quality.

In this manner, optimal levels of VCM quantity, coke crystalline structure, VCM quality, and coke decontamination can be determined. After these levels are derived, the various methods and embodiments of the present invention (with proper consideration of various engineering factors) can be used to optimize the upgraded petroleum coke for specific combustion applications. The optimized coker process control procedures (i.e. temperature controls, quench controls, etc.) via burning profile tests is analogous to other coker process controls that are determined by pilot plant tests.

In conclusion, the upgraded petroleum coke of the present invention can be readily optimized to provide sufficiently similar, critical combustion characteristics. In this manner, the upgraded petroleum coke can readily replace solid fuels in existing combustion facilities with limited modifications to current design and operation. Though the sulfur content does not significantly affect combustion characteristics, the optimization of upgraded petroleum coke that has been desulfurized would provide an even more ideal fuel replacement. That is, the use of desulfurized coker feedstocks in this optimization process can offer greater flexibility in the optimization of environmental controls.

4. Use of Premium "Fuel-Grade" Petroleum Coke: Conventional Utility Boilers/Wet Scrubbers Another embodiment of the present invention is the use of the upgraded petroleum coke in conventional, PC-fired utility boilers with traditional particulate control devices and wet scrubbing systems. The discussion of this embodiment includes a basic description of a conventional utility boiler system with traditional particulate control devices (electrostatic precipitators, baghouses, etc.), followed by a wet scrubbing system for the removal of sulfur oxides and/or particulates. The prior art has been modified with (1) a retrofit addition of the flue gas conversion reaction chamber (s) and injection system(s) and/or dry sorbent injection system(s). The primary difference from the preferred embodiment is the presence of the wet scrubber. The superior fuel characteristics of the upgraded petroleum coke are essentially the same as the preferred embodiment for the following subsystems: fuel processing, combustion, heat transfer, and heat exchange. The environmental controls section is similar, including the modification of the existing particulate control device to a flue gas conversion system. However, the wet scrubber provides additional flexibility in various options that can be used to optimize the levels of control for particulates, sulfur oxides, carbon dioxide and other undesirable flue gas components. For example, the operation of the wet scrubber can be used in combination with dry sorbent injection to increase overall SOx removal efficiencies.

Figure 5:
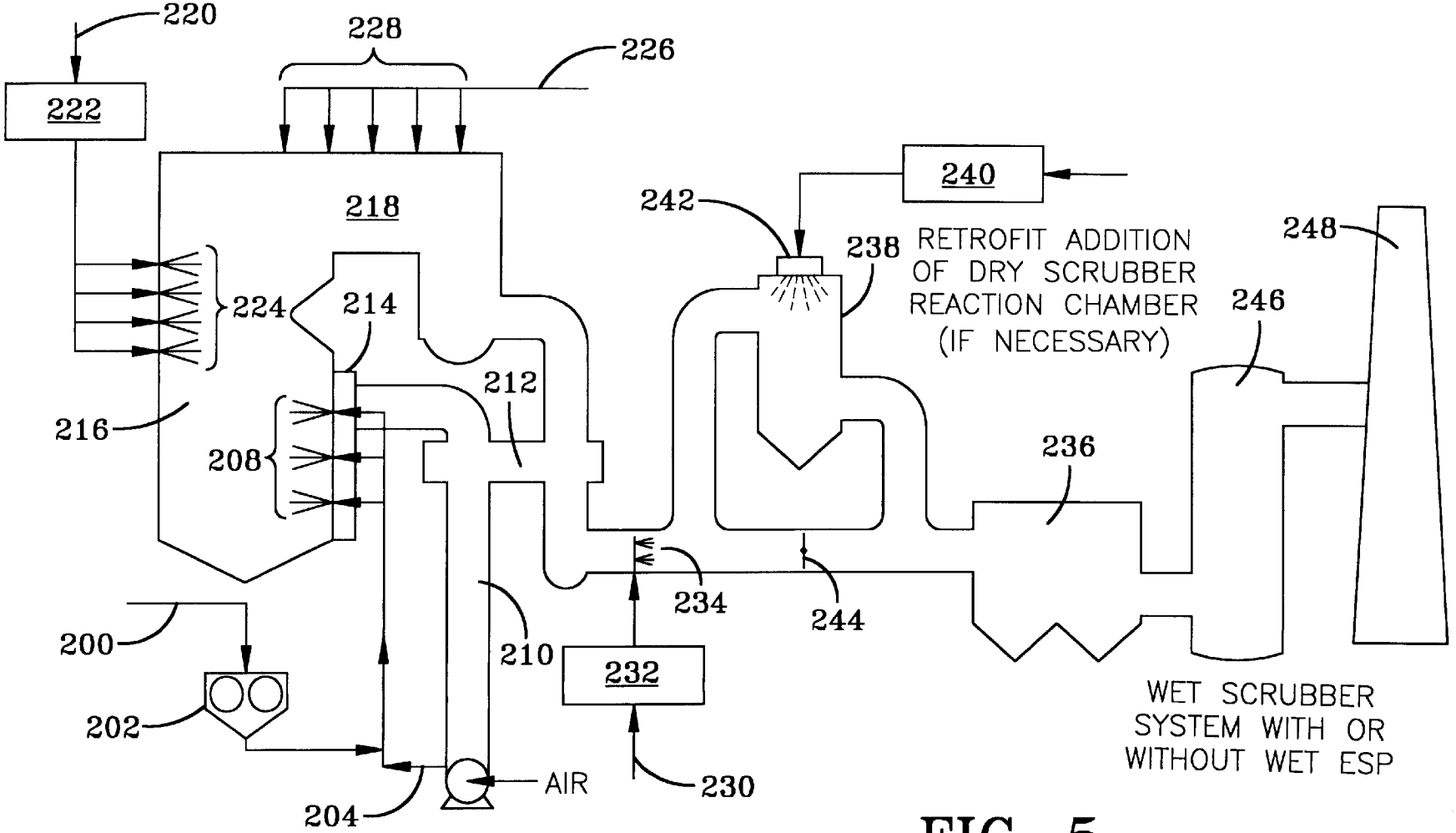
FIG. 5 shows a basic process flow diagram for a conventional, coal-fired utility boiler with a wet scrubber downstream of the traditional particulate control device (PCD): Baghouse, electrostatic precipitator (ESP), or other. The combustion system has been modified to include a reaction vessel(s) and/or reagent injection system(s) for control of undesirable flue gas components.

A. Conventional, PC Utility Boilers with PCD and Wet Scrubber; Process Description In this embodiment of the invention, a conventional, pulverized-coal utility boiler with a traditional particulate control device is followed by a wet scrubbing system for the removal of sulfur oxides and/or particulates. The boiler and PCD systems are modified in a manner similar to the preferred embodiment: conversion of sulfur oxides to dry particulates upstream of the existing particulate control device(s). Thus, the prior art has been modified to achieve this objective with Option 1: dry reagent injection system(s) and/or Option 2: a retrofit addition of flue gas conversion reaction chamber(s) and injection system(s). FIG. 5 shows a basic process flow diagram for this system burning a pulverized solid fuel as the primary fuel. Auxiliary fuel, such as natural gas or oil, is used for start-up, low-load, and upset operating conditions. The solid fuel 200 is introduced into the fuel processing system 202, where it is pulverized and classified to obtain the desired particle size distribution. A portion of combustion air (primary air) 204 is used to suspend and convey the solid fuel particles to horizontally-fired burners 208. Most of the combustion air (secondary air) 210 passes through an air preheater 212, where heat is transferred from the flue gas to the air. The heated combustion air (up to 600° F.) is distributed to the burners via an air plenum 214. The combustion air is mixed with the solid fuel in a turbulent zone with sufficient temperature and residence time to initiate and complete combustion in intense flames. The intense flames transfer heat to water-filled tubes in the high heat capacity furnace 216, primarily via radiant heat transfer. The resulting flue gas passes through the convection section 218 of the boiler, where heat is also transferred to water-filled tubes, primarily via convective heat transfer. At the entrance to the convection section 218, certain dry reagents can be mixed with the flue gas to convert undesirable flue gas components (e.g. sulfur oxides) to collectible particulates (this embodiment: option 1). The reagents 220 pass through a reagent preparation system 222 and are introduced into the flue gas via a reagent injection system 224. Steam or air 226 is normally injected through soot-blowing equipment 228 to keep convection tubes clean of ash deposits from the fuel and formed in the combustion process. The flue gas then passes through the air preheater 212, supplying heat to the combustion air.

The cooled flue gas then proceeds to the air pollution control section of the utility boiler system. At the exit of the air preheater, certain dry reagents can be mixed with the flue gas to convert undesirable flue gas components (e.g. sulfur oxides) to collectible particulates (this embodiment: option 1). The reagents 230 pass through a reagent preparation system 232 and are introduced into the flue gas via a reagent injection system 234. The existing particulate control device 236 (ESP, baghouse, etc.) has been retrofitted with the addition of a reaction chamber 238 for this embodiment: option 2. Certain reagents (e.g. lime slurry) can be prepared in a reagent preparation system 240. The reagent(s) is dispersed into the flue gas through a special injection system 242. Sufficient mixing and residence time is provided in the reaction chamber to convert most of the undesirable flue gas components (e.g. sulfur oxides) to collectible particulates. These particulates are then collected in the existing particulate control device (PCD) 236. A bypass damper 244 is installed in the original flue gas duct to bypass (100% open) the retrofit flue gas conversion system, when necessary. The flue gas exits the PCD and enters the wet scrubbing system 246. The wet scrubbing system 246 removes additional SOx and particulates. The clean flue gas then exits the stack 248.

B. Combustion Process of the Prior Art

The combustion process of the prior art for this embodiment is similar to the combustion process of the prior art in the preferred embodiment.

C. Combustion Process of the Present Invention

The combustion process of the present invention for this embodiment is similar to the combustion process of the present invention in the preferred embodiment. However, the higher density and spherical shape of the modified fluid petroleum coke make it more difficult to burn than modified delayed coke. Consequently, certain parameters need to be adjusted to compensate for this undesirable characteristic. For example, a higher VCM specification (e.g. 20 wt. % VCM) can be necessary to achieve acceptable combustion characteristics.

D. Environmental Controls of the Prior Art

The environmental controls of the prior art for this embodiment are similar to the environmental controls of the prior art in the preferred embodiment. Traditional particulate control devices PCDs) for conventional, coal-fired utility boilers include (but should not limited to) electrostatic precipitators (ESPs), various types of filtering systems, and wet scrubber systems. Various wet scrubber systems have evolved to control particulate and other emissions, including sulfur oxides. Wet scrubbing technologies range from simple flue gas scrubbing towers to high pressure drop, turbulent mixing devices with downstream separation. As discussed previously. The most common type of wet scrubbers used for U.S. utility boilers is low-pressure drop spray tower. This type of wet scrubber system is included in this embodiment, and was described previously in the Preferred Embodiment: Environmental Controls of the Prior Art. The present invention does not claim novel wet scrubbing technology, but provides a novel application of such technology that provides unexpected benefits and synergism to optimize environmental controls associated with the combustion of petroleum coke. Therefore, further description of readily available wet scrubbing technologies was not deemed appropriate, at this time.

E. Environmental Controls of the Present Invention

The present invention does not claim the prior art environmental control technologies separately, but provides improvements and novel combinations of these technologies in applications of the present invention. The different combinations of these technologies are somewhat involved and provide synergism and/or unappreciated advantages that are not suggested by the prior art.

Similar to the preferred embodiment, this embodiment describes the use of existing particulate control equipment for the control of sulfur oxides (SOx) and/or other undesirable flue gas components. As noted previously, fuel switching, from coal to the upgraded petroleum coke of this invention, will make available a tremendous amount of particulate control capacity in existing particulate control devices. Again, the existing particulate control devices (baghouses, electrostatic precipitators, etc.) can be used for extensive removal of SOx and/or other undesirable flue gas components by converting them to collectible particulates upstream of the PCDs.

The primary difference in the environmental controls of this embodiment (versus the preferred embodiment) is the presence of the existing wet scrubber system. The existing wet scrubber increases the number of environmental control options and operational flexibility. As the final environmental control system before the flue gas exits the stack, the wet scrubber has additional impacts on environmental emissions. The environmental controls of this embodiment (i.e. with the wet scrubber) are also applicable to upgraded petroleum coke from the delayed and other coking processes.

PARTICULATES IMPACT

The particulates impact of this embodiment is similar to the preferred embodiment. That is, the fuel switch from coal to modified fluid coke will decrease the ash particulate loading by >90%. However, the additional wet scrubber system in this embodiment can provide additional reduction of particulates but can also increase liquid entrainment in the flue gas that exits the stack. The degrees of additional particulate reduction and increase in liquid entrainment are expected to be minor. Both are dependent upon the design and operation of the wet scrubber system.

SULFUR OXIDES IMPACT

The sulfur oxides impact of this embodiment is similar to the preferred embodiment. However, as noted above, the existing wet scrubber system provides more options to achieve high levels of sulfur oxides control. The existing wet scrubber also offers greater operational flexibility and reliability, if a combination of sulfur oxide controls is used.

In this embodiment, however, conversion of all the sulfur oxides upstream of the PCD may not be desirable to optimize the combined sulfur oxides removal. In other words, a certain portion of the total sulfur oxides may be left unconverted and be collected downstream of the particulate control device in the wet scrubbing system to maximize or optimize the overall SOx removal. Alternatively, all the sulfur oxides may be converted to particulates and collected in the existing particulate control device, avoiding the need for continuing the operation of the wet scrubber. In these cases, the additional sulfur removal may not be warranted, and the bypassing/shutdown of the wet scrubbing system can provide substantial savings in operating costs. Alternatively, the wet scrubber could then be converted to flue gas conversion technology for another undesirable flue gas component, such as $CO_2$.

In Option 1 of this embodiment, dry sorbent injection systems are added for additional control of sulfur oxides. As noted in the preferred embodiment, this unique application of this flue gas conversion technology is expected to achieve 50–70% SOx removal efficiency, on a long-term basis. In this embodiment, however, the combination with the existing wet scrubber system increases the overall sulfur oxides removal. That is, the existing wet scrubber typically has the capability of reducing the SOx FGCT outlet emissions by 80–95+%. The actual removal efficiency of the wet scrubber can be reduced slightly due to the effects of lower SOx inlet concentrations. In conclusion, the combination of this unique flue gas conversion retrofit and the wet scrubber is expected to achieve overall SOx removal efficiencies of 95–97% (e.g. 0.7+0.85(0.3)).

In Option 2 of this embodiment, retrofit reaction chamber (s) and reagent injection system(s) are added to convert sulfur oxides to dry particulates upstream of the existing particulate control device(s). Since the combination of Option 1 and the existing wet scrubber are expected to achieve such high SOx removal efficiencies (i.e. 95–97%), replacing Option 1 with Option 2 would usually not be cost effective. However, Option 2 can be effectively used, if shutting down or reducing the load of the existing wet scrubber is desirable. In this case, the combined SOx removal efficiency is expected to be the dry scrubber efficiency (e.g. 80–90%) plus the reduced efficiency of the existing wet scrubber multiplied by the remaining sulfur oxide emissions from the outlet of the dry scrubber system.

In both flue gas conversion options, minor modifications may be necessary to maintain particulate collection efficiencies. The particulates coming into the existing PCDs may have substantially different properties than the particulates of the PCD's design basis. Consequently, modifications in design and/or operating conditions may be required. For example, flue gas conditioning or operational changes may be appropriate to achieve desirable resistivity characteristics, and maintain collection efficiencies in existing electrostatic precipitators.

CARBON DIOXIDE IMPACT

The carbon dioxide impact of this embodiment is similar to the preferred embodiment. However, the wet scrubber system provides a greater opportunity to use the excess capacity of the existing particulate control device for the control of carbon dioxide, instead of sulfur oxides. In other words, the combination of the dry sorbent injection (option 1) and the wet scrubber should be sufficient SOx control to meet environmental regulations in most cases. Therefore, the retrofit addition of a flue gas conversion reactor/injection system (option 2) can be primarily used for carbon dioxide control. Alternatively, Option 2 can be used for SOx, and the wet scrubber could then be converted to flue gas conversion technology for carbon dioxide. This latter option would provide greater separation of technologies, and greater conversion selectivity.

NITROGEN OXIDES IMPACT

The nitrogen oxides impact of this embodiment is similar to the preferred embodiment. However, the wet scrubber system can provide additional reduction of nitrogen oxides. The overall impact is expected to be relatively minor.

OPACITY IMPACT

The opacity impact of this embodiment is similar to the preferred embodiment. However, the wet scrubber system can contribute greatly to increased opacity. That is, higher levels of liquid entrainment can induce the agglomeration of particulates and residual sulfur oxides, and increase opacity significantly over the preferred embodiment. Substantial reductions in ash particulates and sulfur oxides, in many cases, will offset the opacity increase due to liquid entrainment. Consequently, the liquid entrainment remains predominantly water vapor (without impurities) and dissipates without visual obstruction when it leaves the stack.

SOLID WASTE IMPACT

The solid waste impact of this embodiment is very similar to the preferred embodiment. However, any solid waste (e.g. sludge) generated by the use of the wet scrubber system must be addressed. Lower utilization of the wet scrubber is expected to substantially reduce solid wastes from the wet scrubber. As noted earlier, reagent recycling or regeneration with Options 1 or 2 can substantially reduce the quantity and/or quality of the solid wastes for disposal. For most applications, the solid wastes are expected to be substantially less than the existing system. Even their worst case scenarios will often produce solid wastes no greater than the existing system.

F. EXAMPLE 2

Utility Boiler with PCD and Conventional Wet Scrubber

A power utility has a conventional, pulverized-coal fired utility boiler that currently uses a high sulfur, bituminous coal (Illinois #6). This utility has a conventional particulate control device (PCD) followed by a wet scrubber, achieving ~90% removal efficiency for sulfur oxides. Full replacement of this coal with a high-sulfur, fluid (petroleum) coke produced by the present invention would have the following results:

Basis = $1.0 \times 10^9$ Btu/Hr Heat Release Rate as Input

| | Current Coal | Upgraded coke | Results |
|---|---|---|---|
| Fuel Characteristics | | | |
| VCM (% wt) | 44.2 | 20.0 | 54% Lower |
| Ash (% wt.) | 10.8 | 0.3 | 97% Lower |
| Moisture (% wt.) | 17.6 | 3.8 | 78% Lower |
| Sulfur (% wt) | 4.3 | 5.2 | 21% Higher |
| Heating Value (Mbtu/lb) | 10.3 | 14.2 | 38% Higher |
| Fuel Rate (Mlb/Hr) | 97.0 | 70.4 | 27% Lower |
| Pollutant Emissions: Uncontrolled/Controlled | | | |
| Ash Particulates (lb/MMBtu or Mlb/Hr) | 10.5/.53 | .18/.01 | 98% Lower |
| Sulfur Oxides (lb/MMBtu or Mlb/Hr) | 8.4/.84 | 7.4/.15 | 82% Lower |
| Carbon Dioxide (lb/MMBtu or Mlb/Hr) | 245 | 214 | 13% Lower |

This example further demonstrates the beneficial application of the present invention. Again, the upgraded petroleum coke has substantially lower ash and moisture contents, compared to the existing coal. These factors contribute greatly to (1) the ability to bum successfully with lower VCM and (2) a fuel heating value that is 38% higher. In turn, the higher heating value requires a 27% lower fuel rate to achieve the heat release rate basis of one billion Btu per hour in the boiler. As noted previously, this lower fuel rate and the softer sponge coke significantly reduce the load and wear on the fuel processing system, while increasing pulverizer efficiency and improving combustion properties.

The ash particulate emissions (ash from the fuel) are 98% lower than the existing coal, due to the lower ash content and higher fuel heating value. Consequently, fuel switching to the upgraded coke unleashes 97% of the capacity in the existing particulate control device. This excess capacity can now be used for the control of sulfur oxides via retrofit FGC technology.

Dry sorbent injection systems (this embodiment: option 1) is added upstream of the existing particulate control device, along with any associated reagent preparation and control systems, for sulfur oxides control. In this case, the inlet SOx would be reduced by 70% (i.e. 7.4 to 2.2 Lb/MMBtu.). The existing wet scrubber can achieve an additional 80–90% removal (i.e. 2.2 to 0.33 Lb/MMBtu.). Thus, the combined control efficiency of the existing wet scrubber and the converted PCD would be >95% (e.g. 0.7+0.85(0.3)). In this manner, the utility of converting the existing particulate control device to dry sorbent injection represents 61% reduction in sulfur oxides (i.e. 0.33 vs. 0.84 lb/MMBtu). This unexpected result is achieved even though the sulfur content (5.2%) of the upgraded petroleum coke is 21% higher than the sulfur level (4.3%) of the Illinois bituminous coal. If this level of sulfur emissions is sufficient to meet environmental regulations, the retrofit addition of reaction chamber(s) and reagent injection system(s) is not necessary.

Alternatively, a SOx dry scrubber injection/reaction vessel (this embodiment: option 2) can be added upstream of the existing particulate control device, along with any associated reagent preparation and control systems. This conversion of the existing particulate control device is assumed to achieve 90% reduction in sulfur oxides in this case. Therefore, the uncontrolled sulfur oxide emissions are reduced from 7.4 to 0.74 thousand pounds per hour. If the wet scrubber is still operated, an additional 75–85+% removal (i.e. 0.74 to 0.15 Lb/MMBtu) can be achieved. Thus, the combined control efficiency of the existing wet scrubber and the converted PCD would be >98% (e.g. 0.9+0.8(0.1)). In this manner, the utility of converting the existing particulate control device to dry scrubbing represents over 82% reduction in sulfur oxides (i.e. 0.15 vs. 0.84 lb/MMBtu). This unexpected result is achieved even though the sulfur content (5.2%) of the upgraded petroleum coke is 21% higher than the sulfur level (4.3%) of the Illinois bituminous coal.

In this example, the effective use of retrofit FGCTs for additional reductions of carbon dioxide can be demonstrated. If option 1 is used for sulfur oxides control, a FGCT injection/reaction vessel can be added up stream of the existing PCD for additional carbon dioxide control. In this case, the level of additional carbon dioxide control is limited by (1) the conversion of carbon dioxide to particulates and (2) the remaining capacity of the existing PCD without exceeding environmental regulations for particulate emissions. Alternatively, additional particulate control capacity could be added as part of the retrofit project. As noted earlier, the performance and capacity of the existing PCD is not strictly on a mass weight basis, but depends on several factors, including particulate properties. If option 2 is used for sulfur oxide control, additional $CO_2$ control would likely be limited due to lack of selectivity of the FGCT reagent. In either case, the original ash particulate capacity less the required capacity for converted SOx (large ionic salts) may not leave sufficient capacity to make $CO_2$ control cost effective. However, an upgraded petroleum coke that has been desulfurized would offer even greater opportunities for additional $CO_2$ control. As noted previously, the wet scrubber could also be converted to flue gas conversion technology for carbon dioxide.

This example also illustrates significant reductions in pollutant emissions, based solely on fuel switching. The 27% lower fuel rate of the upgraded petroleum coke greatly contributes to lower environmental emissions of ash particulates, sulfur oxides, and carbon dioxide. The 98% reduction in ash particulates, noted above, was primarily due to lower fuel ash concentration. However, uncontrolled emissions of sulfur oxides and carbon dioxide are significantly reduced primarily due to the 27% lower fuel rate. That is, the sulfur content of the modified fluid coke is 21% higher than the existing coal. Yet the upgraded petroleum coke has 12% lower uncontrolled SOx. Similarly, the upgraded petroleum coke has 20% higher carbon content (i.e. 82.8% vs. 69.0%). Yet the uncontrolled emissions of carbon dioxide is reduced by 13% due to fuel switching. Similar results would be achieved by fuel switching to an upgraded petroleum coke from a delayed coking process.

Each utility boiler will have a different set of design conditions for converting the existing particulate control devices. Consequently, the degree of additional control needs to be determined on a case by case basis: including analyses of site-specific factors of the design and operation of the existing PCD. The conversion of each system will depend on various design and operational parameters. Engineering factors will determine the optimal design and level of control for SOx FGC technologies and wet scrubbing technologies. Again, the ultimate level of additional control for SOx and particulates will depend on (1) the efficiency of conversion of the sulfur oxides to particulates, (2) the efficiency of particulate collection, and (3) capacity limitations without exceeding environmental regulations for particulate emissions.

5. Use of Premium "Fuel-Grade" Petroleum Coke: Additional Embodiments

Additional embodiments are described below for the various means to effectively use the premium "fuel-grade" petroleum coke of the present invention. Any, all, or any combination of the embodiments, described above or below, could be used to achieve the objects of this invention. In any combination of the embodiments, the degree required can be less than specified here due to the combined effects.

A. Combustion or Other End-User Systems: Additional Embodiments

ALL COAL-FIRED BOILERS

Further embodiments of the present invention would include the use of upgraded petroleum coke in all types of coal-fired boilers (new or existing) regardless of furnace design, burner orientation, or other design and operational parameters. These combustion systems would include, but should not be limited to, low heat capacity furnaces, cyclone furnaces, tangentially fired furnaces/burners, non-horizontal fired burners, etc.

OTHER COMBUSTION APPLICATIONS

Additional embodiments of the present invention would include all other facilities, where coals or petroleum cokes are currently used as fuels. The present invention should not be viewed as limited to coal-fired utility boilers, but rather may be applicable to all combustion applications, where the enhanced properties of the upgraded coke provide improvements, combustion and otherwise. These combustion applications may preferably include, but should not be limited to, industrial boilers, rotary kilns, cement kilns, process heaters, incinerators, and fluidized bed combustors. Also, the use of upgraded petroleum coke as a supplemental fuel for these and other applications is anticipated by the present invention, including biomass and/or waste combustion facilities.

COAL/COKE GASIFICATION

In other embodiments, the present invention anticipates the use of the upgraded petroleum coke in various coal/coke gasification technologies. Coal gasification is a process that converts coal from a solid to a gaseous fuel (or chemical feedstock) through partial oxidation. Once the fuel (or chemical feedstock) is in the gaseous state, undesirable substances, such as sulfur compounds and ash, can be removed from the gas by established techniques. The net result is clean, transportable fuel (or chemical feedstock). Since coal/coke gasification is a type of combustion (i.e. partial oxidation vs. full oxidation), many of the same principles discussed in the present invention still apply.

Consequently, many of the improved properties of the upgraded petroleum coke would be desirable for partial oxidation. For example, the ability to optimize and control the quantity/quality of the VCM and the coke crystalline structure can be very desirable for coke gasification. Also, the ability to decontaminate the coke in/prior to the coking process can substantially reduce the gas clean-up requirements. The dramatically lower levels of ash and sulfur in desulfurized petroleum coke of the present invention can significantly reduce the capital and operating costs of the gasification process. In this manner, the upgraded petroleum coke can effectively replace various coals and cokes, partially or fully, in these gasification technologies.

MAGNETOHYDRODYNAMIC ELECTRIC GENERATION

The upgraded petroleum coke can be extremely valuable as a premium fuel for magnetohydrodynamic or MHD electric generation. The MHD process is currently under development. Conceptually, MHD electric generation occurs when hot, partially ionized combustion gases (plasma) are expanded through a magnetic field. This hot gas is produced in a coal combustor at temperatures approaching 5000° F. In order to achieve these temperatures, the combustion air must be preheated above 3000° F. The gas ionization is increased by seeding the gas with an easily ionized material, such as potassium compounds. The spent seed compounds are treated and recycled for economic and environmental reasons. The major advantage of this technology is potential cycle efficiencies in excess of 60%, compared to conventional cycle efficiencies of 35–38%. Achieving such high operating temperatures can be accomplished more readily with the upgraded petroleum coke of the present invention. The upgraded petroleum coke has substantially lower ash and moisture content than most coals. Also, the crystalline structure of the upgraded petroleum coke has significantly higher porosity and can provide a finer fuel particle size distribution. Consequently, the upgraded coke can burn faster and cleaner, with minimal carbon residue. These properties potentially increase the maximum flame temperatures, as well. In addition, the quality and quantity of the VCM in the upgraded petroleum coke can be readily formulated and controlled to optimize combustion properties and prevent premature combustion with very hot preheated air. Furthermore, the lower ash content can provide economic advantage in (1) the recovery/recycle of the seed compounds, (2) erosion prevention, and (3) environmental controls. Finally, an upgraded petroleum coke that has been desulfurized and/or demetallized can provide further advantages in this combustion system and environmental controls.

NON-COMBUSTION APPLICATIONS

Additional embodiments include any process that (1) uses coal or petroleum coke for its physical and chemical properties (in addition to or regardless of its fuel value), and (2) is enhanced by the improvements of the upgraded petroleum coke of this invention. These end-user applications include, but should not be limited to, cement kilns, coal/coke liquefaction, coal/coke cleaning or any process that uses coal and/or coke as a raw material or chemical feedstock. The present invention anticipates that the chemical and physical properties (as well as the fuel properties and combustion characteristics) of the new formulation of petroleum coke will offer improved operations for these types of applications. In these applications, the modified physical and/or chemical properties may or may not be used in conjunction with the improved fuel properties and combustion characteristics.

B. Fuel Processing Improvements: Additional Embodiments

MORE THAN ONE FUEL PROCESSING SYSTEM

In some cases, the petroleum coke end-user can have more than one fuel processing system. Site-specific design, operational, and/or other constraints may inhibit the fuel processing system benefits described in the preferred embodiment. For example, the facility may already have or desire more than one fuel processing/management system. Similarly, certain refining operations and coking processes may not be capable of producing consistent fuels due to abnormal variations in operation and coker feedstocks. Thus, modified fuel processing systems may be required. In either case, the present invention still provides sufficient utility in these situations and should not be limited.

MODIFICATIONS TO LOWER SPONGE COKE SPECIFICATIONS

In some cases, the petroleum coke end-user can modify the design or operation of the existing fuel processing system to reduce the "minimum-acceptable" sponge coke specification. These modifications include (but should not be limited to) pulverizer type, capacity, number, and power usage characteristics. The present invention anticipates these changes in an effort to (1) improve the operation and reliability of the combustion system and/or (2) reduce the degree of changes in the coker process. These modifications can be more cost effective in certain situations.

C. Combustion Improvements; Additional Embodiments

MODIFICATIONS TO LOWER VCM SPECIFICATIONS

In some cases, the petroleum coke end-user can modify the design or operation of the existing combustion system to reduce the "minimum-acceptable" VCM specification. These modifications include (but should not be limited to) burner design, burner number, air controls/distribution, furnace configuration, and boiler operation. The present invention anticipates these changes in an effort to (1) improve the operation and reliability of the combustion system and/or (2) reduce the degree of changes in the coker process. These modifications can be more cost effective in certain situations.

MODIFICATIONS TO LOWER SPONGE COKE SPECIFICATIONS

In some cases, the petroleum coke end-user can modify the design and/or operation of the existing combustion system to reduce the "minimum-acceptable" sponge coke specification. These modifications include (but should not be limited to) burner design, burner number, air controls/distribution, furnace configuration, and boiler operation. The present invention anticipates these changes in an effort to (1) improve the operation and reliability of the combustion system and/or (2) reduce the degree of changes in the coker process. These modifications can be more cost effective in certain situations.

MODIFICATIONS TO AVOID COKE DECONTAMINATION

Another embodiment of the present invention would modify the combustion systems or operations of the petroleum coke user, and avoid the need for coke decontamination. Some combustion system modifications, including modified firing techniques, firebox temperature profiles, and combustion equipment design/operation can alleviate the detrimental effects of certain salts and metals.

NEW DESIGNS THAT AVOID COKE DECONTAMINATION

Another embodiment of the present invention anticipates new designs for combustion systems with combustion, heat exchange, and air pollution control systems that are capable of handling the detrimental effects of the petroleum coke contaminants, including sulfur. Thus, the need for petroleum coke decontamination can be avoided.

D. Heat Exchange Improvements; Additional Embodiments

MODIFICATIONS TO AVOID COKE DECONTAMINATION

Another embodiment of the present invention would modify the heat exchange equipment design or operation of the petroleum coke user's facility. Some modifications in heat exchange equipment design and/or operation can alleviate the detrimental effects of certain mineral deposits (e.g. salts and metals). These modifications include (but should not be limited to) better tube metallurgy, increased soot blowing frequency, heat transfer temperature profiles, and heat transfer equipment design/operation. These modifications, with or without the combustion system modifications, may reduce or eliminate the need for petroleum coke decontamination.

NO COKE DECONTAMINATION REQUIRED

Another embodiment of the present invention would selectively use the upgraded petroleum coke in existing combustion, heat exchange and air pollution control systems that are currently capable of handling the detrimental effects of the petroleum coke contaminants without coke decontamination.

E. Environmental Controls; Additional Embodiments

The new formulation of petroleum coke can provide improved environmental benefits for a wide variety of solid-fuel applications, both existing and new. The predominant environmental control feature of the present invention is creating and converting excess capacity in the existing particulate control device. This excess capacity can be used for effective control of undesirable flue gas components by converting them to collectible particulates upstream of the existing particulate control device. The pollutants, which are controlled in this manner, would include (but not be limited to) sulfur oxides, nitrogen oxides, carbon dioxide, metals, and air toxics. Other pollutants, defined now or in the future, could also be controlled in this fashion. The new formulation of petroleum coke makes this unique retrofit control possible. In addition, the environmental issues for all embodiments are applicable regardless of the source of the upgraded petroleum coke (e.g. delayed coking & fluid coking).

OTHER FLUE GAS CONVERSION TECHNOLOGIES

Various types of technologies can be used for the conversion of gases or liquids to collectible particulates (dry or wet) upstream of the existing particulate control devices. The preferred and secondary embodiments discussed the novel application of several proven, flue gas conversion technologies that convert sulfur oxides to dry particulates. These embodiments also noted developing technologies for the conversion of carbon dioxide to collectible particulates. The present invention anticipates further development of these and other technologies to convert SOx and $CO_2$. These technologies may include different reagents, reagent preparation, and reagent injection systems. The present invention also anticipates the development of other technologies for the conversion of nitrogen oxides, air toxics, and other pollutants. The conversion of air toxics, such as heavy metal vapors (e.g. mercury), is an area of great potential in the future.

EXISTING DRY SCRUBBER

Another embodiment of the present invention is solid-fuel combustion systems with an existing dry scrubbing system, new or otherwise. An existing dry scrubber can be modified to use existing particulate control capacity for additional control of undesirable flue gas components, particularly sulfur oxides. The reagent injection and subsequent reaction zones would need to be modified to provide for (1) greater injection rates, (2) adequate mixing, and (3) comparable residence time. The optimal application of these technologies for site-specific situations can be determined through evaluation of the engineering factors involved.

DESULFURIZATION AND/OR DEMETALLIZATION OF THE UPGRADED COKE

Another embodiment of the present invention that would improve environmental emissions is the desulfurization and/or demetallization of the upgraded petroleum coke. As noted above, there are various methods to decontaminate the new formulation of petroleum coke. Any method that decreases the sulfur content will decrease the sulfur oxides emissions. In turn, this can make any excess capacity in the existing particulate control devices (including wet scrubbers) available for other types of environmental control (e.g. flue gas conversion of $CO_2$). Similarly, any demetallization can decrease the emissions of metals, particularly those that exit the combustion process in vapor form (e.g. mercury and vanadium oxides). EXAMPLE 4 demonstrates the effective use of desulfurized petroleum coke. Note its impact on the sulfur oxides emissions and the increased ability to use excess PCD capacity for carbon dioxide control. In addition, desulfurization and/or demetallization of the upgraded petroleum coke can alleviate the need for high efficiency desalting. As discussed previously, very low levels of sodium are not as critical, if sulfur and vanadium levels are sufficiently low. Furthermore, certain types of desulfurization and/or demetallization of upgraded coke can produce very low levels of sodium without extensive desalting. In either case, very low sodium levels are still preferable, unless their achievement becomes incompatible with other objectives.

NO CHANGE IN THE EXISTING ENVIRONMENTAL CONTROL SYSTEM(S)

Another embodiment of the present invention would selectively use the upgraded petroleum coke in existing combustion/air pollution control systems (e.g. ESP & wet scrubber) that are currently capable of handling the level of sulfur in the upgraded petroleum coke of the present invention. Many environmental regulations have pollution control limits for sulfur oxides, written in pounds per million Btu heat release of the fuel. Consequently, petroleum coke with a higher concentration of sulfur can be substituted for a coal with lower sulfur concentration without exceeding the regulatory limits. EXAMPLES 1–4 demonstrate this aspect of the present invention. The sulfur content of the upgraded petroleum coke is equal to or greater than the coals' sulfur contents. Yet the uncontrolled SOx emissions from the upgraded petroleum coke are less. This alternative is possible due to the 15–25% higher heat content of petroleum coke compared to most coals (e.g., 13–15,000 Btu/lb vs. 10.5–13,000 Btu/lb for bituminous coal) and its subsequent lower fuel rate.

RECYCLING OF FLUE GAS CONVERSION REAGENTS

Another embodiment of the present invention would include extensive recycling of unreacted reagents in the FGCT systems, that convert flue gas components to collectible particulates. Prior art of SOx dry scrubber technology currently recycles collected flyash into the reagent injection to increase reagent usage. However, high ash particulates of existing fuels limit the degree of recycling. The upgraded petroleum coke of the present invention has such low ash particulates that greater quantities of collected flyash can be effectively recycled to increase reagent utilization efficiencies. Increased reagent utilization efficiencies would increase the SOx control efficiency and reduce the solid wastes requiring disposal. In a similar manner, the present invention can improve other flue gas conversion technologies, as well.

REGENERATION OF FLUE GAS CONVERSION REAGENTS

Another embodiment of the present invention involves the regeneration of spent reagent in flue gas conversion technologies. This regeneration can substantially reduce the make-up reagent and waste disposal required. The regeneration process can include, but should not be limited to, hydration of the collected flyash and subsequent precipitation of the undesired ions (i.e. sulfates, carbonates, etc.). In cases where slaked lime is used as the conversion reagent, the regeneration process can greatly reduce the carbon dioxide generated in the reagent preparation process: limestone (calcium carbonate—$CaCO_4$) to lime (calcium oxide—CaO). Furthermore, the regeneration process would likely include a purge stream to remove unacceptable levels of impurities from the system. This purge stream would be analogous to blow down streams in many boiler water and cooling water systems. In many cases, this purge stream will contain a high concentration of heavy metals, including vanadium. Various physical and/or chemical techniques can be used to extract and purify these metals for commercial use. Finally, the ability to continually regenerate reagents provides the opportunity to improve the flue gas conversion process through the use of exotic reagents; not considered previously due to costs. In this manner, the regeneration of conversion reagents can (1) substantially reduce reagent and flyash disposal costs, (2) reduce $CO_2$ emissions, (3) create a resource for valuable metals, and (4) provide the means to economically improve the flue gas conversion process via the use of more exotic reagents.

SALABLE BY-PRODUCTS FROM FGC TECHNOLOGIES

Another embodiment of the present invention improves the quality of flue gas conversion products to provide salable by-products and substantially reduce the solid wastes requiring disposal. The extremely low ash particulate levels (i.e. low impurities) provide greater opportunity to use the collected flyash as raw materials for various products, instead of solid waste requiring disposal. These products include, but are not limited to, gypsum wallboard and sulfuric acid.

COLLECTION OF CARBON DIOXIDE GENERATED IN REAGENT PREPARATION

Another embodiment of the present invention anticipates the development of carbon dioxide collection systems for the $CO_2$ released as a gas in the reagent preparation systems for flue gas conversion technologies. For example, most SOx dry scrubber systems convert calcium carbonate to calcium oxide and carbon dioxide, that currently goes directly to the atmosphere. The $CO_2$ collection technologies can include (but should not be limited to) activated carbon adsorbtion with pressure swing regeneration. The upgraded petroleum coke of the present invention has many desirable properties (e.g. high porosity, high HGI, etc.) for use as the activated carbon in this $CO_2$ collection process. That is, upgraded petroleum coke can be readily altered to be effectively used in this carbon adsorption application. The activated coke eventually loses activation after numerous cycles of use and regeneration. The deactivated coke can then be blended into the coke fuel and subsequently burned in the combustion system.

INTEGRATION OF ACTIVATED COKE REMOVAL TECHNOLOGIES

Combined control of SOx and NOx emissions has been commercially achieved in Germany and Japan using sorbent beds of activated coke or activated char in the flue gas stream. The activated coke/char can adsorb $SO_2$ and catalyze the reduction of NOx to nitrogen gas by ammonia injection. $SO_2$ removals of 90–99+% and NOx removals of 50–80+% have been reported for low- to medium-sulfur systems. An additional advantage of this system is noted to be the adsorbtion of air toxics and carbon dioxide to a limited extent. High coke consumption and high moisture content are noted to be potential problems, particularly in high-sulfur applications. The present invention anticipates effective integration of this technology. Similar to the previous embodiment, the upgraded coke of the present invention has many desirable characteristics of the activated carbon. In many cases, the upgraded coke can be readily modified to be effectively used as the activated coke. Again, the coke loses activation after numerous cycles of use and regeneration. Apparently, this occurs more quickly in the high-sulfur applications. Deactivated coke can then be blended into coke fuel and subsequently burned in the combustion system.

In a similar manner, the upgraded coke of the present invention can be used for activated carbon technologies for the removal of air toxics (e.g. mercury), carbon dioxide, or other undesirable flue gas components. The activated carbon technologies for these components system can be integrated (1) fully into the SOx/NOx activated coke system (to the extent possible), (2) share auxiliary systems, or (3) work independently with or without the SOx/NOx activated coke system. In any case, deactivated coke can be blended into the coke fuel and subsequently burned in the combustion system.

E. EXAMPLE 3

Low-Sulfur Lignite Coal vs. Medium Sulfur Coke with Dry Sorbent Injection

Another power utility has a conventional, pulverized-coal fired utility boiler that currently burns a low-sulfur, lignite coal from Texas. The existing utility has a large-capacity, particulate control device with no sulfur oxides control. Full replacement of this coal with a medium-sulfur, petroleum coke produced by the present invention would have the following results:

| Basis = 1.0 × $10^9$ Btu/Hr Heat Release Rate as Input | Current Coal | Upgraded coke | Results |
|---|---|---|---|
| Fuel Characteristics | | | |
| VCM (% wt) | 31.5 | 16.0 | 49% Lower |
| Ash (% wt.) | 50.4 | 0.3 | 99+% Lower |
| Moisture (% wt.) | 34.1 | 0.3 | 99+% Lower |
| Sulfur (% wt) | 1.0 | 2.5 | 150% Higher |
| Heating Value (Mbtu/lb) | 3.9 | 15.3 | 290% Higher |
| Fuel Rate (Mlb/Hr) | 254 | 65.4 | 74% Lower |
| Pollutant Emissions: Uncontrolled/Controlled | | | |
| Ash Particulates (lb/MMBtu or Mlb/Hr) | 128/6.4 | 0.2/.01 | 99+% Lower |
| Sulfur Oxides (lb/MMBtu or Mlb/Hr) | 5.1 | 3.2/.96 | 37/81% Lower |
| Carbon Dioxide (lb/MMBtu or Mlb/Hr) | 315 | 210/150 | 33/52% Lower |

This example further demonstrates the beneficial application of the present invention. Again, the upgraded petroleum coke has substantially lower ash and moisture contents, compared to the existing coal. These factors contribute greatly to (1) the ability to burn successfully with lower VCM and (2) a fuel heating value that is 290% higher. In turn, the higher heating value requires a 74% lower fuel rate to achieve the heat release rate basis of one billion Btu per hour in the boiler. As noted previously, this lower fuel rate and the softer sponge coke substantially reduce the load and wear on the fuel processing system, while increasing the pulverizer efficiency and improving combustion characteristics.

The ash particulate emissions (ash from the fuel) are >99+% lower than the existing coal, due to the lower ash content and higher fuel heating value. Consequently, fuel switching to the upgraded coke unleashes >99% of the capacity in the large, existing particulate control device. Part of this excess capacity can now be used for the control of sulfur oxides via retrofit SOx FGC technology.

In this example, dry sorbent injection into the combustion system with the excess capacity of the existing PCD is sufficient to achieve the desirable sulfur oxides control. Dry sorbent is injected in the firebox and downstream of the air preheater to achieve 70% SOx removal. Therefore, the uncontrolled sulfur oxide emissions are reduced from 3.2 to 0.96 thousand pounds per hour. In this manner, the utility of converting the existing particulate control device to dry sorbent injection represents 81% reduction in sulfur oxides (i.e. <0.96 vs. 5.1 lb/MMBtu). This unexpected result is achieved even though the sulfur content (2.5%) of the upgraded petroleum coke is only 150% higher than the sulfur level (1.0%) of the Texas lignite coal.

In this example, carbon dioxide is reduced by the lower fuel rate and new flue gas conversion technologies (FGCT). The 74% lower fuel rate alone reduces the carbon dioxide emissions by 32%. FGCT processes convert carbon dioxide to dry solid particulates that can be collected in the conventional particulate control device. The retrofit deployment of FGC technology can be limited by the excess capacity in the existing PCD. However, the remaining part of the excess capacity is expected to provide further reductions of carbon dioxide; at least 60 Mlb/Hr. In this case, the additional $CO_2$ control from FGCT increases the combined reduction to >50%.

This example also demonstrates that the beneficial application of the present invention does not necessarily require the conversion of existing particulate control devices. Based solely on fuel switching, (74% lower fuel rate and the >99% lower ash content of the upgraded petroleum cokecoke) substantially lower environmental emissions of ash particulates, sulfur oxides, and carbon dioxide are achieved. Ash particulates are reduced by 99%. The uncontrolled SOx emissions are 37% lower, even though the sulfur content of the upgraded petroleum coke is 150% higher. Similarly, the uncontrolled carbon dioxide emissions are reduced by 32%, even though the carbon content of the upgraded petroleum coke is 163% higher (i.e. 88.8% vs. 33.8%). All of these pollutant emission reductions are achieved without conversion of the existing PCD. They come solely from switching fuel to the new formulation of petroleum coke of the present invention.

F. EXAMPLE 4

Low Sulfur Western Coal vs. Desulfurized Petroleum Coke

Another utility has a conventional, coal-fired utility boiler that currently uses a very low sulfur, sub-bituminous coal from Montana. This utility has a typical particulate control device (PCD) with no sulfur oxides emission control. Full replacement of this coal with a desulfurized (85%) petroleum coke produced by the present invention would have the following results:

| Basis = 1.0 × $10^9$ Btu/Hr Heat Release Rate as Input | Current Coal | Upgraded coke | Results |
|---|---|---|---|
| Fuel Characteristics | | | |
| VCM (% wt) | 40.8 | 16.0 | 61% Lower |
| Ash (% wt.) | 5.2 | 0.3 | 94% Lower |
| Moisture (% wt.) | 23.4 | 0.3 | 99% Lower |
| Sulfur (% wt) | 0.44 | 0.65 | 48% Higher |
| Heating Value (Mbtu/lb) | 9.5 | 15.3 | 61% Higher |
| Fuel Rate (Mlb/Hr) | 105 | 65.4 | 38% Lower |
| Pollutant Emissions: Uncontrolled/Controlled | | | |
| Ash Particulates (lb/MMBtu or Mlb/Hr) | 5.5/.3 | 0.2/.01 | 97% Lower |
| Sulfur Oxides (lb/MMBtu or Mlb/Hr) | 0.92 | 0.85 | 8% Lower |
| Carbon Dioxide (lb/MMBtu or Mlb/Hr) | 277 | 210/190 | 23/31% Lower |

This example further demonstrates the beneficial application of the present invention. Again, the upgraded petroleum coke has substantially lower ash and moisture contents, compared to the existing coal. These factors contribute greatly to (1) the ability to burn successfully with lower VCM and (2) a fuel heating value that is 61% higher. In turn, the higher heating value requires a 37% lower fuel rate to achieve the heat release rate basis of one billion Btu per hour in the boiler. As noted previously, this lower fuel rate and the softer sponge coke substantially reduce the load and wear on the fuel processing system, while increasing the pulverizer efficiency and improving combustion characteristics.

In this example, the desulfurized petroleum coke of the present invention is sufficient to achieve very low sulfur oxide emissions (<1.25 lb/MMBtu). In fact, the desulfurized coke achieves 8% lower emissions (i.e. 0.85 vs. 0.92 lb/MMBtu) than this very low sulfur, western coal, even though the desulfurized coke has 50% higher sulfur content. Consequently, the excess capacity created in the particulate control is available for other undesirable flue gas components via FGC technologies.

Carbon dioxide FGC technologies with the excess capacity of the existing PCD are expected to provide increased reductions in carbon dioxide. The ash particulate emissions (ash from the fuel) are >97% lower than the existing coal, due to the lower ash content and higher fuel heating value. Consequently, fuel switching to the upgraded coke unleashes >97% of the capacity in the existing particulate control device. This excess capacity can now be used for the control of carbon dioxide via retrofit FGC technology. Carbon dioxide FGCT reagent(s) injection/reaction vessel is added upstream of the existing particulate control device, along with any associated reagent preparation and control systems. The retrofit of this technology can be limited by the excess capacity in the existing PCD. However, the excess capacity is expected to provide further reductions of carbon dioxide; at least 20 Mlb/Hr or 7%. In this case, the combined effect of fuel switching and carbon dioxide FGCT is 30+% reduction in $CO_2$ (190 vs. 275 Mlb/hr).

The desulfurized coke can be used to make most of the excess PCD capacity (created from fuel switching) available for uses other than SOx control. As shown in Example 3, greater reductions of $CO_2$ can be expected from retrofit FGC technology, if the current coal has higher ash content and lower heating values. In this manner, additional benefits from switching to desulfurized, premium "fuel-grade" petroleum coke can be achieved in those applications.

E. EXAMPLE 5

Mixture of Existing Coal & Upgraded Petroleum Coke W/Dry Sorbent Injection

Another power utility has a conventional, pulverized-coal fired utility boiler that currently burns a medium-sulfur, bituminous coal from western Pennsylvania (i.e. Pittsburgh #8). The existing utility currently has a typical particulate control device with no sulfur oxide emissions control. Replacement of half of this coal (i.e. 50% by weight) with a high-sulfur petroleum coke produced by the present invention would have the following results:

Basis = $1.0 \times 10^9$ Btu/Hr Heat Release Rate as Input

| | Current Coal | 50/50 Coal/ Coke | Results |
|---|---|---|---|
| Fuel Characteristics | | | |
| VCM (% wt) | 40.2 | 28.1 | 32% Lower |
| Ash (% wt.) | 9.1 | 4.7 | 48% Lower |
| Moisture (% wt.) | 5.2 | 2.8 | 46% Lower |
| Sulfur (% wt) | 2.3 | 3.3 | 43% Higher |
| Heating Value (Mbtu/lb) | 12.5 | 13.9 | 11% Higher |
| Fuel Rate (Mlb/Hr) | 79.7 | 72.6 | 9% Lower |
| Pollutant Emissions: Uncontrolled/Controlled | | | |
| Ash Particulates (lb/MMBtu or Mlb/Hr) | 7.3/0.7 | 3.8/0.4 | 43% Lower |
| Sulfur Oxides (lb/MMBtu or Mlb/Hr) | 3.7/3.7 | 4.7/1.4 | 62% Lower |
| Carbon Dioxide (lb/MMBtu or Mlb/Hr) | 216 | 210 | 3% Lower |

This example further demonstrates the beneficial application of the present invention. The 50%/50% mixture of the existing coal and upgraded petroleum coke has significantly lower ash and moisture contents, compared to the existing coal. These factors contribute greatly to (1) the ability to burn successfully with lower VCM and (2) a fuel heating value that is 11% higher. In turn, the higher heating value requires a 9% lower fuel rate to achieve the heat release rate basis of one billion Btu per hour in the boiler. As noted previously, this lower fuel rate and the softer sponge coke substantially reduce the load and wear on the fuel processing system, while increasing the pulverizer efficiency and improving combustion characteristics.

The ash particulate emissions (ash from the fuel) are >43% lower than the existing coal, due to the lower ash content and higher fuel heating value. Consequently, fuel switching to the upgraded coke unleashes >43% of the capacity in the existing particulate control device. This excess capacity can now be used for the control of undesirable flue gas components via FGC technology.

In this example, dry sorbent injection into the combustion system with the excess capacity of the existing PCD is sufficient to achieve the desirable sulfur oxides control. Dry sorbent is injected in the firebox and downstream of the air preheater to achieve 70% SOx removal. Therefore, the uncontrolled sulfur oxide emissions are reduced from 4.7 to 1.4 thousand pounds per hour. In this manner, the utility of converting the existing particulate control device to dry sorbent injection SOx FGCT represents 62% reduction in sulfur oxides (i.e. 1.4 vs. 3.2 lb/MMBtu). This unexpected result is achieved even though the sulfur content (3.3 wt. %) of the coal/coke mixture is 43% higher than the sulfur level (2.3%) of the existing coal.

6. Use of Premium "Fuel-Grade" Petroleum Coke: Optimized Environmental Embodiment The various methods and embodiments of the present invention, used to control environmental emissions, can also be used to optimize the overall environmental controls for specific combustion applications. In this manner, an existing combustion facility can be modified to produce the optimal combination of environmental controls to meet or exceed environmental regulations. The following embodiment provides a means (1) to produce an upgraded petroleum coke that not only achieves the basic objectives of this invention, but (2) to also optimize the various environmental control options for various undesirable flue gas components and solid wastes.

As noted earlier, the upgraded petroleum coke of the present invention has unique combustion characteristics that provides for novel combinations of environmental control technologies. That is, much lower ash particulates and lower fuel rates of the upgraded petroleum coke creates tremendous capacity in the existing particulate control device to use for the collection of various undesirable flue gas components. However, the undesirable flue gas components must be converted to collectible particulates (dry, wet, or otherwise) upstream of the existing particulate control device (PCD). Consequently, the level of control for each undesirable flue gas component will depend on several factors: (1) Net availability of PCD capacity, (2) Effectiveness of conversion to collectible particulates, (3) Characteristics of conversion reagents: Selectivity, reactivity, chemical complexity, etc, and (4) Reaction characteristics: temperature, residence time, and mixing requirements. The selectivity of the conversion reagent is a key aspect, when trying to control specific undesirable flue gas components. Otherwise, the reagent will be wasted on components that are not intended for conversion to collectible particulates (e.g. carbon dioxide versus sulfur oxides).

Pilot plant studies can be designed to determine the appropriate combination of various techniques described in this invention to optimize the control of various undesirable flue gas components. The following procedure can provide an adequate means to optimize the novel combinations of environmental controls of the present invention in an existing combustion facility:

1. Create PCD Capacity; Reduction in Ash Particulates and Fuel Rate Due to Fuel Switching:
   a. Analyze PCD capacity created: PCD design and operating parameters
      Calculate increase in collection area/flue gas ratio; due to decrease in flue gas flow rate
      Determine available capacity, based on differences in particulate collection characteristics
   b. Evaluate potential for particulate conversion technologies w/o exceeding particulate regulations
2. Control of Undesirable Flue Gas Components: SOx, NOx, Carbon Dioxide, Air Toxics, Metals, etc.
   a. Determine level of control required for each undesirable flue gas component
   b. Prioritize undesirable flue gas components (e.g. SOx, $CO_2$, NOx, air toxics, etc.)
   c. Evaluate control options for each undesirable flue gas component
      Fuel replacement only: Lower fuel rate and better combustion characteristics
      Reagent injection in the furnace and/or downstream heat exchange
      Retrofit reaction chamber with reagent injection and mixing systems
      Coker feedstock decontamination and/or treatment (s) of upgraded petroleum coke
      Combination of above and/or other control options
   d. Integrate all possible control combinations into various control scenarios
   e. Optimize various control scenarios to achieve control objectives at lowest cost This optimization process is unique for each specific combustion facility, and can become quite complex and time-consuming. First of all, the process must take into account many site-specific factors, including (1) design and operation of the existing combustion facility and particulate control devices and (2) characteristics of the existing fuel and the replacement upgraded petroleum coke fuel. Secondly, the optimization process must carefully consider the relative impacts of the individual control systems on each other, when combined in a control scenario. For example, the reagents to convert undesirable flue gas components to collectible particulates may interfere with each other. Alternatively, they can create undesirable compounds (e.g. ammonium bisulfate from reagent ammonia) that can foul, plug, or corrode downstream system components. Finally, the mix of various collectible particulates (e.g. calcium sulfates, ammonium bicarbonates, etc.) can inhibit the effective use of reagent (flyash) recycling/regeneration to improve reagent utilization and reduce solid waste disposal. Some of these principles are illustrated in the following embodiment of maximum environmental protection.

The embodiment of maximum environmental protection would likely include desulfurization and demetallization of the upgraded petroleum coke and convert excess particulate control capacity in the existing system for additional removal of various undesirable flue gas components.

1. Sulfur Oxides (SOx): Though most of the sulfur (e.g. >85%) would be removed in the hydrodesulfurization of the coker feedstocks, additional control of sulfur oxides can be completed by injection of reagents in the furnace and downstream heat exchange. In this manner, 50–70% of the remaining SOx could be converted to collectible particulates, or >93% total reduction.
2. Carbon Dioxide ($CO_2$): In this embodiment, $CO_2$ is given second priority for available PCD capacity. Carbon dioxide would likely be converted to collectible particulates via retrofit reaction chamber(s) with reagent injection and mixing systems. Reaction efficiency and available PCD capacity would primarily limit the level of $CO_2$ removal. Additional PCD capacity could be added as part of the retrofit project. Regeneration and recycle of conversion reagents would likely broaden $CO_2$ conversion options and improve economic viability.
3. Air Toxics; Most of the air toxic emissions associated with combustion processes are related to the heavy metals (e.g. mercury, vanadium, nickel, etc.) in the fuel. These air toxics could also be converted to collectible particulates, as long as their conversion reagents are compatible and do not interfere with the conversion reagents for the SOx and $CO_2$. However, the hydrodesulfurization of coker feedstock will also decrease the metals content of the coke. Consequently, the consumption of available PCD capacity for air toxics removal is not expected to be significant.
4. Nitrogen Oxides (NOx): The nitrogen content of petroleum coke is normally reduced by the hydrodesulfurization of the coker feed. Nitrogen oxides are further reduced by the lower fuel rates of the petroleum coke. Furthermore, the dramatically lower ash, which is responsible for more uniform and stable flame, makes the upgraded petroleum coke more susceptible to Low NOx burner designs for lower emissions of nitrogen oxides (NOx). The remaining NOx could also be converted to collectible particulates, but selective noncatalytic reduction (SNCR) would likely be preferred and more effective. SNCR technologies convert NOx to molecular nitrogen via ammonia injection into the furnace at about 1400–1800° F. However, excess ammonia needs to be minimized to avoid conversion of SOx to ammonium bisulfate, which deposits on downstream heat exchange.

In conclusion, the present invention provides various mechanisms of environmental protection, if needed, far beyond what can be achieved with most coals. As noted above, the present invention provides several embodiments to address the concerns of environmental protection and compliance. The optimization of these methods and embodiments can create a variety of control scenarios to address the specific needs (compliance, economic, etc.) of a particular combustion facility, existing or otherwise.

7. Other Embodiments; General Issues

Finally, an additional embodiment of the present invention may be any combination of the above embodiments. Engineering factors will determine the optimal application for any of the above embodiments, separately or in combination. In any combination of the embodiments, the degree required may be less than specified here due to the combined effects. Again, these concepts and embodiments may be applied to delayed coking, Fluid Coking®, Flexicoking® and other types of coking processes, available now or in the future.

In view of the foregoing disclosure, it may be within the ability of one skilled in the relevant fields to make alterations to and substitutions in the present invention, without departing from the spirit of the invention as reflected in the appended claims.

CONCLUSION

Thus the production and use of the premium "fuel-grade" petroleum coke, in the manner described in the present invention, provides a superior solid fuel for conventional, coal-fired utility boilers and various other solid-fuel combustion applications. The environmental controls of the present invention also provide unique technology applications with superior control capabilities.

While the above description contains many specificities, these should not be construed as limitations on the scope of the invention, but rather as an exemplification of preferred embodiments thereof. For example, other possible variations of the invention include those brought about through the substitution of equivalent components or process steps. Accordingly, the scope of the invention should be determined not by the embodiments illustrated, but by the appended claims and their legal equivalents, the appended claims hereby being incorporated herein by reference.

What is claimed is:

1. A process of producing a coke fuel, said method comprising the steps:

(a) obtaining a coke precursor material derived from crude oil, and having a volatile organic component; and (b) subjecting said coke precursor material to a thermal cracking process for sufficient time and at sufficient temperature and under sufficient pressure so as to promote the production of sponge coke and to produce a coke product having volatile combustible material (VCM) present in an amount in the range of from about 13% to about 50% by weight;

wherein said coke product is comprised of sponge coke in an amount in the range of about 40% to 100% by weight.

2. A process according to claim 1 wherein said coke precursor material is subjected to an efficient desalting process prior to step (b) and sodium levels are reduced to <15 ppm by weight.

3. A process according to claim 1 wherein said volatile combustible material in said coke product is in the range of from about 15% to about 30% by weight.

4. A coke product made in accordance with a process according to claim 1.

5. A coke product made in accordance with a process according to claim 2.

6. A method for producing energy, said method comprising combusting a fuel, said fuel comprising coke, said coke comprising sponge coke in an amount in the range of about 40% to 100% by weight and having volatile combustible materials in amount in the range from about 13% to about 50% by weight.

7. A method for producing energy according to claim 6 wherein said volatile combustible materials in said coke is in the range of from about 5% to about 30% by weight.

8. A method for producing energy according to claim 6 wherein said fuel comprises a mixture of said coke and coal, wherein the heat release rate ratio of said coke to said coal in said mixture is greater than about 1:4.

9. A method for producing energy according to claim 6 wherein said fuel consists essentially of coke comprising volatile combustible materials in amount in the range from about 13% to about 50% by weight.

10. A method for producing energy according to claim 6 wherein said fuel consists essentially of coke comprising volatile combustible materials in amount in the range from about 15% to about 30% by weight.

11. A process according to claim 2 wherein said sodium levels are reduced to less than about 5 ppm by weight.

12. A process according to claim 1 wherein said coke product is comprised of sponge coke in an amount in the range of about 60% to 100% by weight.

13. A method according to claim 6 wherein said coke has sodium present in an amount less than about 25 ppm by weight.

14. A method according to claim 6 wherein said coke comprises sponge coke in an amount in the range of about 60% to 100% by weight.

15. A coke comprising sponge coke in an amount in the range of about 40% to 100% by weight, said coke having volatile combustible material (VCM) present in an amount in the range of from about 13% to about 50% by weight.

16. A coke according to claim 15 wherein said sponge coke is in an amount of about 60% to 100% by weight.

17. A coke according to claim 15 wherein said volatile combustible material (VCM) is present in an amount in the range of from about 15% to about 30% by weight.

18. A coke according to claim 15 wherein said coke has sodium present in an amount less than about 25 ppm by weight.

19. A process according to claim 1 wherein said thermal cracking process includes adding predetermined hydrocarbon compounds to promote an increase of the VCM content of said coke product to within the range of from about 13% to about 50% by weight.

20. A process according to claim 1 further comprising adding predetermined hydrocarbon compounds to said coke precursor material to promote an increase of the VCM content of said coke product to within the range of from about 13% to about 50% by weight.

21. A process according to claim 1 further comprising adding predetermined hydrocarbon compounds to said coke precursor material which are adapted to decompose at predetermined temperatures to promote the production of sponge coke during said thermal cracking process to within the range of about 40% to 100% by weight of said coke product.

* * * * *